US005937442A

United States Patent [19]

Yamaguchi et al.

[11] Patent Number: 5,937,442

[45] Date of Patent: Aug. 17, 1999

[54] SHOULDER AND ARM SUPPORT GARMENT

[75] Inventors: Mitsukuni Yamaguchi, Kanagawa; Takako Fujii; Risa Saka, both of Kyoto, all of Japan

[73] Assignee: Wacoal Corp., Kyoto, Japan

[21] Appl. No.: 08/952,042

[22] PCT Filed: Mar. 6, 1997

[86] PCT No.: PCT/JP97/00707

§ 371 Date: Nov. 6, 1997

§ 102(e) Date: Nov. 6, 1997

[87] PCT Pub. No.: WO97/33492

PCT Pub. Date: Sep. 18, 1997

[30] Foreign Application Priority Data

Mar. 14, 1996 [JP] Japan ..... 8-058109

[51] Int. Cl.[6] ..... A41D 13/00

[52] U.S. Cl. ..... 2/69; 2/44; 2/115

[58] Field of Search ..... 2/69, 79, 115, 2/2.11, 459, 461, 467, 16, 44, 92, 125, 133, 134; 602/19, 60, 61, 62, 63, 75; 482/124

[56] References Cited

U.S. PATENT DOCUMENTS

| | | | |
|---|---|---|---|
| 4,698,847 | 10/1987 | Yoshihara . | |
| 4,731,882 | 3/1988 | Ekman | 2/69 |
| 5,109,546 | 5/1992 | Dicker | 2/69 |
| 5,282,277 | 2/1994 | Onozawa | 2/69 |
| 5,308,305 | 5/1994 | Romney | 2/69 |
| 5,367,708 | 11/1994 | Fujimoto . | |
| 5,606,745 | 3/1997 | Gray | 2/69 |
| 5,659,895 | 8/1997 | Ford, Jr. | 2/69 |
| 5,708,976 | 1/1998 | Dicker | 2/115 |

FOREIGN PATENT DOCUMENTS

| | | |
|---|---|---|
| 61-239002 | 10/1986 | Japan . |
| 4-40445 | 7/1992 | Japan . |

*Primary Examiner*—Amy B. Vanatta

*Attorney, Agent, or Firm*—Merchant & Gould P.C.

[57] ABSTRACT

The invention provides a shoulder and arm support garment capable of covering at least an upper body part of a human. The shoulder and arm support garment includes a front and back body part wherein at least one portion having a strong straining force is attached to the front and/or back body part of the garment. The garment of the invention is effective for preventing and treating shoulder joint or muscle disorders and can easily be put on an taken off by ordinary people.

27 Claims, 56 Drawing Sheets

SHOULDER AND ARM SUPPORT GARMENT

TECHNICAL FIELD

The present invention relates to a shoulder and arm support garment. More specifically, it relates to a shoulder and arm support garment which is applied generally in close contact with the surface of the human body and is primarily effective for promoting the prevention or treatment of disorders etc. in the vicinity of the shoulder joint ranging from the shoulder to the arm.

BACKGROUND ART

Various kinds of sports or training activities such as pitching in baseball, tennis, shot put, rugby, judo, sumo, wrestling, and the like, excessively load the muscles of the arm or the shoulder joint to often cause disorders in this region. Moreover, it is also thought that a disorder of the shoulder called "stiff and painful shoulder of older age" occurs as a result of long-time load to the shoulder. Moreover, since human beings came to take a standing position, it is said that a simple standing position heavily loads the shoulder.

In order to prevent such disorder in the vicinity of the shoulder joint or to support the relevant muscles or bones in the vicinity of the shoulder joint when disorders occur, a taping treatment is used to strongly support the muscle region or bone which relates to the area of the disorders. Also supporters of a tube-like shape made of a stretchable relatively thick pile fabric or neoprene sheet etc. are often used to compress human body parts such as the arms and the legs, inwardly from the circumference.

However, the above mentioned conventional taping method requires skill and if the treatment is applied inadequately, it not only fails to accomplish the purpose of the preventing or treating disorders but also can produce an adverse effect, for example, such as disturbing physical movements, and increasing susceptibility to blood circulation disorders or nervous disorders on the disordered body area and other areas where the taping treatment is applied. Therefore, the taping method can be applied only by those who are skilled in the method but not by those who are not. In particular, in the case of taping treatment for the shoulder or back of the body, self taping treatment is actually impossible. Moreover, once the tape is removed when taking a bath etc. it is necessary to be treated by the skilled person again. Thus, it takes much labor and time to take a taping treatment. Moreover, in the case of taping treatment, tapes are applied to the human body by adhesives, which is not so preferred for the skin from the hygienic viewpoint. Moreover, there is another problem, that is, the area where the taping is applied is always subjected to a compression, so that the user tends to feel uncomfortable.

Recently, support garments incorporating a supporter for protecting the shoulder joint or the taping function have been suggested. Some of such garments can easily be put on, but most of them do not seem to be based on sufficient medical grounds, for example, some of them simply compress strongly the entire region to be protected.

Furthermore, the supporters etc. are often made of rubber materials such as neoprene or thick pile fabric, so that they have shortcomings: for example, deteriorating an appearance, e.g. a proportion in use, because the portion where the above mentioned materials are used swells when worn; or becoming stuffy due to the poor ventilation.

The object of the present invention is to overcome the above mentioned problems and to provide a shoulder and arm support garment which has a structure in which a tape-like portion having a strong straining force is located on the garment main part. The garment is capable of covering at least the upper body part and made of a stretchable fabric. The garment can be easily put on and taken off as necessary (e.g., when taking a bath, etc.) by ordinary people. Therefore, use of the garment does not require a skilled person as in the case of the taping treatment described above. The garment is also comfortable and has no hygienic problems such as itchiness due to the garment becoming stuffy. Furthermore, the garment is effective for prevention or treatment of disorders in the shoulder joint or the arm muscles in the vicinity of the shoulder joint.

Another object of the present invention is to provide a shoulder and arm support garment which does not deteriorate in appearance in use, such as in proportion, and is relatively excellent in ventilation.

DISCLOSURE OF THE INVENTION (1) The shoulder and arm support garment of the present invention is capable of covering at least the upper body part and made of stretchable fabric, comprising:

A) a portion having a strong straining force <<a>> comprising a portion having a strong straining force 31 which, in the back part of said garment, ranges from the portion that is located slightly near to the back center from the acromion (1) and at the edge of the acromion side of the upper region of the trapezius muscle of the human body (2) to the vicinity of the lower costa in the opposite side body (5) by way of the vicinity of angulus superior scapulae (3) and the vicinity of any of the vertebrae thoracicae VII to the vertebrae thoracicae IX (4), and B-1) a portion having a strong straining force <<b-1>> comprising a portion having a strong straining force (32) which, in the front part of said garment, ranges from the vicinity of the portion corresponding to the muscles deltoideus distalis (6) to the vicinity of the upper end portion (10) of the garment between the left and right acromion (1), (1) (the acromion is not included) and ends therein by way of the vicinity of the edge of the portion corresponding to the muscles deltoideus (9), and which, in the back part of said garment, ranges from the vicinity of the portion corresponding to the muscles deltoideus distalis (6) to the portion between the portion corresponding to the vertebrae cervicales VII and the portion corresponding to the vertebrae thoracicae III (8) by way of the vicinity of the edge of the portion corresponding to the muscles deltoideus (7) and further extends from this portion to the opposite directions similarly in the right-left symmetrically, or B-2) a portion having a strong straining force <<b-2>> that comprises a combination of: the portion having a strong straining force 32 which, in the front part of said garment, ranges from the vicinity of the portion corresponding to the muscles deltoideus distalis (6) to the vicinity of the upper end portion (10) of the garment somewhere between the left and right acromion (1), (1) (the acromion is not included) and ends therein by way of the vicinity of the edge of the portion corresponding to the muscles deltoideus (9), and which, in the back part of said garment, ranges from the vicinity of the portion corresponding to the muscles deltoideus distalis (6) to the vicinity of the upper end portion (11) of the garment between the acromion (1) and back center of the body (the acromion is not included) by way of the vicinity of the edge of the portion corresponding to the muscles deltoideus (7); and the portion having a strong straining force (33) which is provided, for connecting the right and left end portions of the portion having a strong straining force (32), in the back portion of said garment, in a way that ranges between the portion corresponding to the vertebrae cervicales VII and the portion corresponding to vertebrae thoracicae III of the human body (8), extends to the directions of the right and left shoulders (19), and is overlapped to the right and left end portions of the portion having a strong straining force (32).

In the shoulder and arm support garment of the present invention, the portion having strong straining force <<a>> has a partial effect of compressing the angulus superior scapulae and fitting the scapula in the backside of the thorax. Since all locations of the starting point and ending point of the portion having a strong straining force <<a>> and the vicinity of any of the portion (4) between vertebrae thoracicae VII to vertebrae thoracicae IX where the right and left portions having a strong straining force <<a>> intersect are in locations that are not relatively subjected to the physical motions, the dislocation of the portion having a strong straining force from the desired location can be kept at a minimum. Moreover, the portion having a strong straining force <<b-1>> or <<b-2>> supports the muscles deltoideus in a manner that sandwiches the muscles deltoideus from the front side and back side from the vicinity of the portion corresponding to the muscles deltoideus distalis (6) in an obliquely upward direction along the vicinity of the edge of the muscles deltoideus. And the portion having a strong straining force <<b-1>> or <<b-2>> can apply the stress to the humeral head (the upper edge of the humerus) in a manner that holds up the humeral head in the direction of the scapula (in a manner that fits the humeral head to the normal location of the glenoidal cavity). In addition, since the portion having a strong straining force <<b-1>> or <<b-2>> has a portion having a strong straining force extending to the right and left shoulders by way of between the portion (8) corresponding to the vertebrae cervicales VII and the portion corresponding to vertebrae thoracicae III of the human body, the load to the shoulders due to the weight of the arms can be reduced even in a simple position of hanging the arms down.

In the above mentioned shoulder arm support garment of the present invention, due to the comprehensive effect of each of the portions having straining force <<a>> and <<b-1>> or <<b-2>> in the primarily longitudinal direction, the one-sided motions or over-ranged motions can be inhibited and the load to the shoulder joint can be reduced.

Moreover, each of the portions having a strong straining force exhibits the holding power so as to keep the most desirable physical relationship of the upper arm, the shoulder joint and the scapula. In this connection, when we hang down our arms, if we can hold the location of the arm with an angle between the arm and the body side (in other words, the angle of the arms with respect to the perpendicular direction) of about 30 degrees, the load to the shoulder joint is reduced to relatively small level and we can enjoy a comfortable position. In the shoulder and arm support garment of the present invention, each of the portions having straining force <<b-1>> or <<b-2>> acts in the direction that holds up the arms, and so the shoulder and arm support garment of the present invention is also preferably designed in this respect.

Moreover, disorders in the shoulder joint by stiff and painful shoulder of older age or sports are thought to be caused by the break of stabilization mechanism of the gleno-humeral joint (in other words, the mechanism that presses the humeral head onto the humerus glenoidal cavity) and disorder in the shoulder girdle function (in other words, the function of fitting the scapula onto the thorax). Since the shoulder and arm support garment of the present invention has an effect of supporting the joint or muscle by each of the above mentioned portions having a strong straining force and mutual comprehensive effect by each of the above mentioned portions having a strong straining force, it can be used for promoting the prevention and treatment of various kinds of disorders of the shoulder joint.

Because all that is needed is to put on a shirt, the use is very easy for ordinary persons and treatment by skilled persons is not necessary (unlike taping treatment). The user can easily take the garment off when taking a bath, and can easily wash the surface of the human body (whereas the user can wash only after the tape is removed in the case of taping treatment). Thus, treatment by the skilled person is not required at every bathing. In addition, since the portion having a strong straining force is incorporated into the garment, the tightness and looseness of the compression can be obtained without making the user feel pain. In contrast, the portion where the taping is applied is always subjected to compression in the case of the taping treatment. As a result, the shoulder and arm support garment of the present invention is comfortable in use due to small supporting power when the user does not move the body. On the other hand, it can exhibit the suitable straining force while the user moves the body. Therefore, it provides a good comfortable feeling without making the user feel pain in use. Moreover, since tape is not adhered directly to the skin of the human body, as in the case of taping treatment, hygienic problems, for example, itchiness due to stuffiness, are improved.

(2) It is preferable in the shoulder and arm support garment of the present invention that the end portion which ends in the vicinity of the upper end portion (10) of the garment between the left and right acromion (1), (1) (the acromion is not included) of the portion having a strong straining force <<b-1>> or <<b-2>> in the front portion of the garment is: for the end portion of the portion having the a strong straining force <<b-1>> or <<b-2>> in the right side of the garment, located in the vicinity of the upper end portion of the garment of between the center-to-right front of the garment and the right acromion (1) (the acromion is not included); and for the end portion of the portion having the strong straining force <<b-1>> or <<b-2>> of the left side of the garment in the front part of the garment, located in the vicinity of the upper end portion (10) of the garment of between the center-to-left front of the garment and the left acromion (1) (the acromion is not included).

By such an embodiment, it is preferable that the feeling of compression of the front part in use is reduced as compared with the garment which is designed in a manner in which the long portion having the strong straining force <<b-1>> or <<b-2>> ranges from the right or left arm through the center front part of the garment respectively to the opposite side body in the vicinity of the left body or the right body of the upper portion of the garment.

(3) It is further preferable that the shoulder and arm support garment of the present invention further comprises the portion having a strong straining force (34) extending from the vicinity of the portion corresponding to the muscles deltoideus distalis (6) of the portion having a strong straining force <<b-1>> or <<b-2>> in the direction of the edge of the sleeve along the upper surface of the sleeve.

By such an embodiment, it is preferable that the effect of the above mentioned portion having straining force <<b-1>> or <<b-2>> is more strengthened and the stress is applied in a manner that holds up the humeral head (to the upper edge of the humerus) in the direction of the scapula (in a manner that can fit the humeral head in the regular location of the glenoidal cavity). In other words, the stress acts in the direction that holds up the arms, so that the load to the shoulder can be reduced.

(4) It is preferable that the shoulder and arm support garment of the present invention further comprises the portion having a strong straining force <<c>> comprising the portion having a strong straining force (41) which, in the back part of the garment, ranges from the location (8) between the portion corresponding to the vertebrae cervicales VII and the portion corresponding to the vertebrae thoracicae III of the human body to the axilla (17) by way of the vicinity of angulus superior scapulae (3).

By such an embodiment, it is preferable that the portion having a strong straining force <<c>> can enhance the effect of compressing the vicinity of the angulus superior scapulae and fitting strongly the scapula to the backside of the thorax together with the effect of the portion having straining force <<a>>.

(5) It is preferable that the shoulder and arm support garment of the present invention further comprises the portion having a strong straining force <<d>> comprising portions having a strong straining force (42) and (43) which, in the front and back parts of the garment, extend from the acromion (1) obliquely down to the vicinity of the body side of the upper arm in the portion having a minimum circumference (18) and surround the circumference of the upper arm.

By such an embodiment, the portion having a strong straining force <<d>> has a structure in which it starts from the acromion and sandwiches the shoulder joint (the glenohumeral joint) from the front and back sides, so that the portion can support the shoulder joint from many sides at the same time and can exhibit the effect of supporting the function of the shoulder joint, and can supplement and strengthen the effect of the above mentioned portion having straining force <<b-1>> or <<b-2>>. Subsequently, the load to the shoulder due to the weight of the arms can be reduced.

(6) It is further preferable that the shoulder and arm support garment of the present invention further comprises a portion having a strong straining force (45) extending from the vicinity of the body side of the upper arm in the portion having a minimum circumference (18) of the portion having a strong straining force <<d>> in the direction of the edge of the sleeve along the lower surface of the sleeve.

By such an embodiment, it is preferable that, in particular, in a case where the shoulder and arm support garment of the present invention comprises the portion having a strong straining force (34) extending from the vicinity of the portion corresponding to the muscles deltoideus distalis (6) of the portion having a strong straining force <<b-1>> or <<b-2>> in the direction of the edge of sleeve along the upper surface of the sleeve as mentioned in the above item (3), the straining force of the fabric of the lower sleeve and that of the upper sleeve can easily be balanced, and generation of the distortion in the sleeve portion can be inhibited.

(7) It is further preferable that the shoulder and arm support garment of the present invention further comprises a portion having a strong straining force <<e>> comprising a portion having a strong straining force (44) extending, in the front part of the garment, from the portion that is located slightly near to the front center from the acromion (1) and at the edge of the vicinity of the acromion side of the upper region of the trapezius muscle of the human body (2) towards the axilla (17) while curving slightly toward the front center of the human body.

By such an embodiment, it is preferable that the portion having a strong straining force <<e>> can exhibit a supplemental function that ensures the effect of the portion having a strong straining force <<a>> or the portion having a strong straining force <<a>> and the portion having a strong straining force <<c>>, as well as can exhibit the supplemental functions that easily exhibit the effects of the portion having a strong straining force <<b-1>> or <<b-2>>.

(8) It is preferable in the shoulder and arm support garment of the present invention that the portion having a strong straining force is formed in a way in which a predetermined shaped stretchable fabric is overlapped to the garment main part by stitching or adhering.

By such a preferred embodiment, it is preferable that a garment of the present invention having a durability can easily be provided.

(9) It is preferable in the shoulder and arm support garment of the present invention that the portion having a strong straining force is formed in a way in which a predetermined shaped stretchable fabric is stretched and overlapped to the garment main part by stitching or adhering.

Such an embodiment is preferred to the embodiment in which stronger straining force is required to be provided to the portion having a straining force.

(10) It is preferable in the shoulder and arm support garment of the present invention that the portion having a strong straining force is formed in a way in which elastic resin is impregnated or elastic resin film is adhered to the predetermined portion of the garment main part.

By such an embodiment, it is preferable that the portion having a strong straining force of a relatively thin thickness can be obtained.

(11) It is preferable in the shoulder and arm support garment of the present invention that the portion having a strong straining force is a portion using an elastic fiber having a thicker thickness than that of any other location in the fiber material constituting the garment main part.

By such an embodiment, it is preferable that a portion having a strong straining force of a relatively thin thickness can be obtained.

(12) It is preferable in the shoulder and arm support garment of the present invention that the portion having a strong straining force comprises a texture of knitted fabric having a stronger straining force than the texture of knitted fabric of the stretchable fabric constituting the garment main part.

By such an embodiment, it is preferable that a portion having a strong straining force of a relatively thin thickness can be obtained.

(13) It is preferable in the shoulder and arm support garment of the present invention that the portion having a strong straining force has 30 to 400 gf of straining force.

By such an embodiment, the above mentioned effect of the present invention can efficiently be exhibited and the excellent feeling of wearing can be obtained without making the user feel compression too strongly.

(14) It is preferable in the shoulder and arm support garment of the present invention that the stretchable fabric is a knitted fabric selected from the group consisting of a two directions stretchable tricot knitted fabric and a power net knitted fabric.

By such an embodiment, as compared with the conventional supporters etc. using the relatively thick pile fabric or neoprene sheet etc., the fabric having such a thickness as used for manufacturing the general clothes can be used. Therefore, a shoulder and arm support garment having little deterioration of appearance in use, for example, in proportion, that is well fitted to the body and has excellent ventilation is provided.

BEST MODE FOR CARRYING OUT THE INVENTION

Hereinafter, the specific embodiments of the present invention will be explained with reference to the figures. In the present invention, when we explain where in the garment of the present invention a portion having a strong straining force primarily exhibiting the taping function is located, we often use the names of the body parts or the portion corresponding to the muscles or the bones. Therefore, for an ease of understanding, first we will explain the locations of the skeleton of bones or the muscles of the human body used so as to explain the locations of the portions having a strong straining force.

Figure 51:
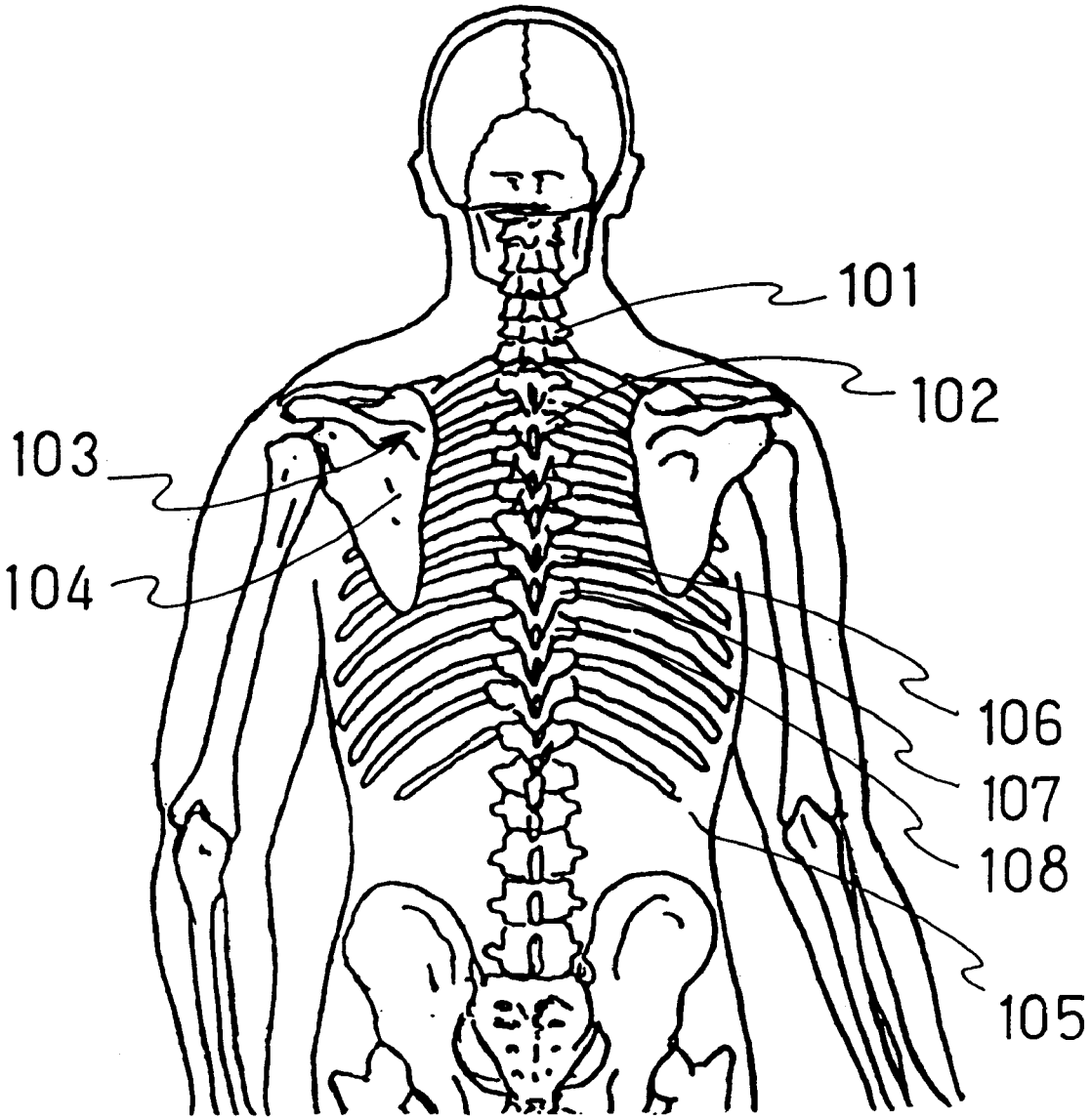
FIG. 51 is a partial skeleton chart showing a part of the skeleton viewed from the backside of the human body.

FIG. 51 is a partial skeleton chart showing a part of the skeleton viewed from the backside of the human body.

In FIG. 51, numeral 101 denotes vertebrae cervicales VII; 102 denotes vertebrae thoracicae III; 103 denotes angulus superior scapulae; 104 denotes the scapula; 105 denotes a lower region of the costa. Moreover, 106 denotes the vertebrae thoracicae VII, 107 the vertebrae thoracicae VIII, and 108 vertebrae thoracicae IX.

Figure 52:
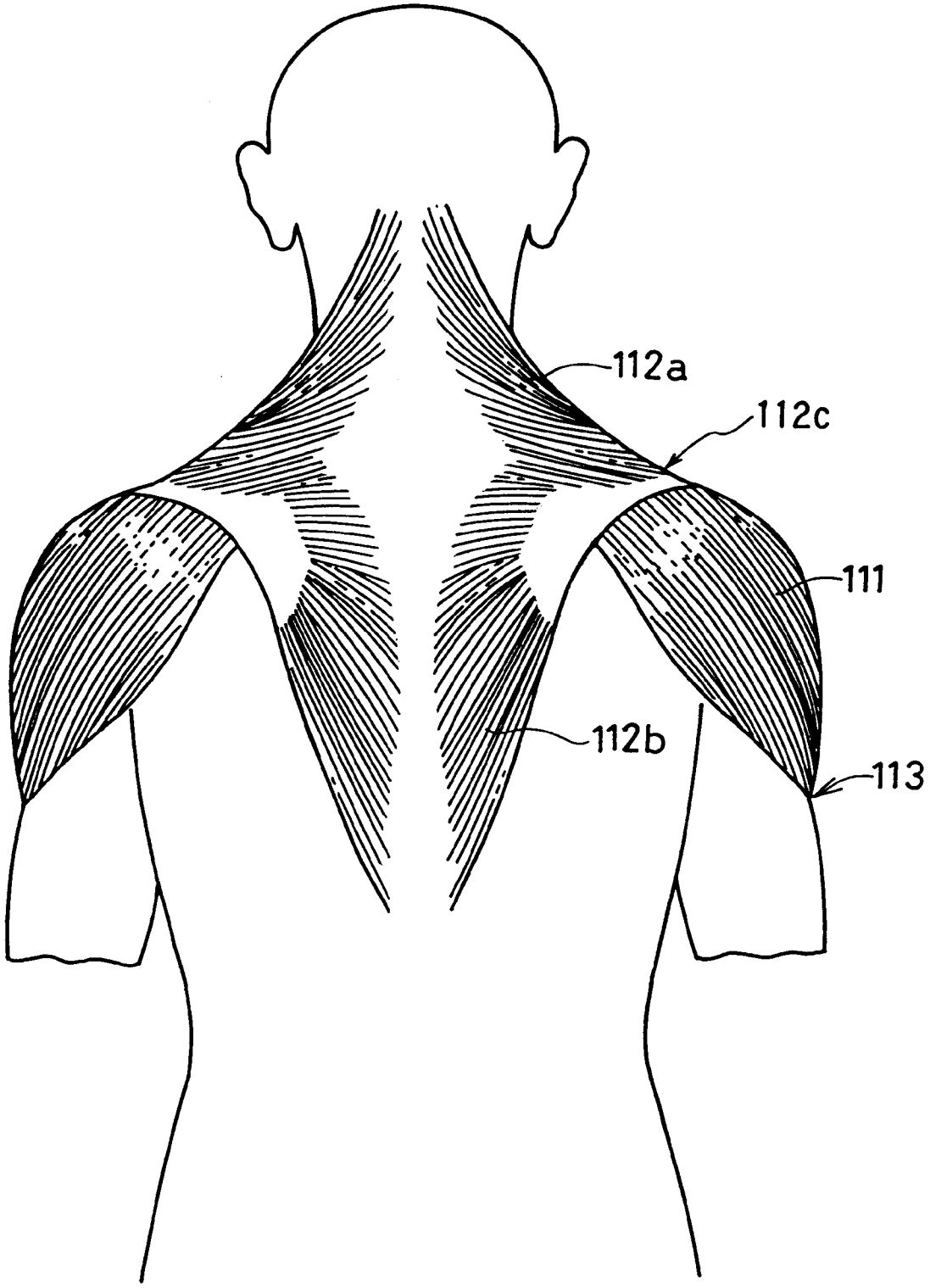
FIG. 52 is a partial view showing a part of the muscles viewed from the backside of the human body.
Figure 53:
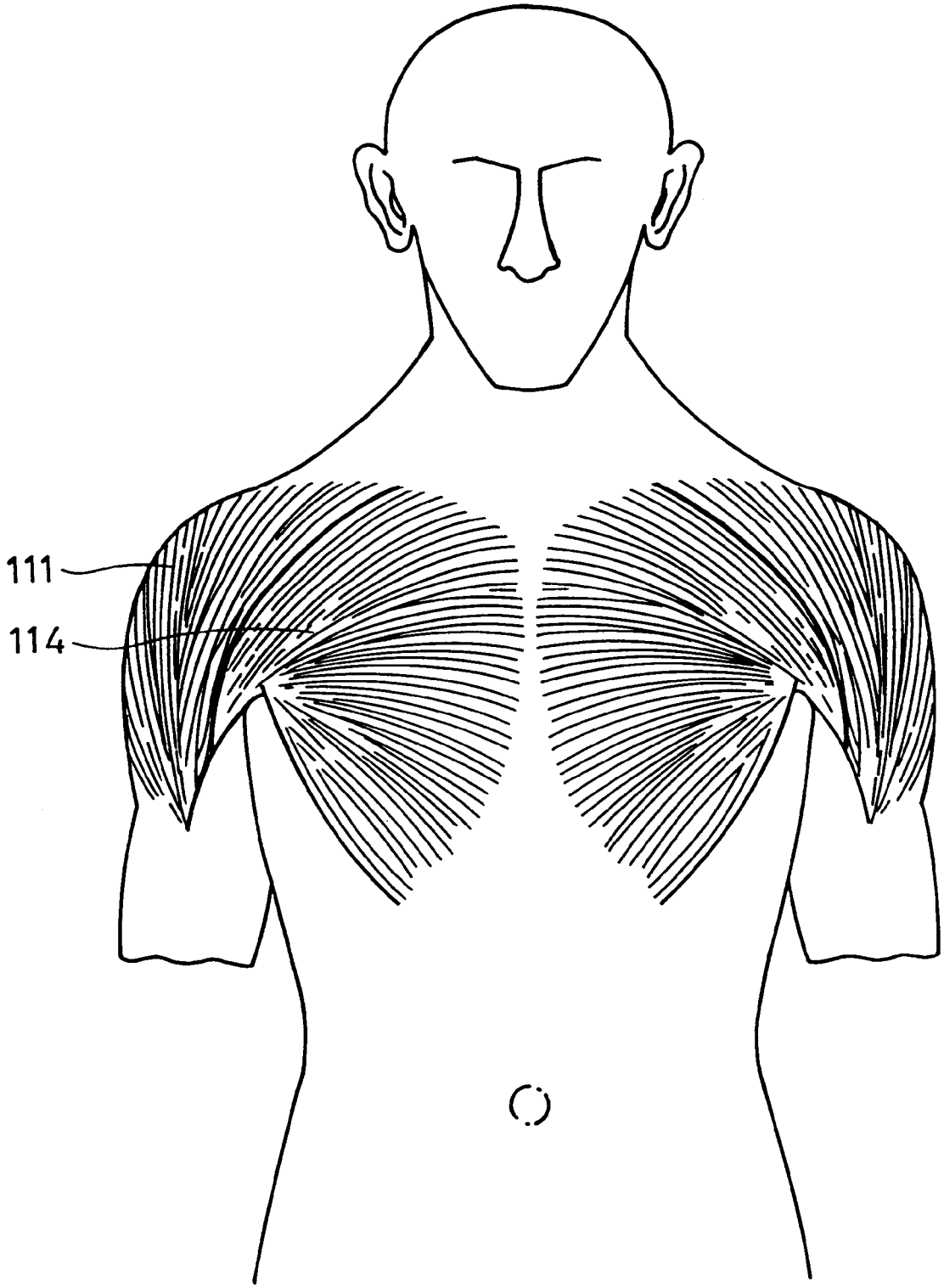
FIG. 53 is a partial view showing a part of the muscles viewed from the front side of the human body.

FIG. 52 is a partial muscle view showing a part of the muscles viewed from the backside of the human body; and FIG. 53 is a partial muscle view showing a part of the muscle viewed from the front side of the human body. In FIGS. 52 and 53, 111 denotes the muscles deltoideus; 113 denotes the distal edge of the muscles deltoideus, which means the muscles deltoideus in the vicinity of the end portion in the direction of the tip of the hand. Numeral 112 denotes the muscles trapezium, 112*a* denotes the upper region of the muscles trapezium; 112*b* denotes the lower region of the muscles trapezius; and 112*c* denotes the vicinity of the end portion of the acromion side of the upper region of the muscles trapezium. And 114 denotes the greater pectoral muscle.

Figure 54:
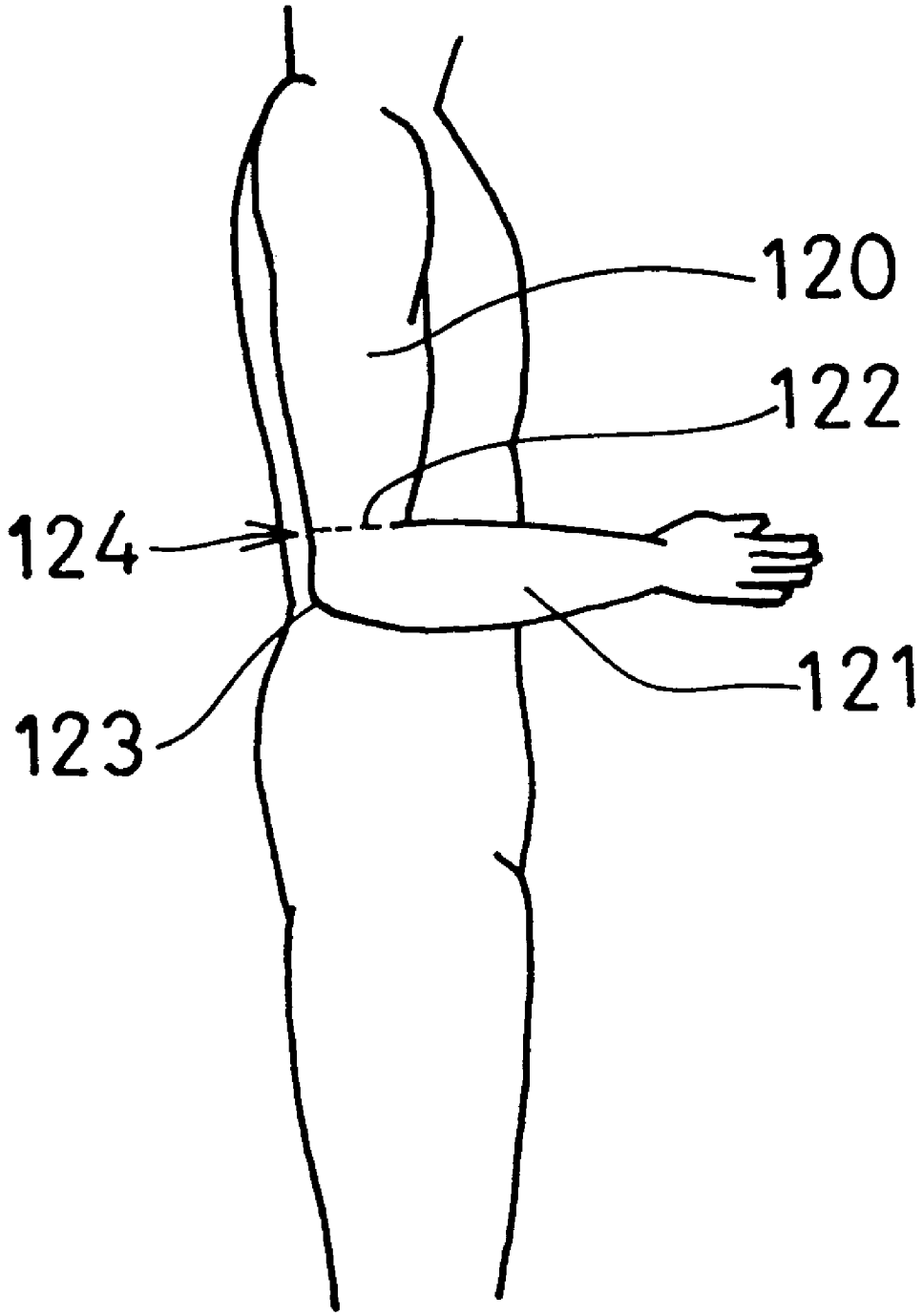
FIG. 54 is a partial view showing the left side of a human body.

Next, FIG. 54 is a partial view of the left side of the human body. It is a view to explain the location of the vicinity of the body side of the upper arm in the portion having a minimum circumference 18 for the portion having a strong straining <<d>>. The minimum circumference of the upper arm is the portion shown by the virtual line 122, which passes the contacting point where the upper arm 120 and the forearm 121 coincide when the elbow 123 is bent at a right angle and runs horizontally around the circumference of the upper arm 120. And the point approximately inside of the above mentioned minimum circumference of the upper arm is defined as the location of the body side on the minimum circumference of the upper arm 124. Moreover, in the present invention, the wording "in the vicinity of - - - " is used to explain the location on the garment of the portions having a strong straining force, and it signifies that the dislocation from the predetermined location is admissible in a scope enabling the achievement of the purpose of the present invention.

In the garment of the present invention, at least one portion having a strong straining force selected from the group consisting of the portion having a strong straining force <<a>>, and <<b-1>> or <<b-2>>, is present, moreover, if necessary, <<c>>, <<d>> and <<e>>. However, if all of these portions are illustrated in one figure of the garment, the figure is complicated and is difficult to understand. Therefore, for an ease of understanding each of the portions having a strong straining force <<a>>, <<b-1>>, <<b-2>>, <<c>>, <<d>> and <<e>>, are illustrated respectively in FIG. 27 to FIG. 50. And then, the shoulder and arm support garment of the present invention will be explained specifically.

In each case, each of the portions having a strong straining force will be explained by using a long-sleeved shirt as a typical example.

Figure 27:
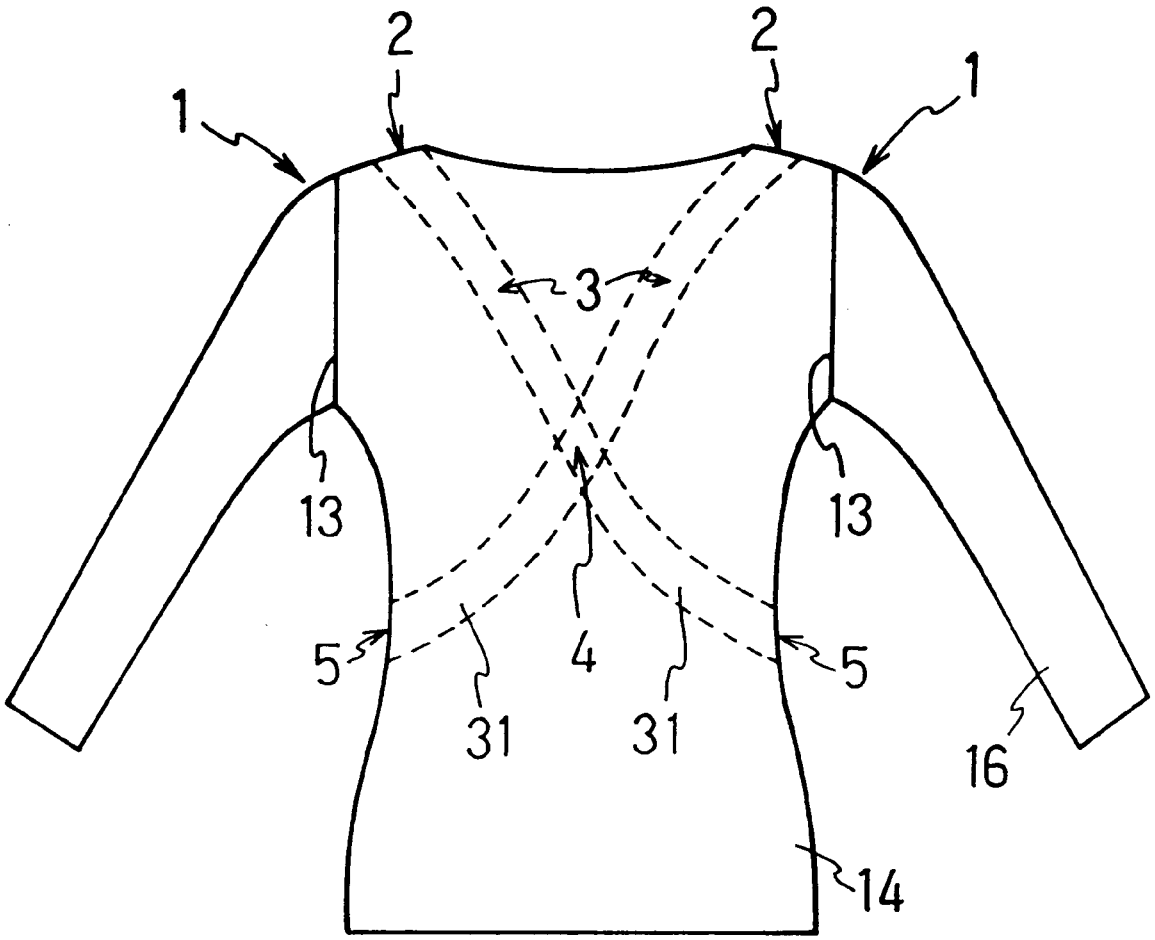
FIG. 27 is a rear view of a shirt in which a part of the portion having a strong straining force used in the present invention is drawn in the long sleeved shirt of one embodiment of the present invention.
Figure 28:
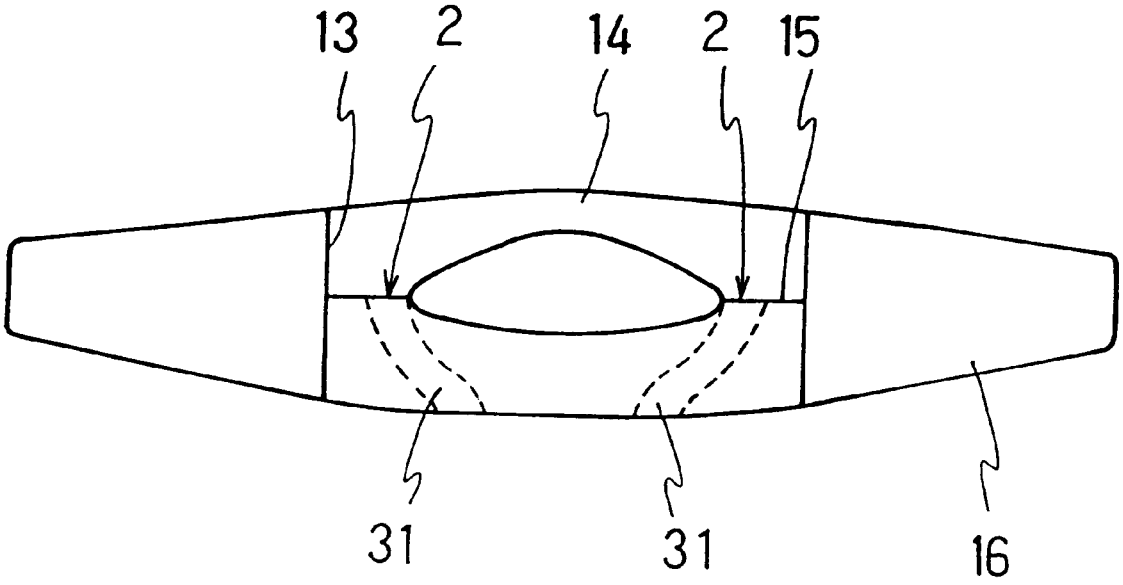
FIG. 28 is a plan view of the shirt in which the part of the portion having a strong straining force used in the present invention is drawn in the long sleeved shirt of one embodiment of the present invention.

FIGS. 27 to 28 are views to explain the portion having a strong straining force <<a>>. FIG. 27 is a rear view of a shirt and FIG. 28 is a plan view. Numeral 14 denotes a shirt main part; 13 denotes a seam line between a sleeve and body part in the shirt main part; 15 denotes a seam line between the front body and back body constituting the shirt main part; and 16 denotes the sleeve.

The portion having a strong straining force <<a>> comprises a portion having a strong straining force 31 which, in the back part of the garment, ranges from the portion that is located slightly near to the back center from the acromion 1 and at the edge of the acromion side of the upper region of the trapezius muscle of the human body 2 to the vicinity of the lower costa in the opposite side body 5 by way of the vicinity of angulus superior scapulae 3 and the vicinity of any of the vertebrae thoracicae VII to the vertebrae thoracicae IX 4. The effect of the portion having a strong straining force <<a>> has already been explained and so is omitted herein.

Figure 29:
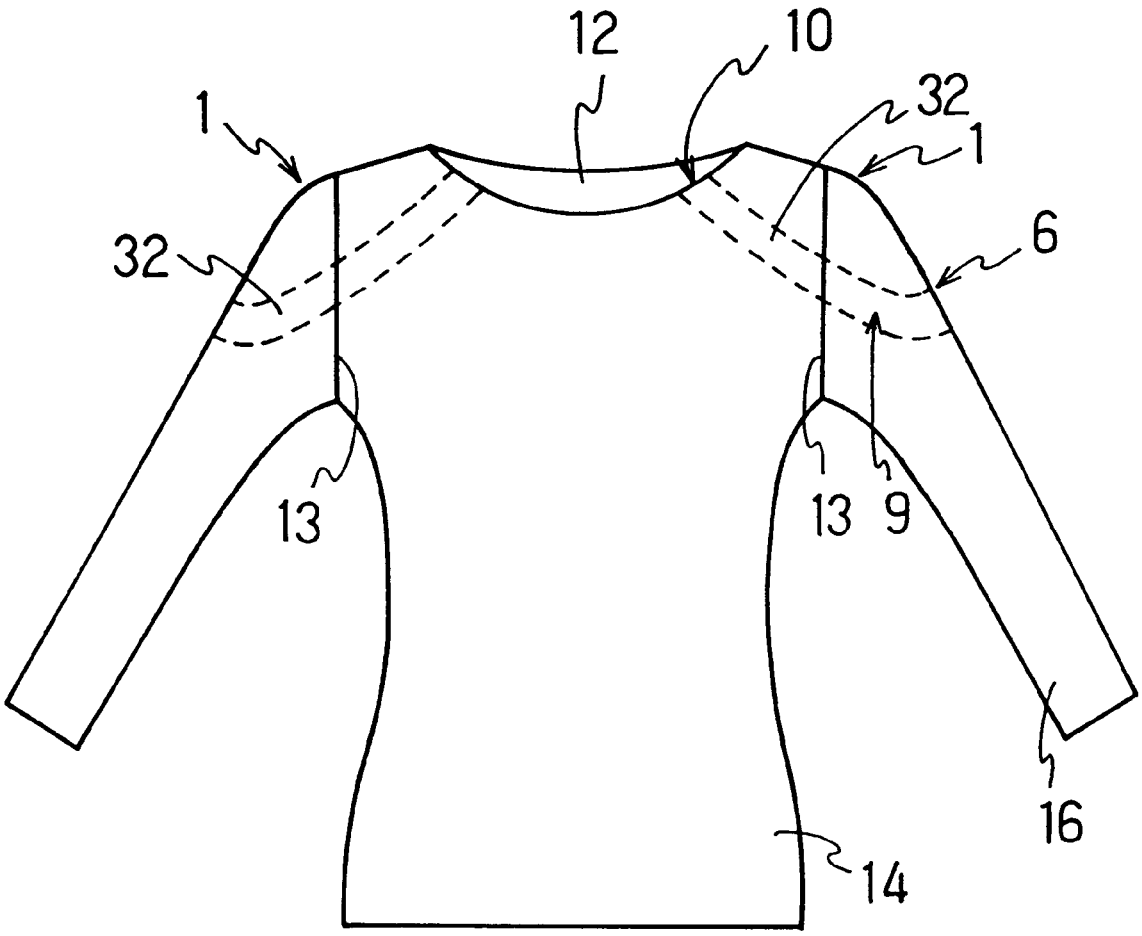
FIG. 29 is a front view of a shirt in which a part of the portion having a strong straining force used in the present invention is drawn in the long sleeved shirt of one embodiment of the present invention.
Figure 30:
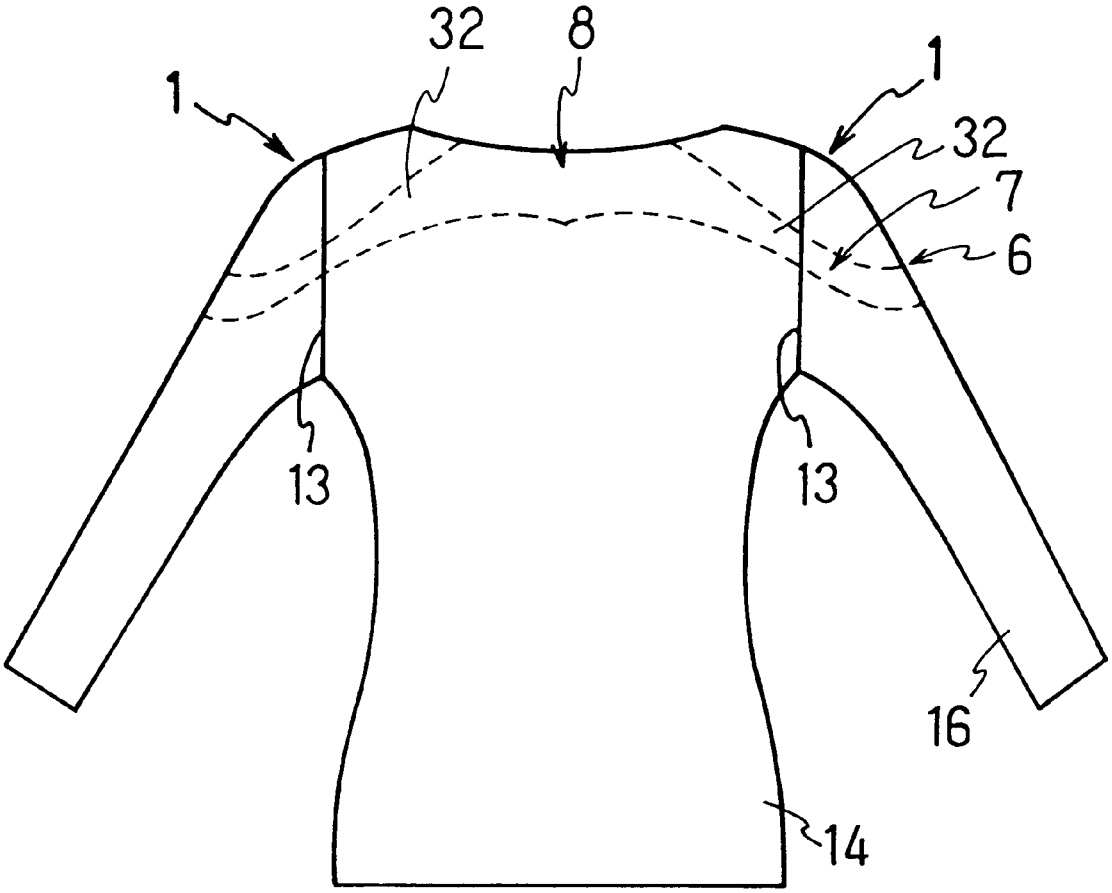
FIG. 30 is a rear view of the shirt in which the part of the portion having a strong straining force used in the present invention is drawn in the long sleeved shirt of one embodiment of the present invention.
Figure 31:
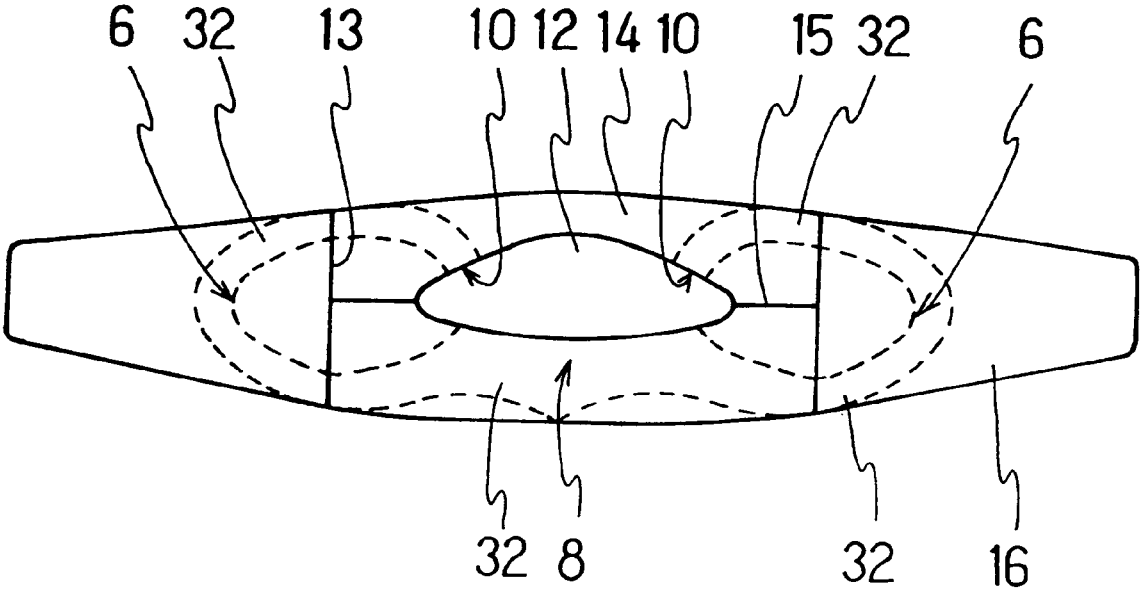
FIG. 31 is a plan view of the shirt in which the part of the portion having a strong straining force used in the present invention is drawn in the long sleeved shirt of one embodiment of the present invention.

FIGS. 29 to 31 are views to explain the portion having a strong straining force <<b-1>>. FIG. 29 is a front view of a shirt; FIG. 30 is a rear view; and FIG. 31 is a plan view.

The portion having a strong straining force <<b-1>> comprises a portion having a strong straining force 32 which, in the front part of the garment, ranges from the vicinity of the portion corresponding to the muscles deltoideus distalis 6 to the vicinity of the upper end portion 10 of the garment between the left and right acromion 1, 1 (the acromion is not included) and ends therein by way of the vicinity of the edge of the portion corresponding to the muscles deltoideus 9. In the back part of said garment, it ranges from the vicinity of the portion corresponding to the muscles deltoideus distalis 6 to the portion between the portion 8 corresponding to the vertebrae cervicales VII and the portion corresponding to the vertebrae thoracicae III by way of the vicinity of the edge of the portion corresponding to the muscles deltoideus 7 and further extends from this portion to the opposite directions similarly in right-left symmetry. The end portion shown by the numeral 10 of the portion having a strong straining force <<b-1>> is not limited to the location shown in FIG. 29, and the location is optionally determined between the right and left acromion 1, 1 (the acromion is not included). The same is true in the portion having a strong straining force <<b-2>> which will be explained hereafter. It is preferable that the end portion that ends in the vicinity of the upper end portion 10 of the garment between the left and right acromion 1, 1 (the acromion is not included) 10 of the portion having a strong straining force <<b-1>> or <<b-2>> in the front portion of the garment is: for the end portion of the portion having the strong straining force <<b-1>> or <<b-2>> in the right side of the garment, located in the vicinity of the upper end portion of the garment of between the center-to-right front of the garment and the right acromion 1 (the acromion is not included); and for the end portion of the portion having the strong straining force <<b-1>> or <<b-2>> of the left side of the garment in the front part of the garment, located in the vicinity of the upper end portion 10 of the garment of between the center-to-left front of the garment and the left acromion 1 (the acromion is not included). By such an embodiment, it is preferable that the feeling of compression of the front part in use is reduced as compared with the garment which is designed in a manner in which the long portion having the strong straining force <<b-1>> or <<b-2>> ranges from the right or left arm through the center front part of the garment respectively to the opposite side in the vicinity of the upper portion of the garment.

Figure 32:
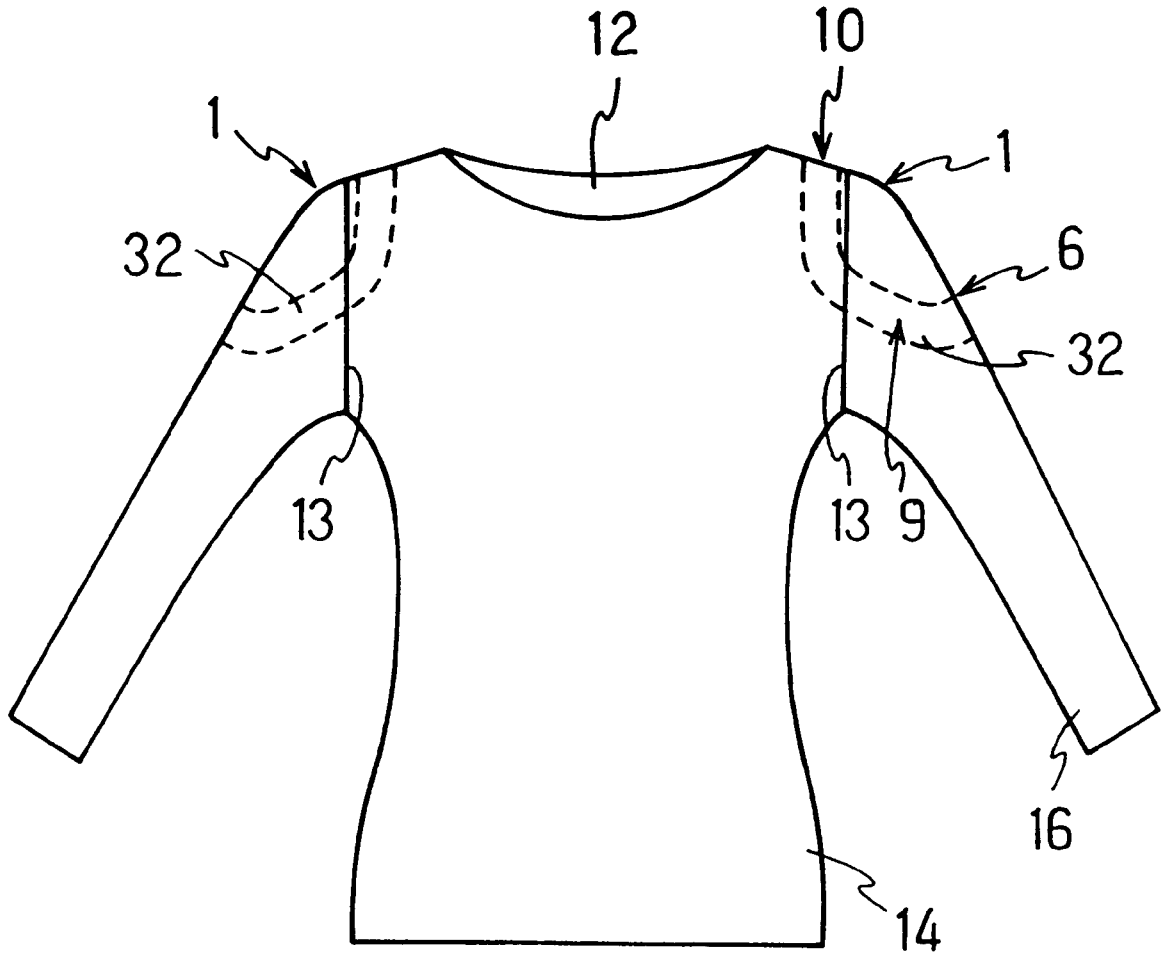
FIG. 32 is a front view of a shirt in which a part of the portion having a strong straining force used in the present invention is drawn in the long sleeved shirt of one embodiment of the present invention.
Figure 33:
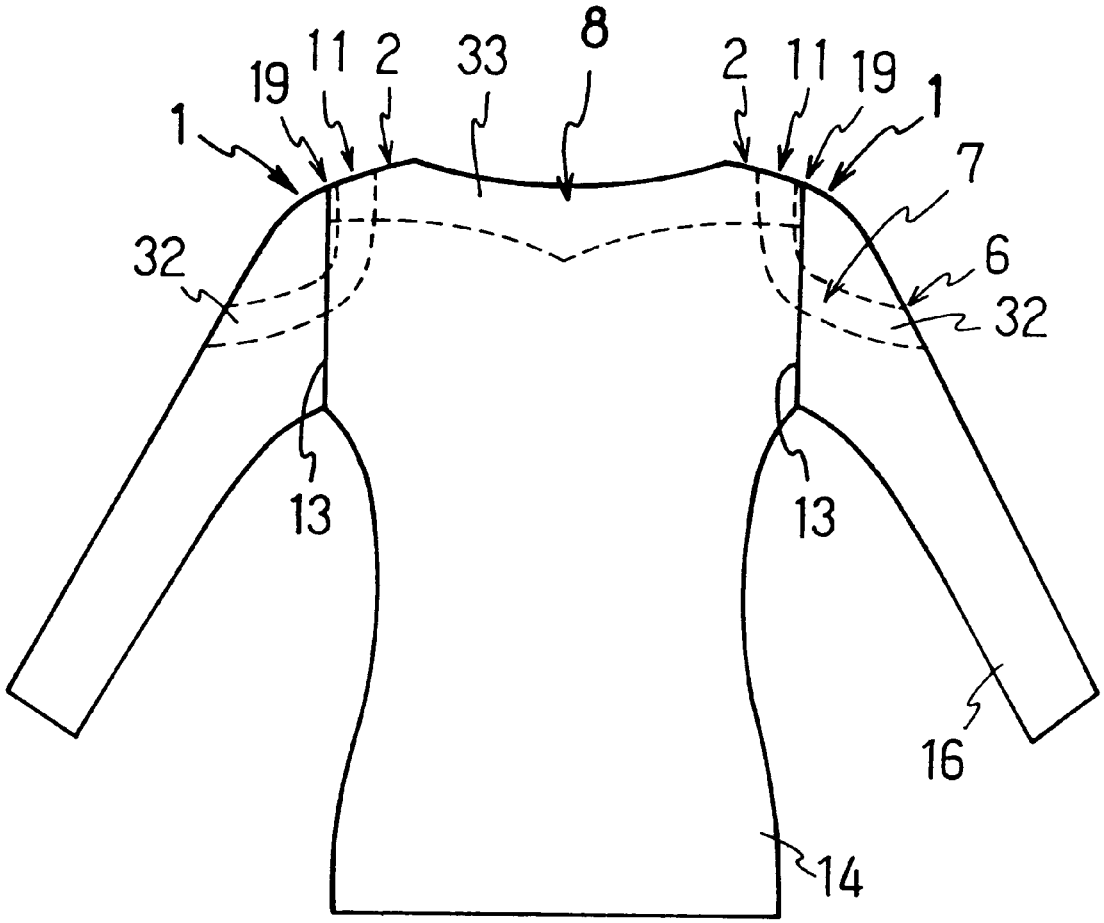
FIG. 33 is a rear view of the shirt in which the part of the portion having a strong straining force used in the present invention is drawn in the long sleeved shirt of one embodiment of the present invention.
Figure 34:
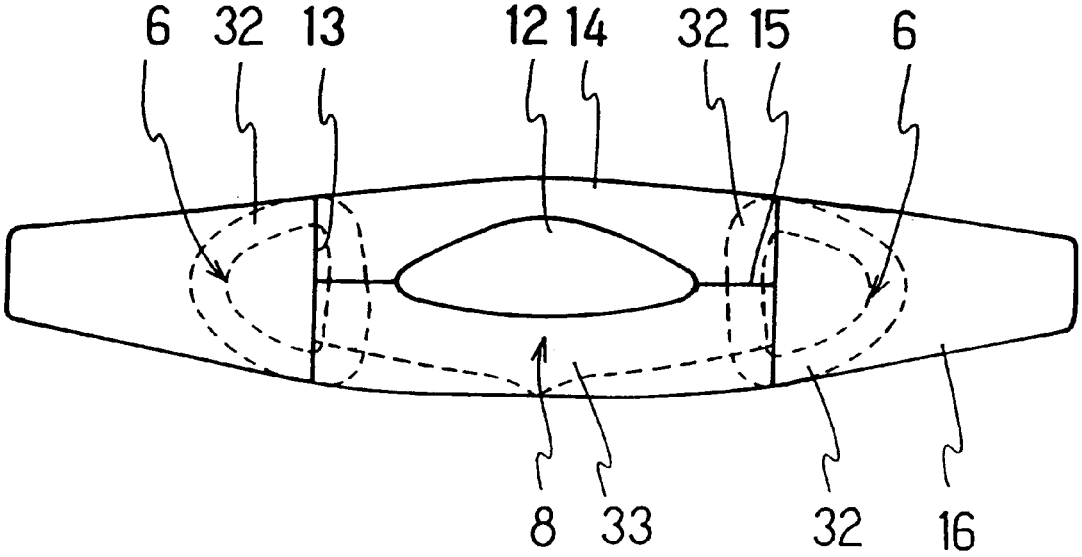
FIG. 34 is a plan view of the shirt in which the part of the portion having a strong straining force used in the present invention is drawn in the long sleeved shirt of one embodiment of the present invention.

FIGS. 32 to 34 are views to explain the portion having a strong straining force <<b-2>>. FIG. 32 is a front view of a shirt; FIG. 33 is a rear view; and FIG. 34 is a plan view.

The portion having a strong straining force <<b-2>> comprises a combination of: the portion having a strong straining force 32 which, in the front part of said garment, ranges from the vicinity of the portion corresponding to the muscles deltoideus distalis 6 to the vicinity of the upper end portion 10 of the garment somewhere between the left and right acromion 1, 1 (the acromion is not included) and ends therein by way of the vicinity of the edge of the portion corresponding to the muscles deltoideus 9, and which, in the back part of said garment, ranges from the vicinity of the portion corresponding to the muscles deltoideus distalis 6 to the vicinity of the upper end portion 11 of the garment between the acromion 1 and back center of the body (the acromion is not included) by way of the vicinity of the edge of the portion corresponding to the muscles deltoideus 7; and the portion having a strong straining force 33, which is provided for connecting the right and left end portions of the portion having a strong straining force 32, in the back portion of said garment, in a way that ranges between the portion corresponding to the vertebrae cervicales VII and the portion corresponding to vertebrae thoracicae III of the human body (8), extends to the directions of the right and left shoulders 19, and is overlapped with the right and left end portions of the portion having a strong straining force 32. The end portion shown by the numeral 11 of the portion having a strong straining force 32 is not limited to the location shown in FIG. 33, and the location is optionally determined in the vicinity of the upper edge portion between the right and left acromion 1, 1 (the acromion is not included). Moreover, the portion having strong straining force 33 is generally called a "stay cloth". When the above mentioned portion having a strong straining force <<b-2>> is employed, the stay cloth 33 is necessary. When the above mentioned portion having a strong straining force <<b-1>> is employed, the stay cloth 33 (the portion having a strong straining force 33) is not always necessary, but it is preferable for the stay cloth 33 to be used together with the portion having a strong straining force <<b-1>> since the effect of the portion having a strong straining force <<b-1>> can be enhanced.

Figure 35:
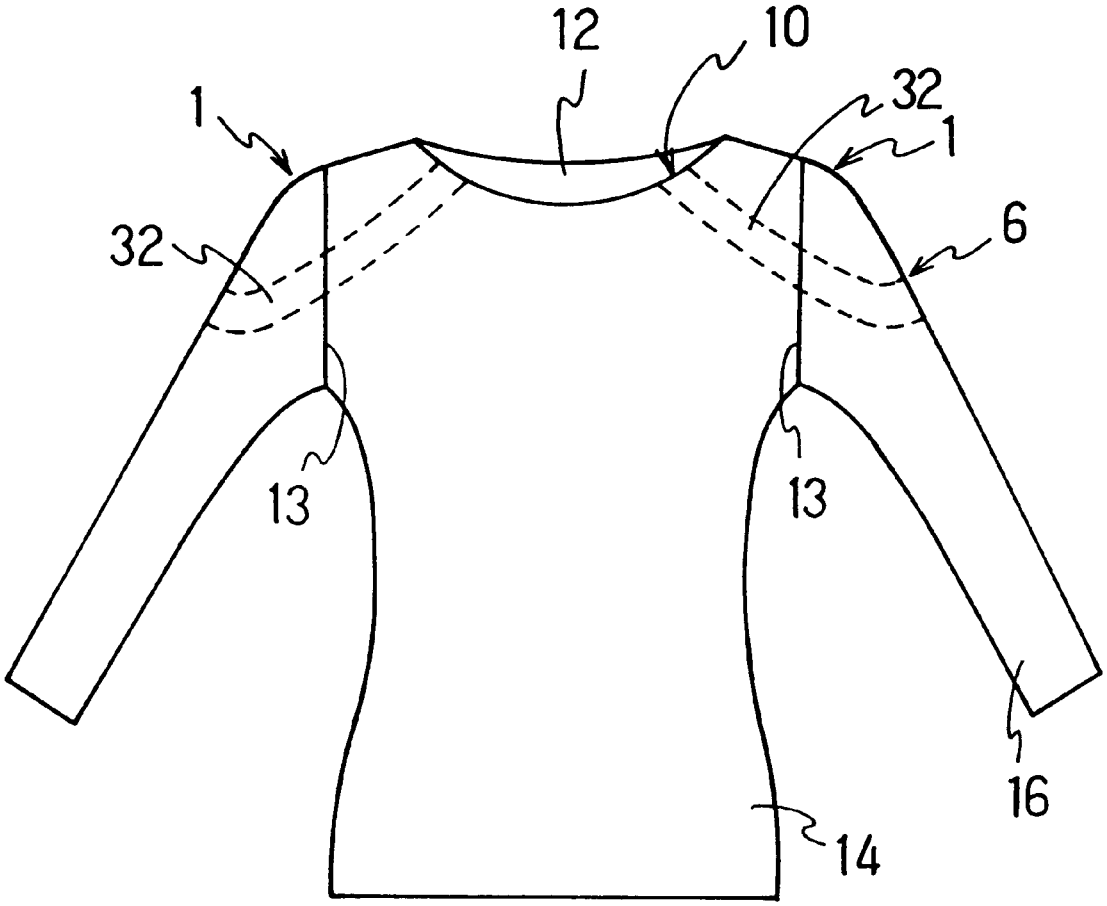
FIG. 35 is a front view of a shirt in which a part of the portion having a strong straining force used in the present invention is drawn in the long sleeved shirt of one embodiment of the present invention.
Figure 36:
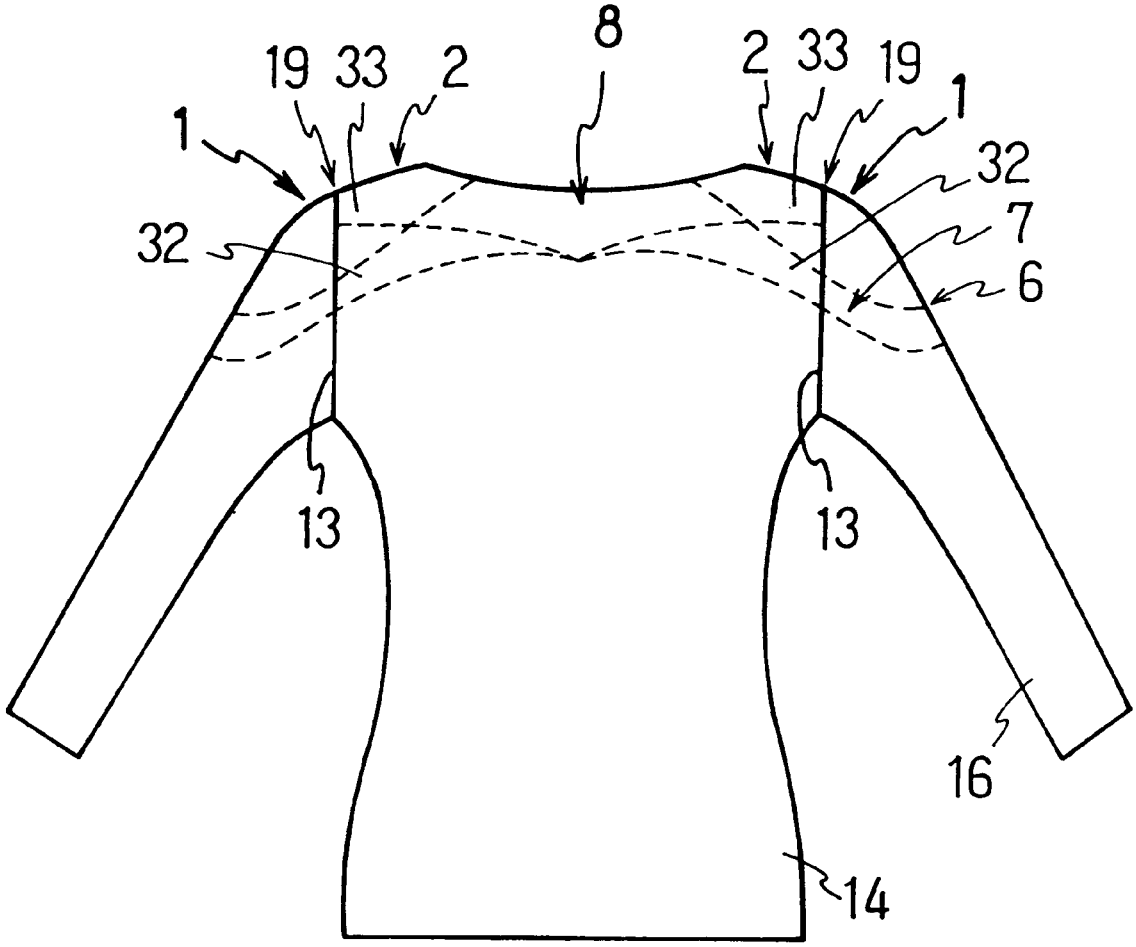
FIG. 36 is a rear view of the shirt in which the part of the portion having a strong straining force used in the present invention is drawn in the long sleeved shirt of one embodiment of the present invention.
Figure 37:
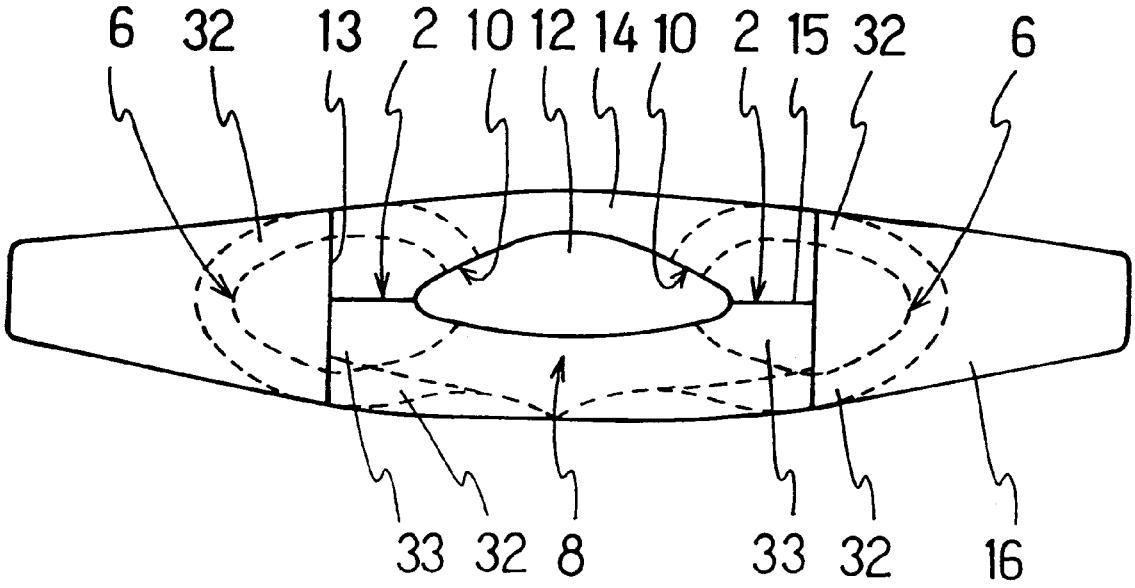
FIG. 37 is a plan view of the shirt in which the part of the portion having a strong straining force used in the present invention is drawn in the long sleeved shirt of one embodiment of the present invention.

FIGS. 35 to 37 are views to explain the state in which the portion having a strong straining force <<b-1>> and the portion having a strong straining force 33 (the stay cloth 33) are used together. FIG. 35 is a front view of a shirt; FIG. 36 is a rear view; and FIG. 37 is a plan view. As mentioned above, the portion having a strong straining force <<b-1>> is shown by 32, the portion having a strong straining force 33 (the stay cloth 33) is overlapped with a part of the portion having a strong straining force 32 and it extends in the direction of the left and right shoulders 19 by way of the portion 8 corresponding to the portion between the vertebrae cervicales VII and the vertebrae thoracicae III of the human body.

Figure 38:
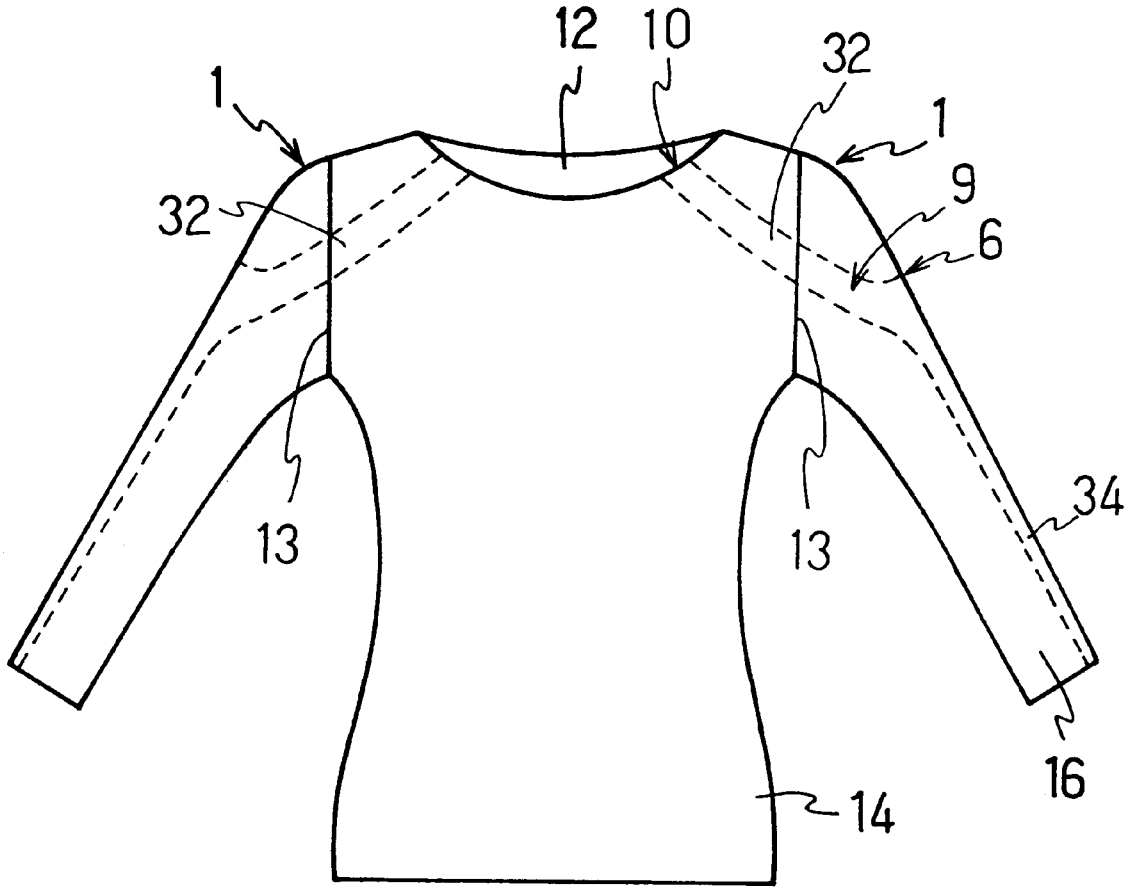
FIG. 38 is a front view of a shirt in which a part of the portion having a strong straining force used in the present invention is drawn in the long sleeved shirt of one embodiment of the present invention.
Figure 39:
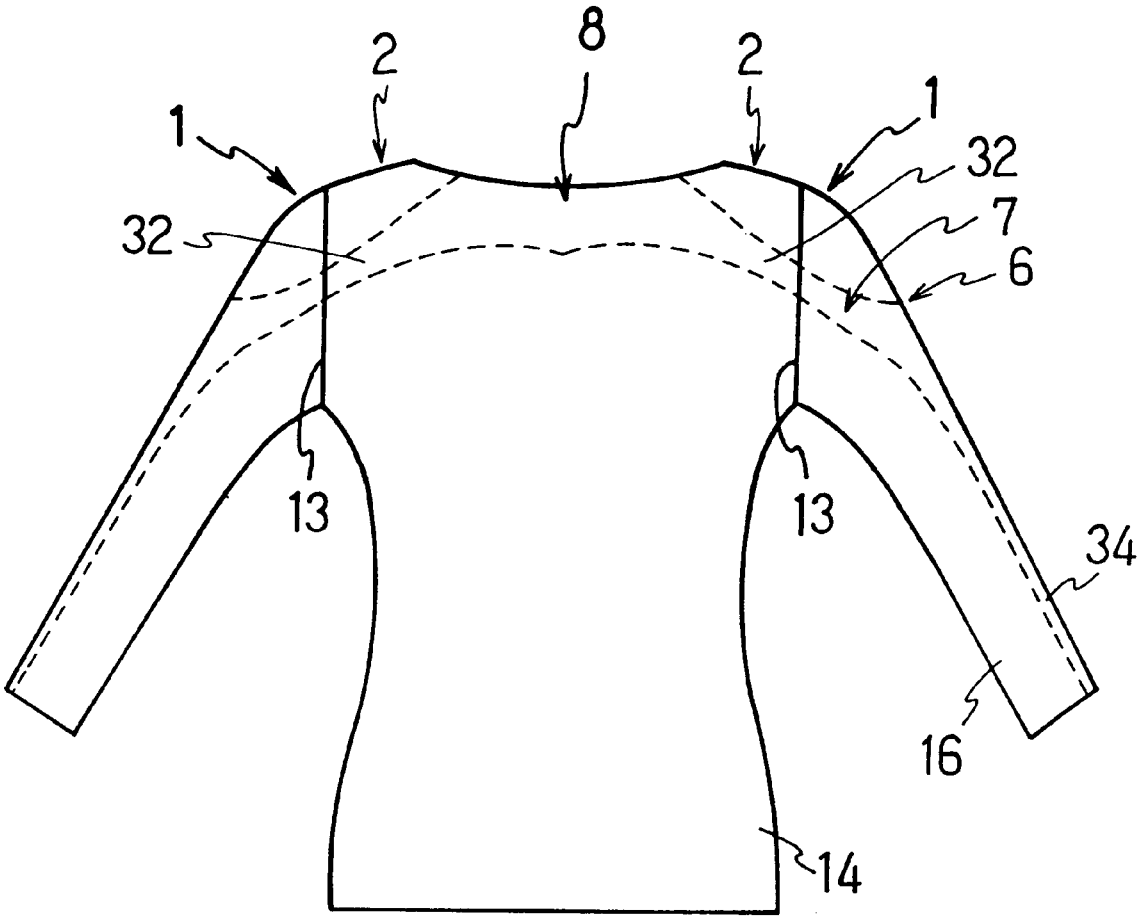
FIG. 39 is a rear view of the shirt in which the part of the portion having a strong straining force used in the present invention is drawn in the long sleeved shirt of one embodiment of the present invention.
Figure 40:
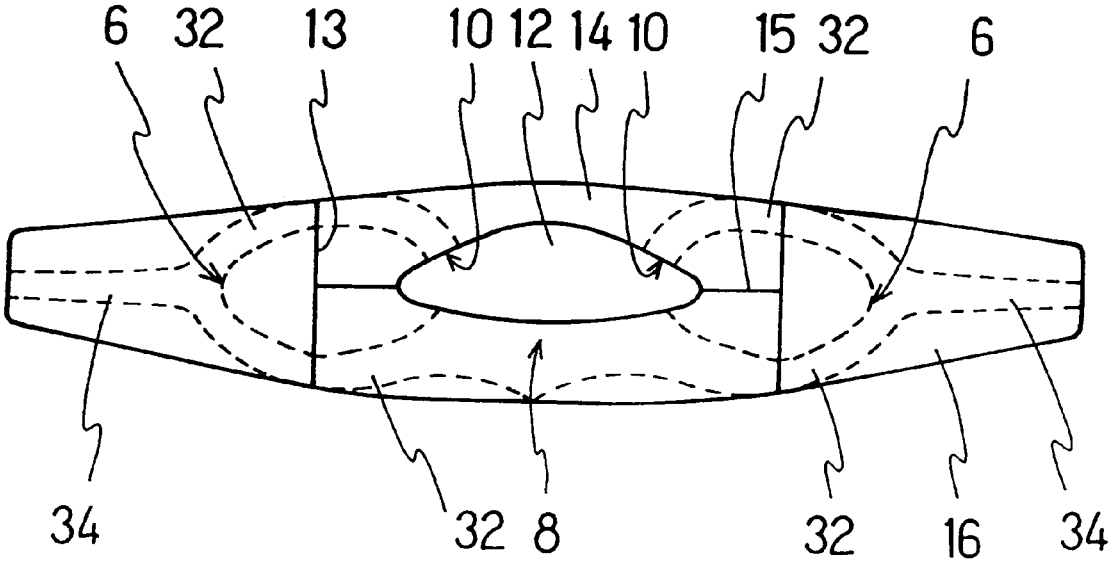
FIG. 40 is a plan view of the shirt in which the part of the portion having a strong straining force used in the present invention is drawn in the long sleeved shirt of one embodiment of the present invention.

FIGS. 38 to 40 are views to explain the case of the portion having a strong straining force 34 extending from the vicinity of the portion corresponding to the muscles deltoideus distalis 6 of the portion having a strong straining force <<b-1>> in the direction to the edge of sleeve along the upper surface of sleeve. FIG. 38 is a front view of a shirt; FIG. 39 is a rear view; and FIG. 40 is a plan view.

Figure 41:
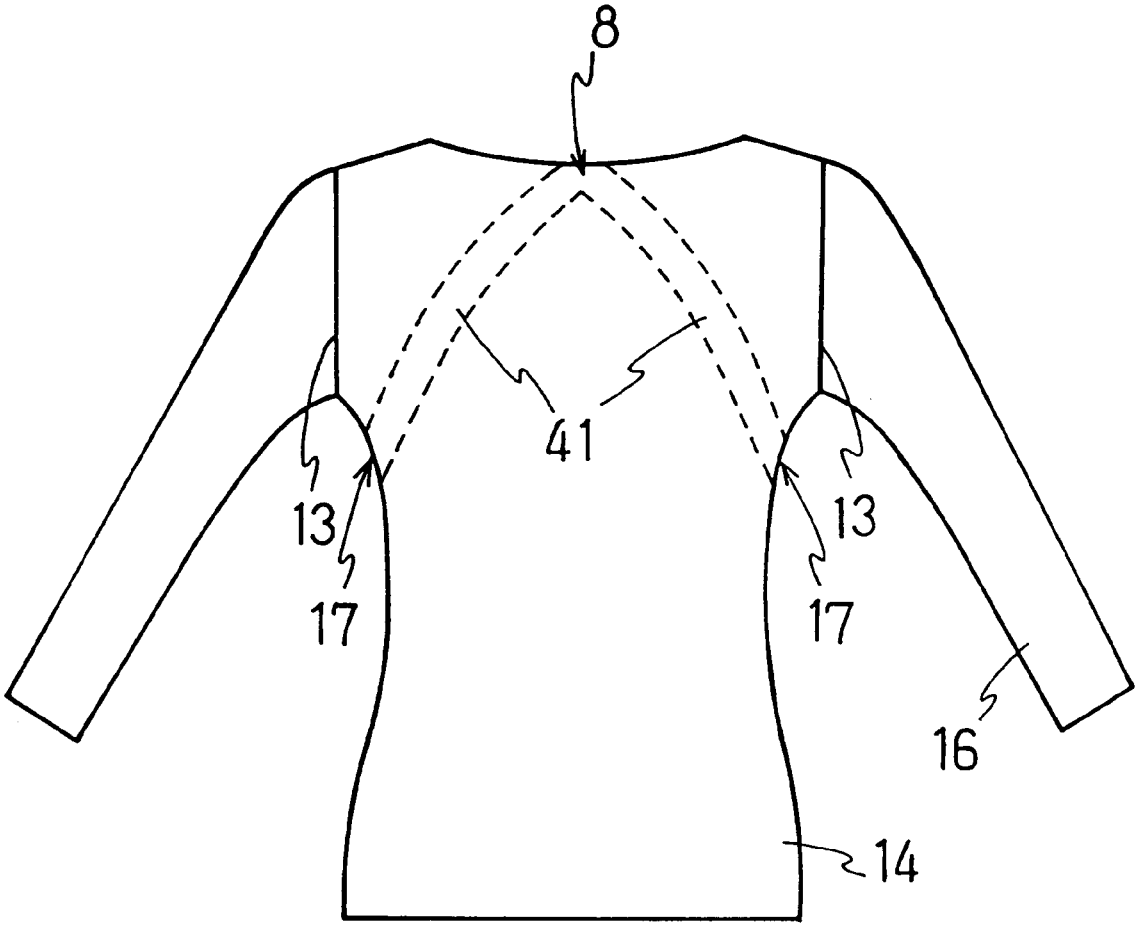
FIG. 41 is a rear view of a shirt in which a part of the portion having a strong straining force used in the present invention is drawn in the long sleeved shirt of one embodiment of the present invention.
Figure 42:
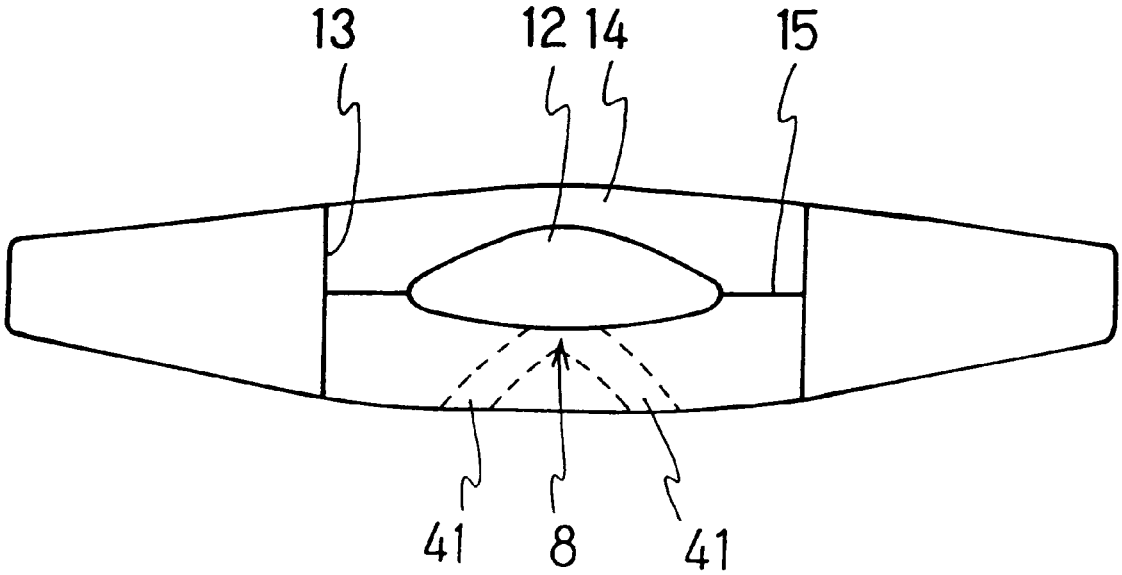
FIG. 42 is a plan view of the shirt in which the part of the portion having a strong straining force used in the present invention is drawn in the long sleeved shirt of one embodiment of the present invention.

FIGS. 41 to 42 are views to explain the portion having a strong straining force <<c>>. FIG. 41 is a rear view of a shirt; and FIG. 42 is a plan view.

The portion having a strong straining force <<c>> comprises the portion having a strong straining force 41 which, in the back part of the garment, ranges from the location between the portion corresponding to the vertebrae cervicales VII and the portion corresponding to the vertebrae thoracicae III of the human body to the axilla 17 by way of the vicinity of angulus superior scapulae 3.

Figure 43:
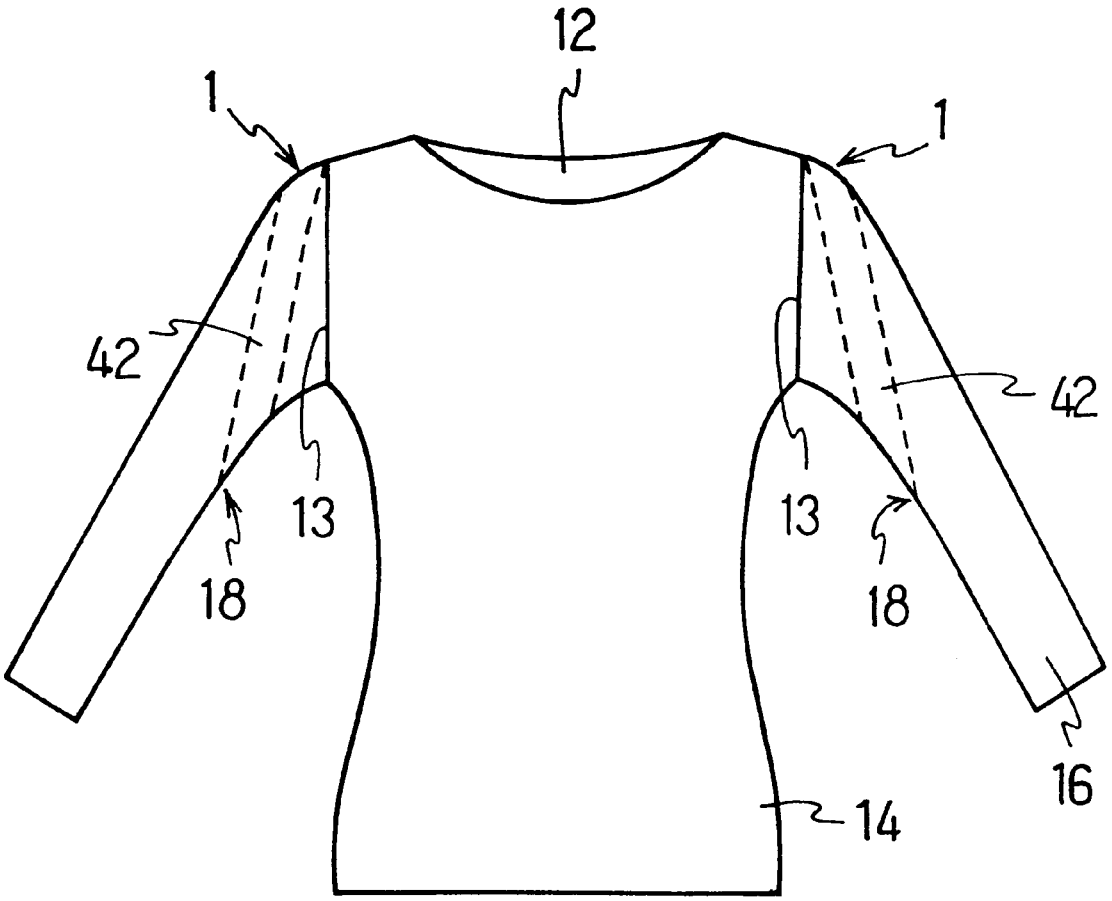
FIG. 43 is a front view of a shirt in which a part of the portion having a strong straining force used in the present invention is drawn in the long sleeved shirt of one embodiment of the present invention.
Figure 44:
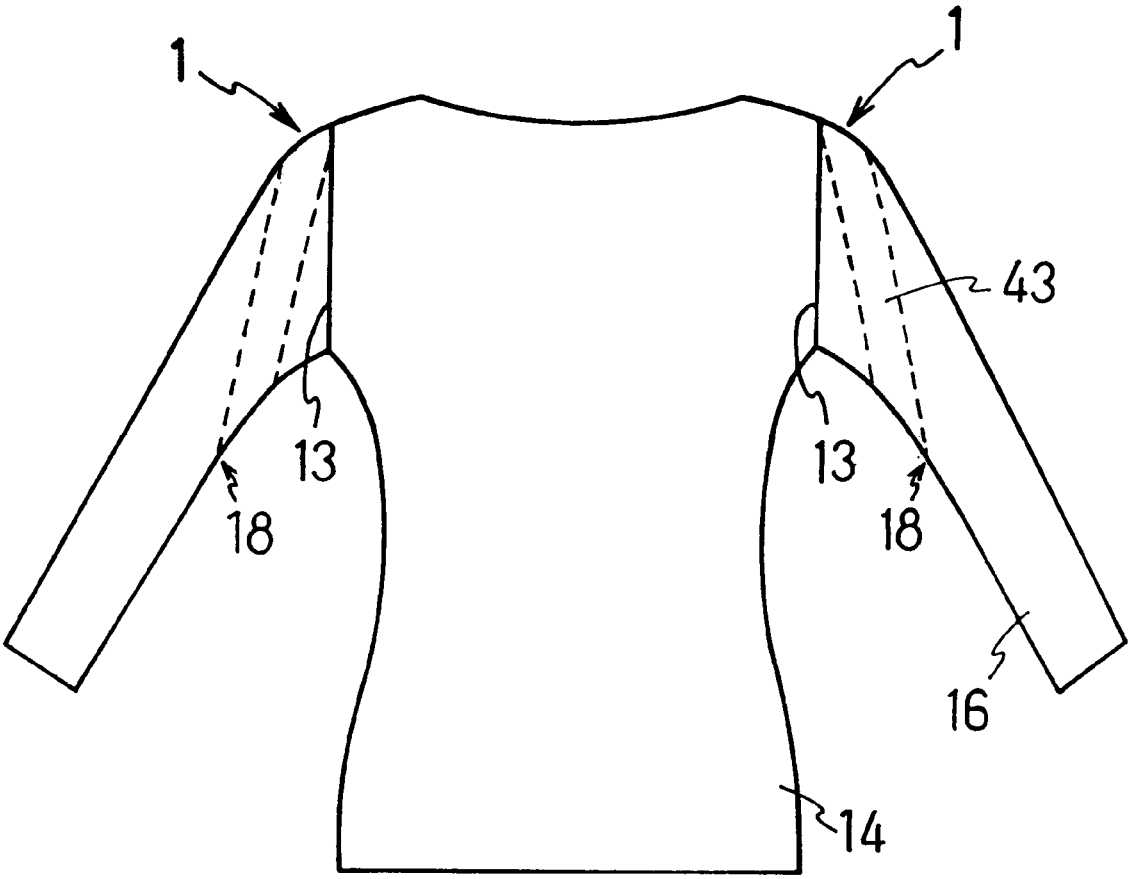
FIG. 44 is a rear view of the shirt in which the part of the portion having a strong straining force used in the present invention is drawn in the long sleeved shirt of one embodiment of the present invention.
Figure 45:
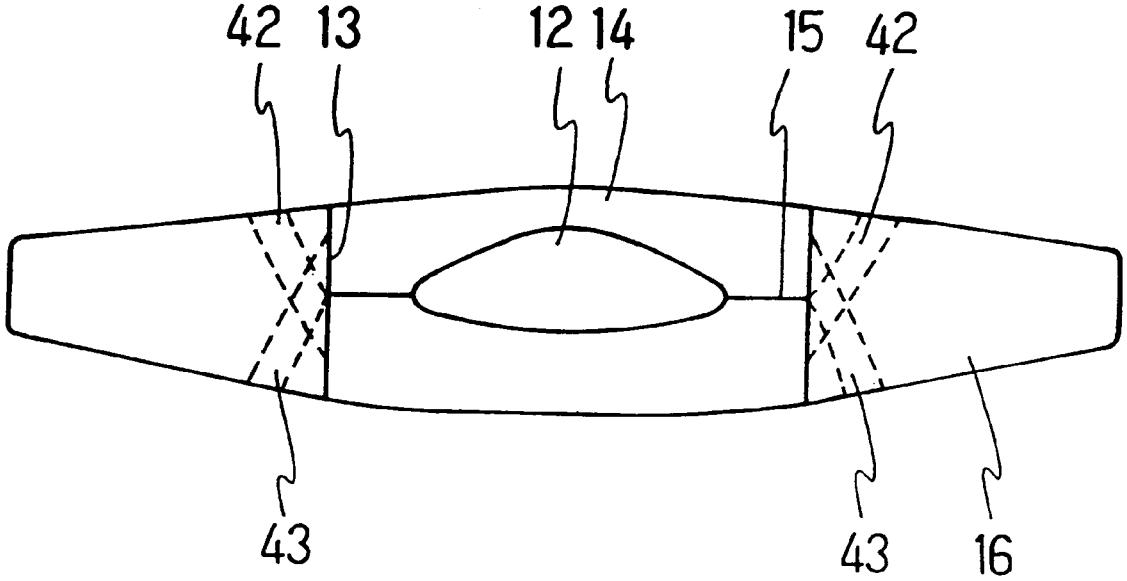
FIG. 45 is a plan view of the shirt in which the part of the portion having a strong straining force used in the present invention is drawn in the long sleeved shirt of one embodiment of the present invention.

FIGS. 43 to 45 are views to explain the portion having a strong straining force <<d>>. FIG. 43 is a front view of a shirt; FIG. 44 is a rear view; and FIG. 45 is a plan view.

The portion having a strong straining force <<d>> comprises the portions having a strong straining force 42 and 43 which, in the front and back parts of the garment, extend from the acromion 1 obliquely downward to the vicinity of the body side of the upper arm at the portion having a minimum circumference 18 and surround the circumference of the upper arm.

Figure 46:
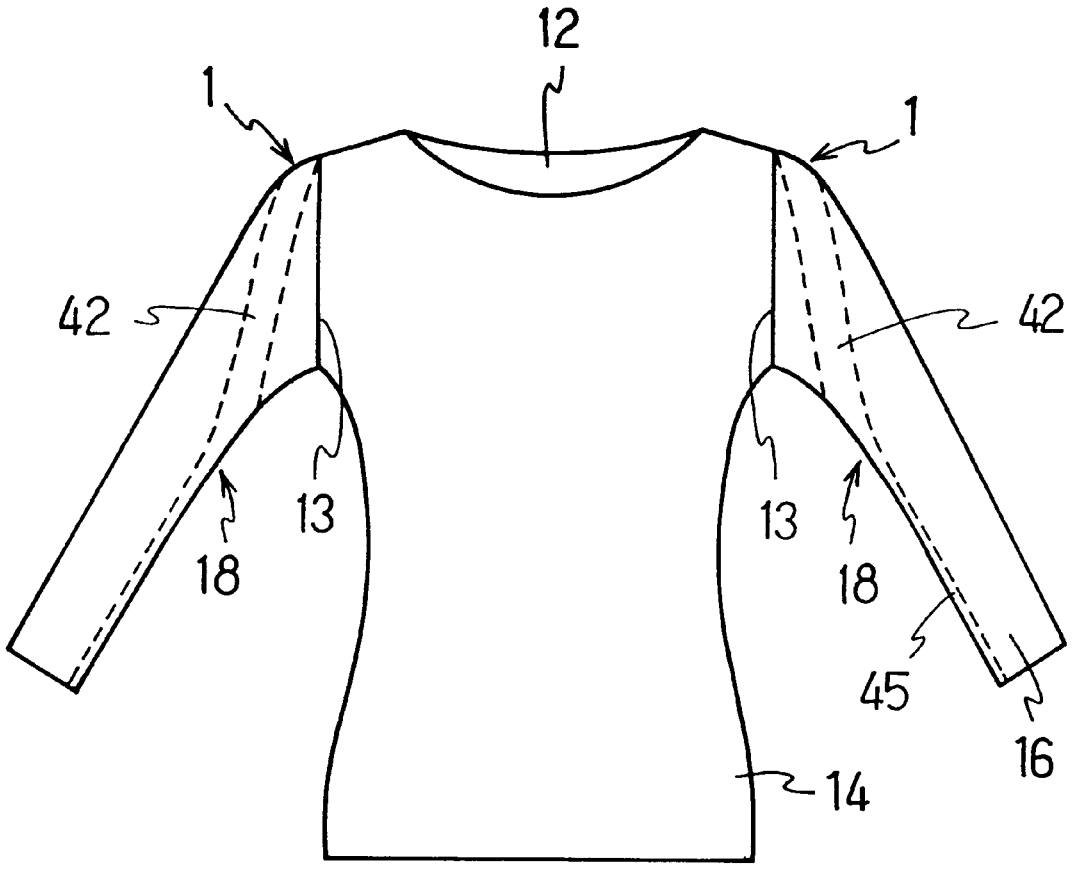
FIG. 46 is a front view of a shirt in which a part of the portion having a strong straining force used in the present invention is drawn in the long sleeved shirt of one embodiment of the present invention.
Figure 47:
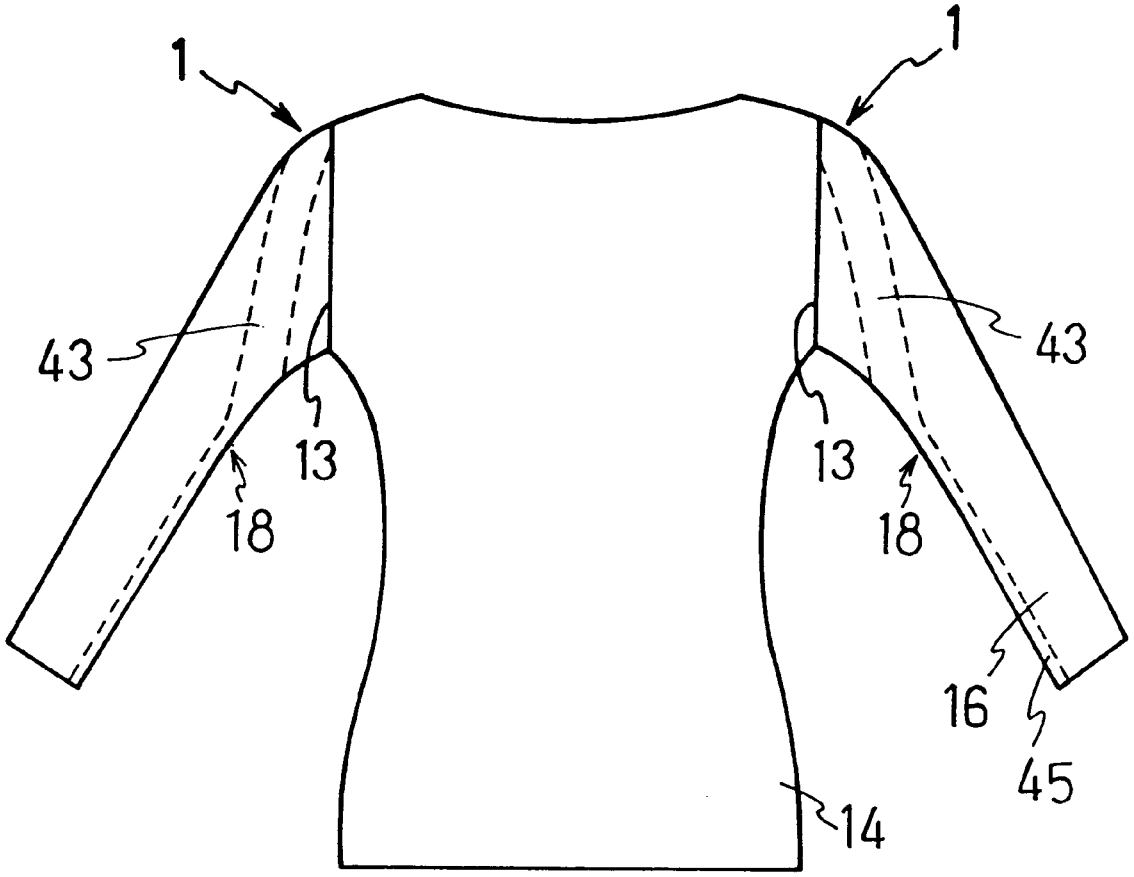
FIG. 47 is a rear view of the shirt in which the part of the portion having a strong straining force used in the present invention is drawn in the long sleeved shirt of one embodiment of the present invention.
Figure 48:
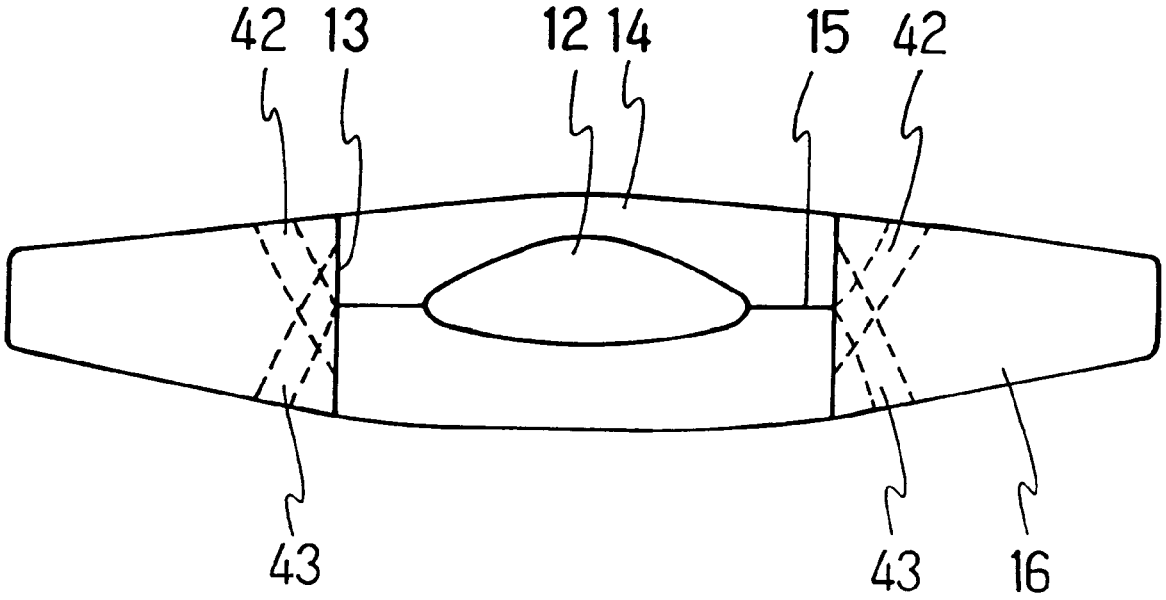
FIG. 48 is a plan view of the shirt in which the part of the portion having a strong straining force used in the present invention is drawn in the long sleeved shirt of one embodiment of the present invention.

FIGS. 46 to 48 are views to explain the portion having a strong straining force 45 extending from the vicinity of the body side of the upper arm at the portion having a minimum circumference 18 of the portion having a strong straining force <<d>> in the direction of the edge of the sleeve along the lower surface of the sleeve. FIG. 43 is a front view of a shirt; FIG. 44 is a rear view; and FIG. 45 is a plan view.

Figure 49:
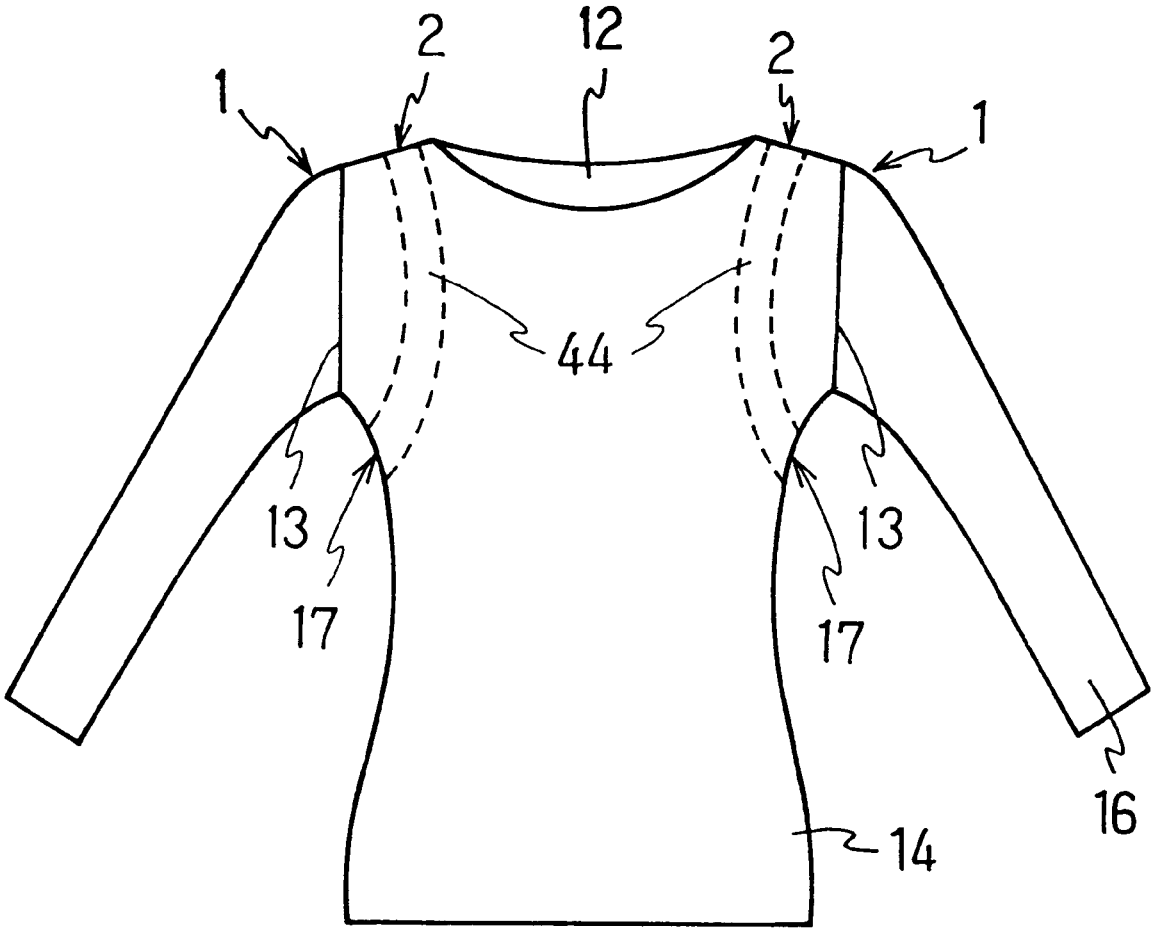
FIG. 49 is a front view of a shirt in which a part of the portion having a strong straining force used in the present invention is drawn in the long sleeved shirt of one embodiment of the present invention.
Figure 50:
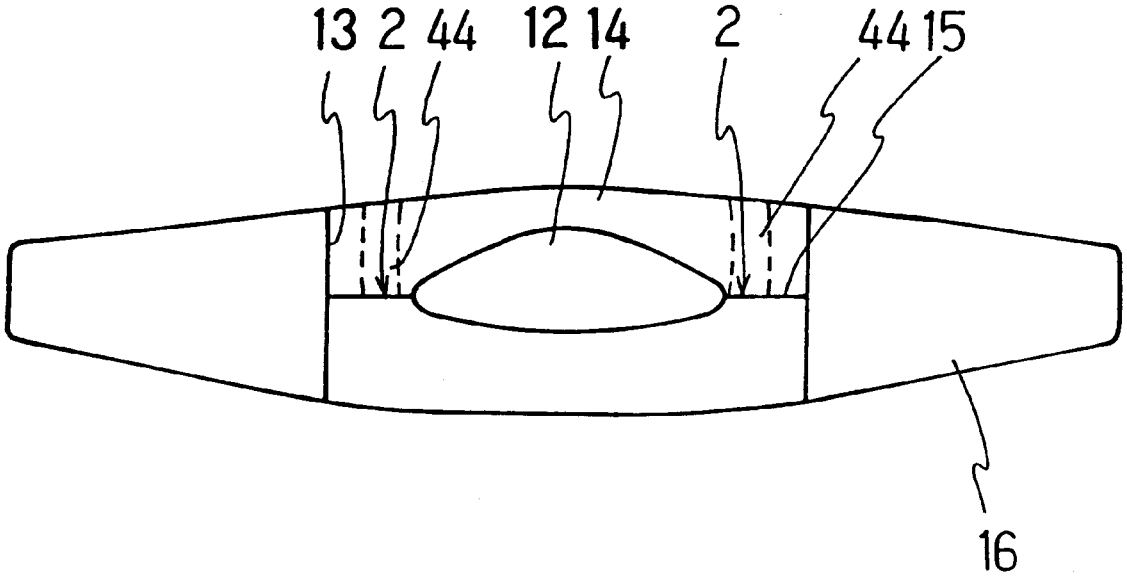
FIG. 50 is a plan view of the shirt in which the part of the portion having a strong straining force used in the present invention is drawn in the long sleeved shirt of one embodiment of the present invention.

FIGS. 49 to 50 are views explaining the portion having a strong straining force <<e>>. FIG. 49 is a front view of a shirt; and FIG. 50 is a plan view.

The portion having a strong straining force <<e>> comprises a portion having a strong straining force 44 extending, in the front part of the garment, from the portion that is located slightly near to the front center with respect to the acromion 1 and at the edge of the vicinity of the acromion side of the upper region of the trapezius muscle of the human body 2 towards the axilla 17 while curving slightly toward the front center of the human body.

In the above, each of the portions having strong straining force is individually explained for an ease of understanding the shoulder and arm support garment of the below mentioned Examples of the present invention.

Hereinafter, Examples of the shoulder and arm support garment of the present invention will be explained.

Figure 1:
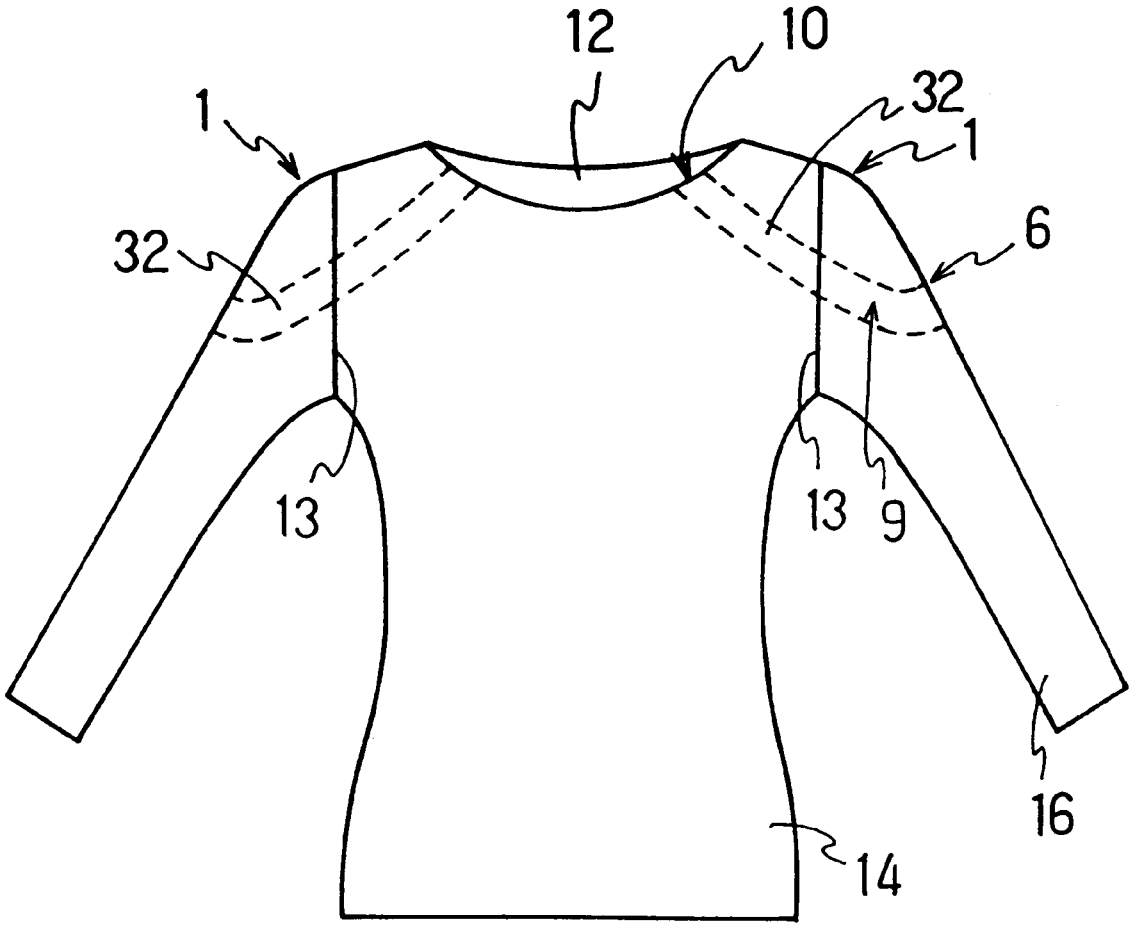
FIG. 1 is a front view showing a long-sleeved shirt of this embodiment of the shoulder and arm support garment of the present invention.
Figure 2:
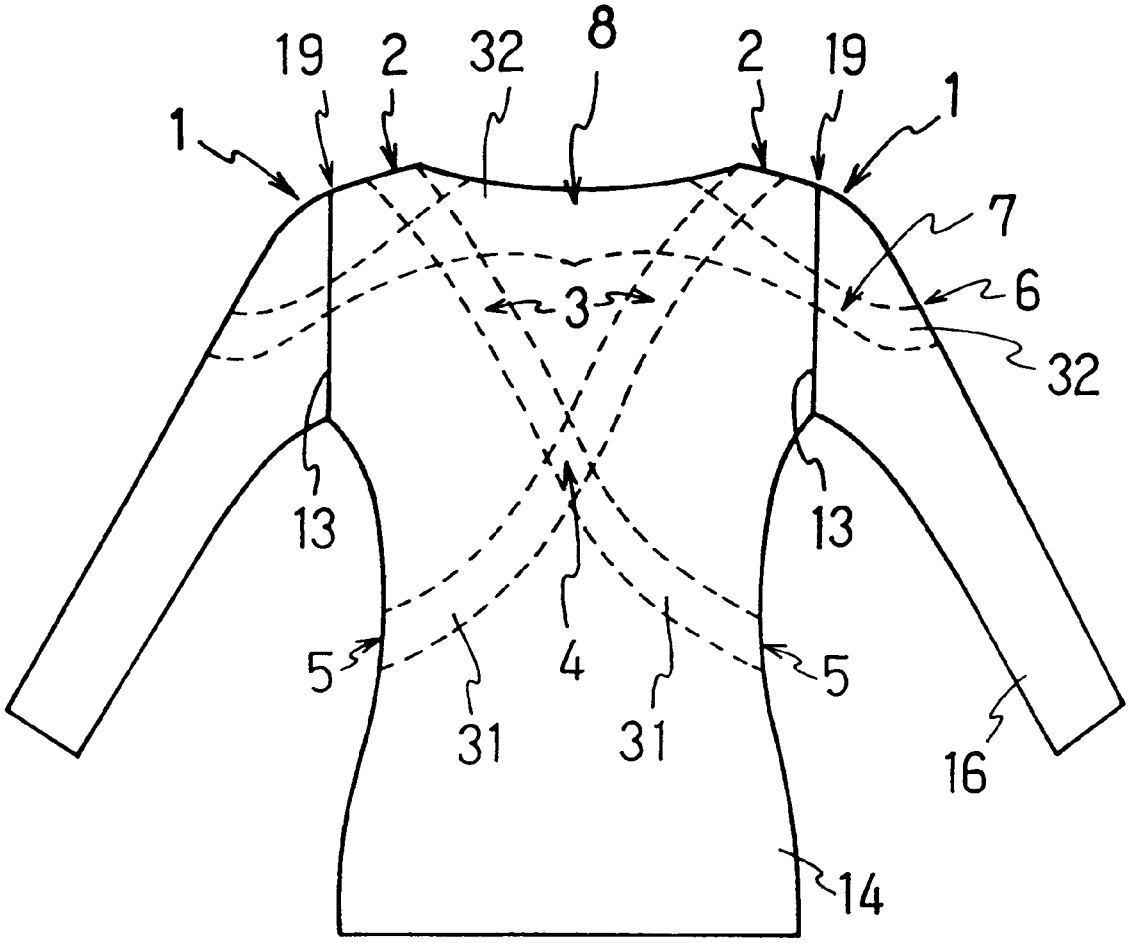
FIG. 2 is a rear view showing a long-sleeved shirt of this embodiment of the shoulder and arm support garment of the present invention.
Figure 3:
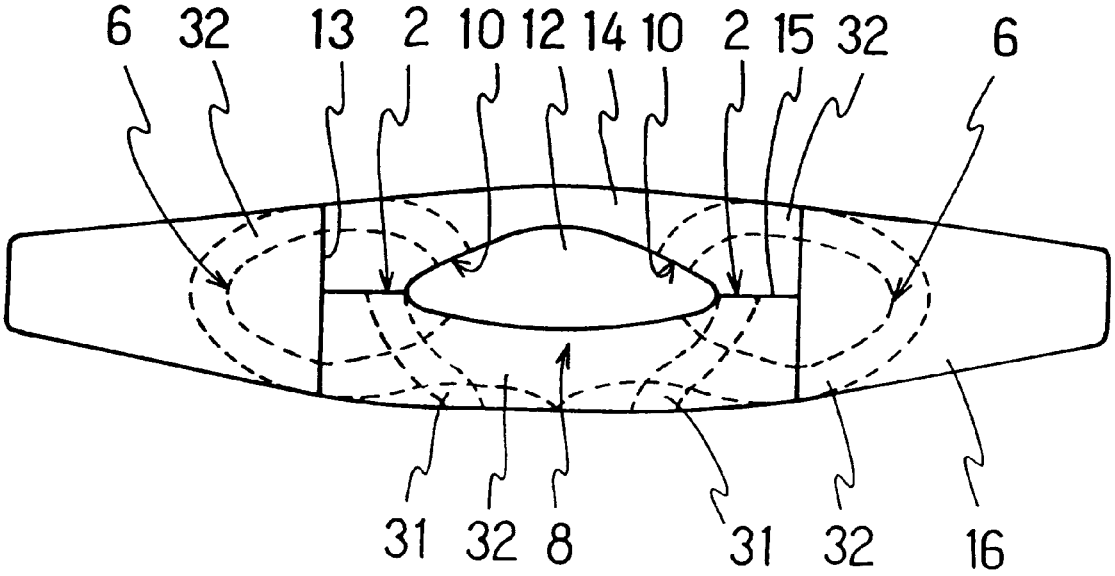
FIG. 3 is a plan view showing a long-sleeved shirt of this embodiment of the shoulder and arm support garment of the present invention.

FIGS. 1 to 3 are views of a long-sleeved shirt of one embodiment of the shoulder and arm support garment of the present invention. FIG. 1 is a front view when the shirt is viewed from the front side; FIG. 2 is a rear view; and FIG. 3 is a plan view in which a shirt is viewed from the top.

The approximately belt-like shaped portion shown by the chain line in FIGS. 1 to 3 is the portion whose straining force is stronger (the portion having a strong straining force) than that of a stretchable fabric of the shirt main part. In these and the below mentioned Examples as to the cases shown in figures, the portion having a strong straining force is formed in a way in which the predetermined shaped stretchable fabric is overlapped on the garment main part made of a stretchable fabric by stitching. As mentioned above, this portion having a strong straining force may be formed by overlapping the predetermined shaped stretchable fabric onto the garment main part by adhering. Besides the above, other methods can be employed for forming the portion having a strong straining force. Such methods include the following examples: a method in which a predetermined shaped stretchable fabric is stretched and overlapped onto the garment main part by stitching or adhering; a method in which an elastic resin is impregnated or elastic resin film is adhered to the predetermined portion of the garment main part; a method which uses an elastic fiber having a thicker thickness than that of any other location in the fiber material constituting the garment main part; and a method in which the portion having a strong straining force is a portion comprising texture of a knitted fabric of the stretchable fabric having stronger straining force or other methods. Among the above, the method by overlapping the predetermined shaped stretchable fabric onto the garment main part by stitching and the method in which the predetermined shaped stretchable fabric is stretched and overlapped onto the garment main part by stitching are preferred. Moreover, by these methods, the straining force of the stretchable fabric that is stitched to the garment main part may be smaller than, or the same as, or larger than the straining force of the stretchable fabric of the garment main part. It is because as a result of a stretchable fabric being overlapped onto the garment main part, the straining force of the overlapped portion is enhanced. The level of the straining force of the fabric to be overlapped is appropriately determined in accordance with the level of disorders of each user or the disorders to be prevented or the level of the straining force of the garment main part.

Some of the locations of the portion having a strong straining force shown in the figures are to some extent displaced from the predetermined portion of the skeleton chart of the human bones or view of the muscles of the human body shown in FIGS. 51 to 53. Each figures of the garments of the present invention is not drawn in use. Therefore, when the garments are dimensionally viewed as they are worn, the locations are changed to some extent. Thus the important locations are explained by wordings.

The straining force in the portion having a strong straining force is not limited, but it is preferable that the straining force is designed to be approximately 30 to 400 gf in the longitudinal direction. As the specific method to measure straining force, an Instron type All Round Specimen-Extension (CRE) tensile tester ("AUTOGRAPH" AG-500D made by Shimadzu Corporation) is used to conduct stretch and recovery for three times at a tension speed of 300±20 mm/min to 80% of the length of the specimen length (the clamping distance). At the third stretch and recovery, the value in 30% stretched state and the value at the recovery are measured and only the value at the recovery is recorded and the value is defined as the straining force. Preferably, the size of the specimen is 2.5 cm in width, and 16 cm in length, and wherein 2.5 cm is a margin for the upper clamping distance, 3.5 cm is a margin for the lower clamping distance, and 10 cm is the length for the tensile test. If such preferred size of specimen cannot be cut out from the garment to be measured, specimens having smaller size than the above may be used. However, the smaller the size of specimens is, the greater the measurement error is. Therefore, it is preferable that largest cuttable specimens are taken and measured. Moreover, in a case where the portion having straining force is formed by overlapping a stretchable fabric onto the garment main part, the measurement specimen of the portion having straining force is, needless to say, carried out on specimens of the overlapped portion.

The width of the portion having a strong straining force of the garment of the present invention is not particularly limited and appropriately determined within a scope suitable to achieve the object of the present invention in accordance with the location of the portion having a strong straining force, the strength of straining force of the material to be used, the means of forming the portion having a strong straining force and the level or locations of disorders of the each user, or the purpose of preventing the disorders; whether the user is child or adult, or the like. For example, preferably the width of the portion having a strong straining force 32 of the portions having a strong straining force <<b-1>> or the portion having a strong straining force 33, that is, the stay cloth, which are the portions having widest the width, is usually approximately 5 to 15 cm, more preferably about 8 to 13 cm. The width of the other portions having strong straining force is preferably 2 to 8 cm. Needless to say, as long as the objects of the present invention can be attained, the width of the portion having a strong straining force may be partially wider or narrower as necessary.

In the shirts of FIGS. 1 to 3, 14 denotes a shirt main part; 13 denotes a seam line between sleeve and body part in the shirt main part; 15 denotes a seam line between the front body and the back body constituting the shirt main part; and 16 denotes the sleeve.

The portion having a strong straining force comprises the above mentioned portions having a strong straining force <<a>> and <<b-1>>. The portion having a strong straining force <<a>> comprises the portion having a strong straining force 31 which, in the back part of said garment, ranges from the portion that is located slightly near to the back center from the acromion 1 and at the edge of the acromion side of the upper region of the trapezius muscle of the human body 2 to the vicinity of the lower costa in the opposite side body 5 by way of the vicinity of angulus superior scapulae 3 and the vicinity of any of the vertebrae thoracicae VII to the vertebrae thoracicae IX 4. The portion having a strong straining force <<b-1>> comprises a portion having a strong straining force 32 which, in the front part of said garment, ranges from the vicinity of the portion corresponding to the muscles deltoideus distalis 6 to in the vicinity of the upper end portion 10 of the garment between the left and right acromion 1, 1 (the acromion is not included) and ends therein by way of the vicinity of the edge of the portion corresponding to the muscles deltoideus 9, and which, in the back part of said garment, ranges from the vicinity of the portion corresponding to the muscles deltoideus distalis 6 to the portion 8 between the portion corresponding to the vertebrae cervicales VII and the portion corresponding to the vertebrae thoracicae III by way of the vicinity of the edge of the portion corresponding to the muscles deltoideus 7 and further extends from this portion to the opposite directions similarly with right-left symmetry.

In this shirt, the portion having a strong straining force <<a>> has a partial effect of compressing the angulus superior scapulae and fitting the scapula in the backside of the thorax. Furthermore, since all locations of the starting point and ending point of the portion having a strong straining force <<a>> and the vicinity of any of the portion between vertebrae thoracicae VII to vertebrae thoracicae IX where the right and left portions having a strong straining force <<a>> intersect 4 are in locations that are not relatively subjected to the physical motions, the dislocation of the portion having a strong straining force from the desired location can be inhibited at the minimum. Moreover, the portion having a strong straining force <<b-1>> supports the muscles deltoideus in a manner that sandwiches the muscles deltoideus from the front side and back side from the vicinity of the portion corresponding to the muscles deltoideus (6) in an obliquely upward direction along the vicinity of the edge of the muscles deltoideus. And the portion having a strong straining force <<b-1>> can apply the stress to the humeral head (the upper edge of the humerus) in a manner that holds up the humeral head in the direction of the scapula (in a manner that fits the humeral head to the normal location of the glenoidal cavity). In addition, since a portion having a strong straining force <<b-1>> has the portion having a strong straining force extending to the right and left shoulders by way of between the portion (8) corresponding to the vertebrae cervicales VII and the portion corresponding to vertebrae thoracicae III of the human body, the load to the shoulders due to the weight of the arms can be reduced even if at simple position of hanging down the arms.

In the above mentioned shoulder arm support garment of the present invention, due to the mutual relevant comprehensive effect of each of the portions having straining force <<a>> and <<b-1>> in the primarily longitudinal direction, the one-sided motions or over-ranged motions can be inhibited and the load to the shoulder joint can be reduced. Moreover, each of the portions having a strong straining force permits exhibiting the holding power in the direction that holds up the arms so as to keep the most desirable physical relationship of the upper arm, the shoulder joint and scapula.

Moreover, disorders in the shoulder joint of stiff and painful shoulder of older age or sports are thought to be caused by break of the stabilization mechanism of the gleno-humeral joint (in other words, the mechanism by which the humeral head is compressed to the humerus glenoidal cavity) and disorder in the shoulder girdle function ( in other words, the function of fitting the scapula on the thorax). Since the shoulder and arm support garment of the present invention has an effect of supporting the joint or muscle by each of the above mentioned portions having a strong straining force and mutual comprehensive effect by each of the above mentioned portions having a strong straining force, it can be used for the promotions of the prevention and treatment of various kinds of disorders of the shoulder joint.

In addition, in the shoulder and arm support garment of the present invention, the stretchable fabric used in the garment main part or each of the portions having a strong straining force is preferably power net containing polyurethane fiber that is rochelle knitted fabric containing polyurethane fiber having stretchability, or two directions stretchable tricot knitted fabric containing polyurethane fiber that is stretchable tricot knitted fabric containing polyurethane fiber or circular knitting fabric containing polyurethane fiber. Therefore, as compared with the conventional supporters etc. using relatively thick pile fabric or neoprene sheet, the fabric having such a thickness as used for the general garments can be provided, for example about 0.3 to 0.8 mm in thick can be used. Therefore, the shoulder and arm support garment in which the deterioration of appearance, for example, in proportion, can be reduced and which is well fitted onto the body; and whose ventilation is excellent. An example of the fabric constituting the shirt main part is: two directions stretchable tricot knitted fabric that is a stretchable material comprising 80% of polyester fiber and 20% of polyurethane fiber (the straining force: 45 gf in the lateral direction of the shirt, 33 gf in the longitudinal direction of a shirt). Power net knitted fabric that is a stretchable material comprising 62% of nylon fiber and 38% of polyurethane fiber (the straining force: 272 gf in the longitudinal direction of a lining material, and 88 gf in the width direction of a lining material) is used for the fabric lined to the portion having a strong straining force (the same is true in the below mentioned examples). But, needless to say, it is not limited to the above mentioned material.

Figure 4:
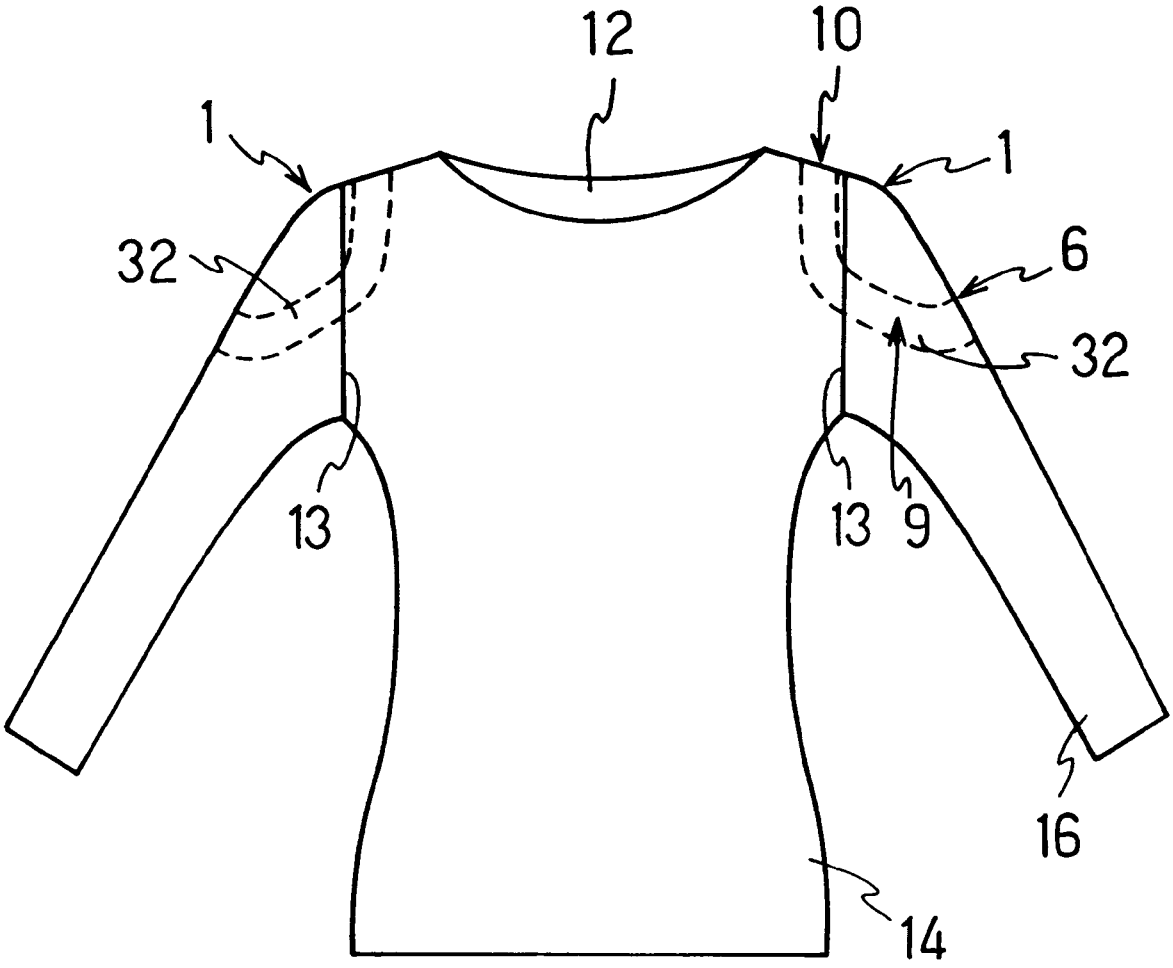
FIG. 4 is a front view showing a long-sleeved shirt of another embodiment of the shoulder and arm support garment of the present invention.

Moreover, the portion having a strong straining force <<b-1>>, ranging, in the front part of the shirt, from the vicinity of the portion corresponding to the muscles deltoideus distalis 6 through the vicinity of the edge of the portion corresponding to the muscles deltoideus 9 to the vicinity of the upper end portion 10 of the garment between the left and right acromion 1, 1 (the acromion is not included), slightly to the side of an open portion for the neck 12, is shown in FIG. 1. However, the end portion in the vicinity of the upper end portion of the garment front part 10 is not limited to the example of FIG. 1, and may be in any portion between the left and right acromion 1, 1 (the acromion is not included) in the vicinity of the upper end portion of the garment. FIG. 4 shows a front view of another embodiment of the shirt when viewed from the front side, wherein the location of the ending portion of the upper end portion 10 of the portion having a strong straining force <<b-1>> or <<b-2>> of the garment front part is different from that of FIG. 1.

In FIG. 4, the ending portion of the upper end portion 10 of the portion having a strong straining force 32 is different from the case of FIG. 1. The ending portion in FIG. 4 is respectively located, in the right body sides slightly near to the acromion 1 between the right edge of the opening portion for the neck 12 and the right acromion 1; and, in the left body side, slightly near to the acromion 1 between the left edge of the opening portion for the neck 12 and left acromion 1. By this embodiment, approximately the same effect can be attained as in FIG. 1.

In another embodiment, unlike the embodiments shown in FIG. 1 or FIG. 4, the two portions having a strong straining force cross in the front part of the garment. In this embodiment, one of the portions having straining force 32 ranges from the edge of the right muscles deltoideus by way of the front center of the garment to the vicinity of the upper end portion of the left body of the garment, and another ranges from the edge of the left muscles deltoideus by way of the front center of the garment to the vicinity of the upper end portion of the right body of the garment. Using the structures shown in FIG. 1 or FIG. 4, the end portion of the portion having a strong straining force <<b-1>> or <<b-2>> on the right side of the garment is in the front part of the garment and ends in the vicinity of the upper end portion 10 of the garment between the center-to-right front of the garment and the right acromion 1 (the acromion is not included); and the end portion of the portion having the a strong straining force <<b-1>> or <<b-2>> of the left side of the garment, is in the vicinity of the upper end portion 10 of the garment of between the center-to-left front of the garment and the left acromion 1 (the acromion is not included). Consequently, it is preferable that the feeling of compression of the front part in use is reduced as compared with the garment which is designed in a manner in which the long portion having strong straining force <<b-1>> or <<b-2>> ranges from right or left arm through the center front part of the garment respectively to the opposite side in the vicinity of the upper portion of the garment.

Figure 5:
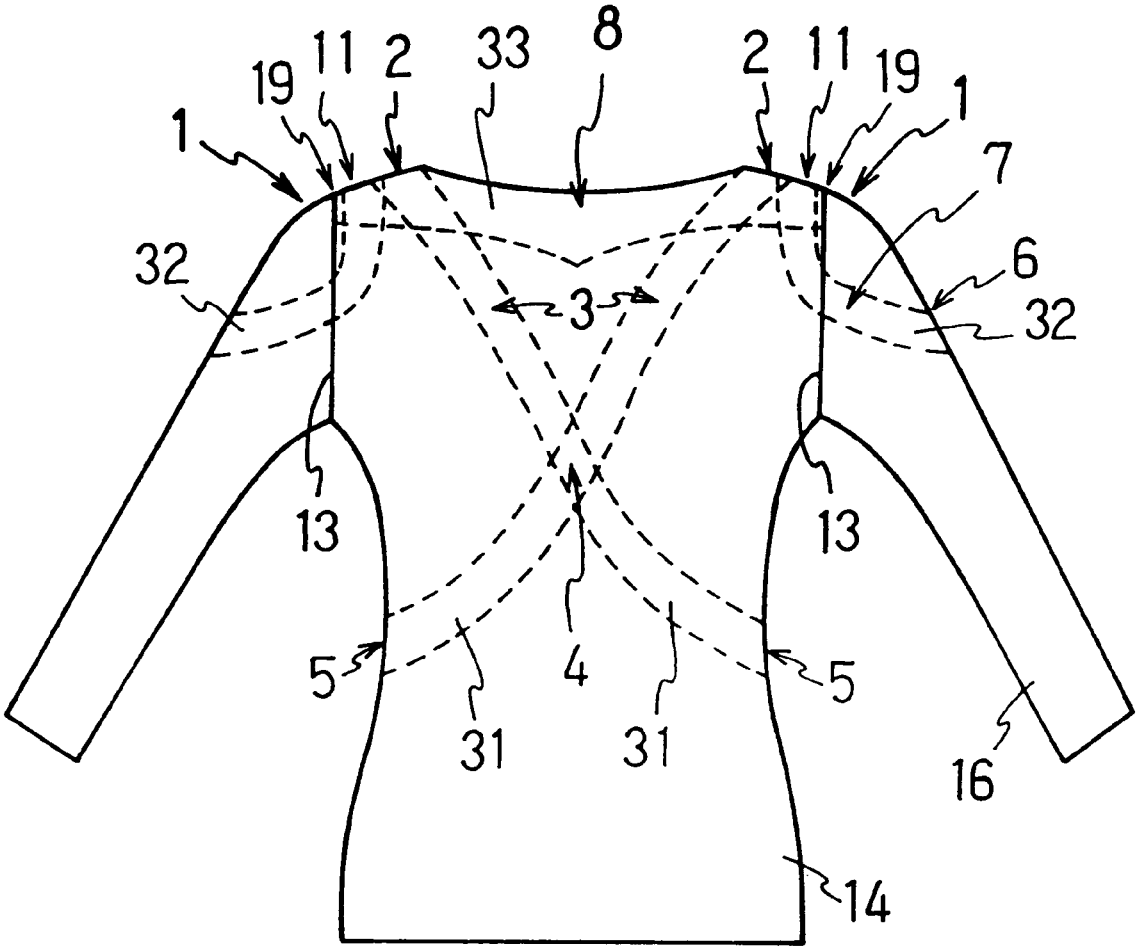
FIG. 5 is a rear view showing a long-sleeved shirt of this embodiment of the shoulder and arm support garment of the present invention.
Figure 6:
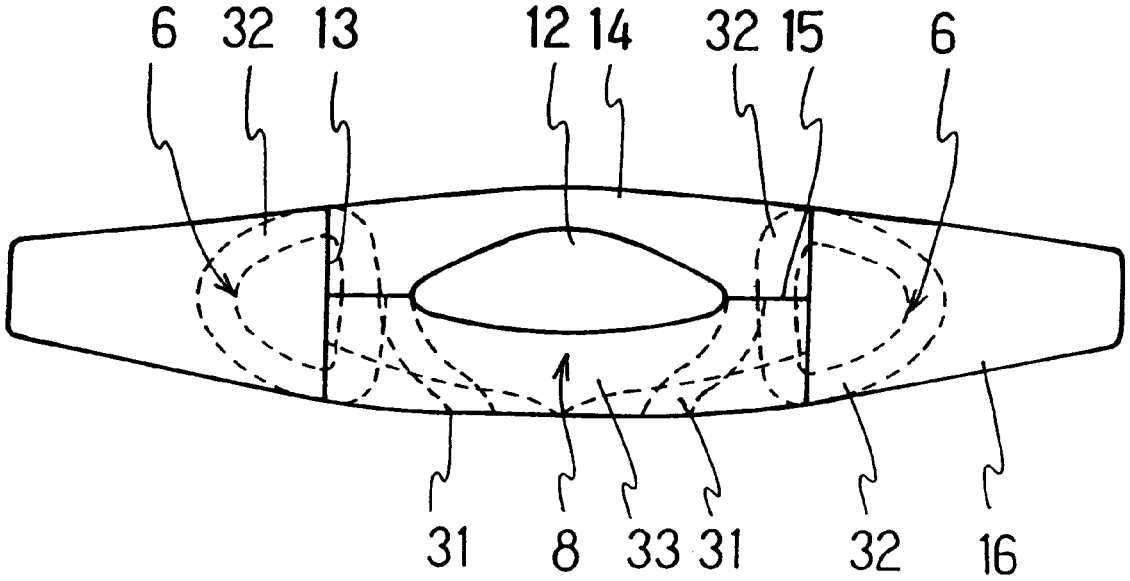
FIG. 6 is a plan view showing a long-sleeved shirt of this embodiment of the shoulder and arm support garment of the present invention.

FIG. 5 is a rear view showing a shirt of one embodiment of the shoulder and arm support garment of the present invention. In this example, for the front part of the shirt, the embodiments shown in FIG. 1 or FIG. 4 can be employed. For the back part of the shirt, the portion having a strong straining force <<b-2>> instead of the portion having a strong straining force <<b-1>> is employed. In other words, the portion having a strong straining force <<b-2>> is employed which comprises a combination of: the portion having a strong straining force 32, which in the front part of said garment as shown in FIG. 1 or FIG. 4 ranges from the vicinity of the portion corresponding to the muscles deltoideus distalis 6 to the vicinity of the upper end portion 10 of the garment between the left and right acromion 1, 1 (the acromion is not included) and ends therein by way of the vicinity of the edge of the portion corresponding to the muscles deltoideus 9; and, in the back part of said garment, ranges from the vicinity of the portion corresponding to the muscles deltoideus distalis 6 to the vicinity of the upper end portion 11 of the garment between the acromion 1 and back center of the body (the acromion is of the edge of the port the vicinity of the edge of the portion corresponding to the muscles deltoideus 7; and the portion having a strong straining force 33 which is provided for connecting the right and left end portions of the portion having a strong straining force 32 in the back portion of said garment, in a way that ranges between the portion corresponding to the vertebrae cervicales VII and the portion corresponding to vertebrae thoracicae III of the human body (8), extends in the directions of the right and left shoulders 19, and is overlapped to the right and left end portions of the portion having a strong straining force 32. The portion having a strong straining force <<a>> is the same as that shown in FIG. 1 (the portion having a strong straining force 31). FIG. 6 is a plan view of the shirt when the shirt is viewed from the top, showing the shirt in which the embodiment of FIG. 4 is employed for the front part of the shirt, and the embodiment of FIG. 5 is employed for the back part of the shirt.

By this embodiment too, approximately the same effect can be exhibited as the shirts shown in FIGS. 1 to 3. In general, the portion having a strong straining force 33 connecting the above mentioned right and left end portions having a strong straining force 32 is a portion having straining force for reinforcing the power of drawing up the arms. When fabric is used for this part, the fabric is called a stay cloth.

Figure 7:
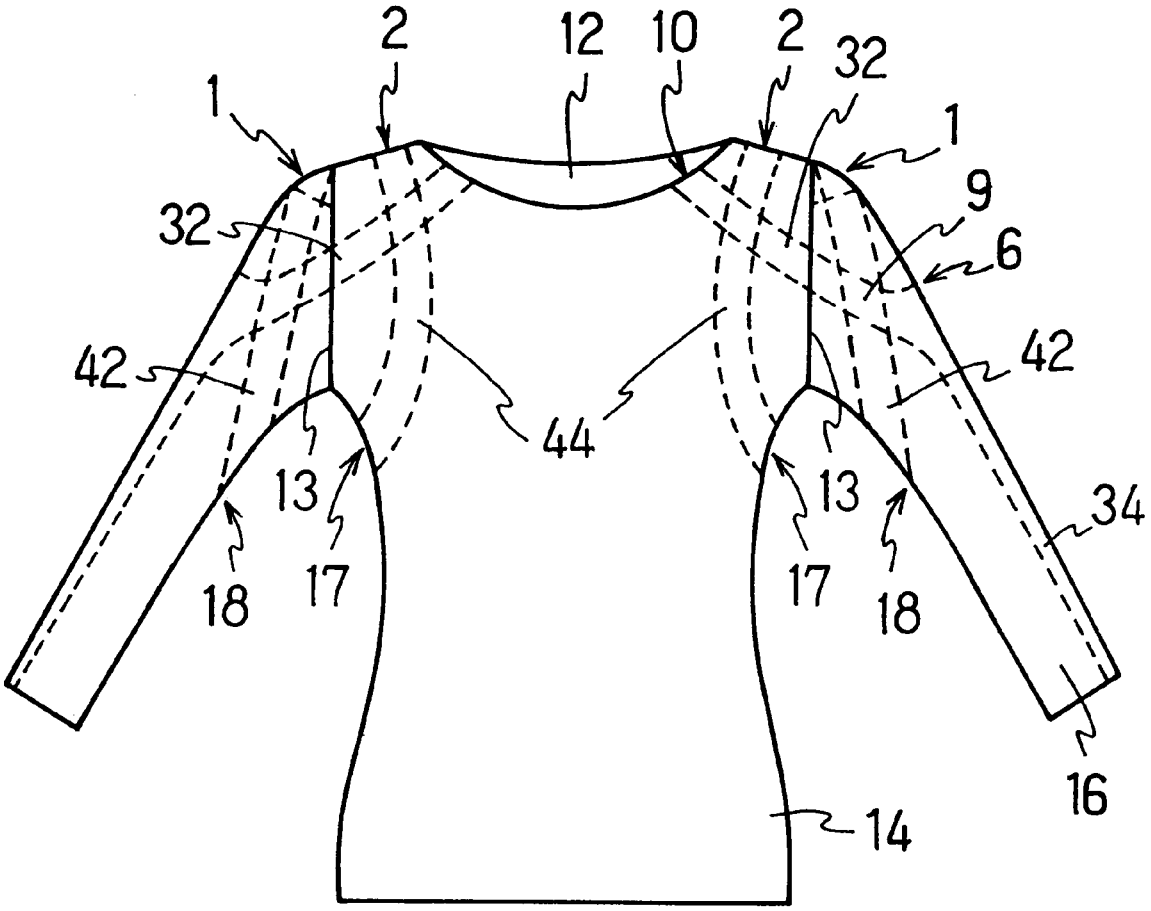
FIG. 7 is a front view showing a long-sleeved shirt of a further embodiment of the shoulder and arm support garment of the present invention
Figure 8:
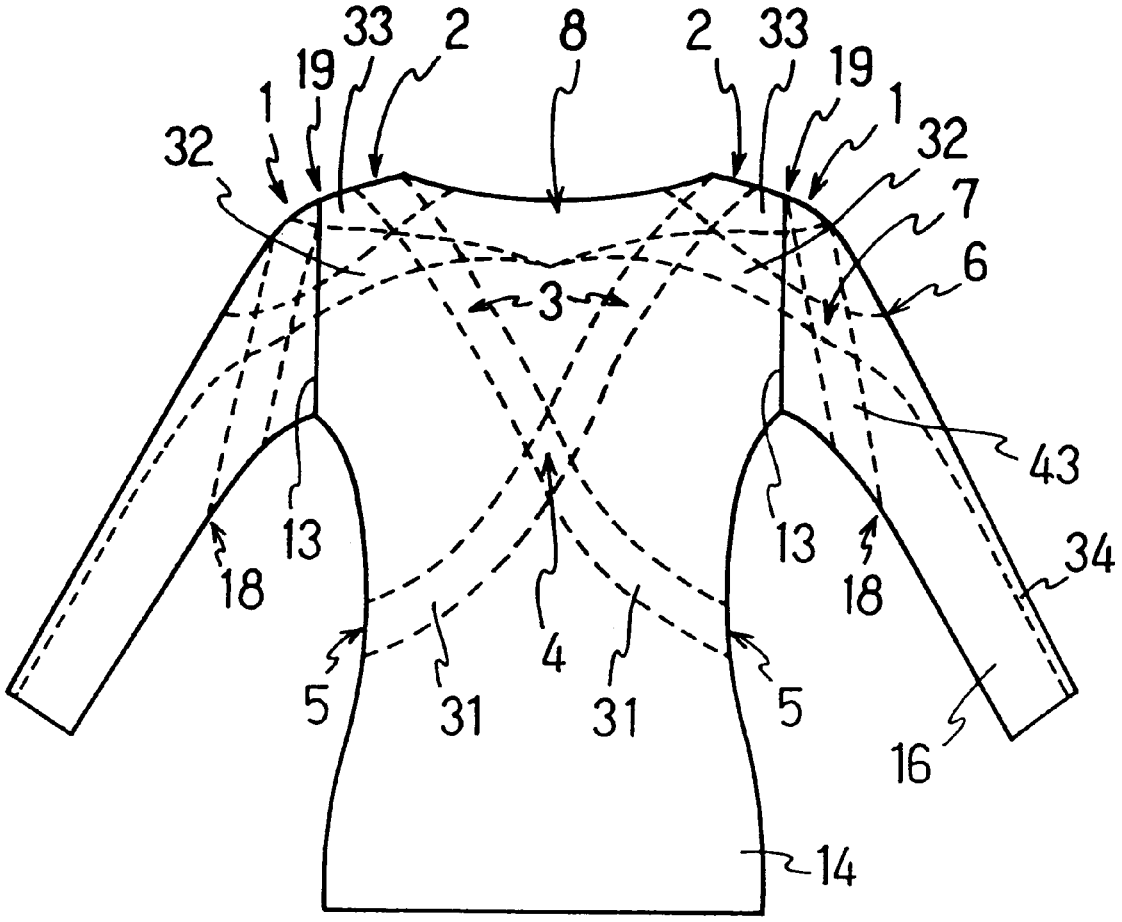
FIG. 8 is a rear view showing a long-sleeved shirt of this embodiment of the shoulder and arm support garment of the present invention.
Figure 9:
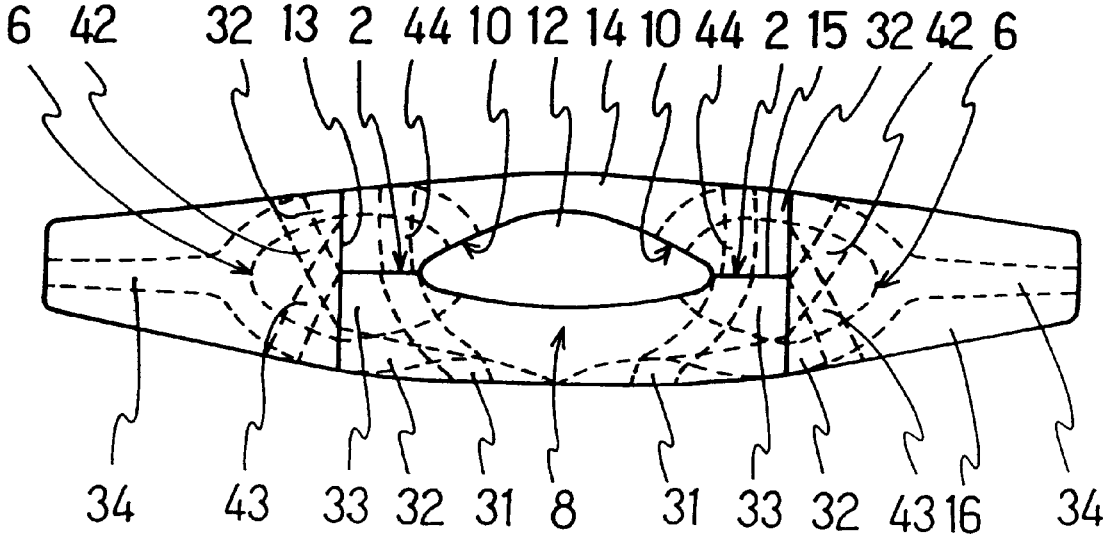
FIG. 9 is a plan view showing a long-sleeved shirt of this embodiment of the shoulder and arm support garment of the present invention.

Next, FIGS. 7 to 9 show a shirt of another embodiment of the present invention. FIG. 7 is a front view of the shirt; FIG. 8 is a rear view; and FIG. 9 is a plan view. The difference between this embodiment and the embodiment shown in FIGS. 1 to 3 is: in this embodiment, the portion having a strong straining force 32 of <<b-1>> further comprises the portion having a strong straining force 34 extending from the vicinity of the portion corresponding to the muscles deltoideus distalis 6 in the direction to the edge of sleeve along the upper surface of sleeve; the portion having a strong straining force <<d>> comprising portions having a strong straining force 42 and 43 which extend from the acromion 1 obliquely down to the vicinity of the body side of the upper arm at the portion having a minimum circumference 18 and surround the upper arm is further provided; the portion having a strong straining force 33 (the stay cloth) is further provided in a way that ranges from between the portion corresponding to the vertebrae cervicales VII and the portion corresponding to vertebrae thoracicae III of the human body (8), extends to the directions of the right and left shoulders 19, and is overlapped with a part of the portion having a strong straining force 32; and a portion having a strong straining force <<e>> comprising a portion having a strong straining force 44 extending, in the front part of the shirt, from the portion that is located slightly near to the front center from the acromion 1 and at the edge of the vicinity of the acromion side of the upper region of the trapezius muscle of the human body 2 towards the axilla 17 while curving slightly toward the front center of the human body is further provided.

In this embodiment, in addition to the effect of the embodiment shown in FIGS. 1 to 3, the portion having a strong straining force 34, extending from the vicinity of the portion corresponding to the muscles deltoideus distalis 6 to the direction of the edge of the sleeve along the upper sleeve surface reinforces the effect of <<b-1>>. The stress is applied in a way that holds the humeral head (the upper edge of the humerus) up in the direction of the scapula (in a way the humeral head is fitted to the normal position of the glenoidal cavity) such that the stress in the direction of holding up the arms is more enhanced and thereby further reducing load to the shoulder. Moreover, <<d>> sandwiches the shoulder joint (the gleno-humeral joint) from the front and back sides with the acromion 1 as a starting point. Thus, the shoulder joint can be supported from many directions at the same time. Additionally, the effect of <<b-1>> is further supplemented and reinforced, and the load to the shoulder due to weight of the arm can be reduced. In addition, since the portion having straining force 33 (the stay cloth) is further provided, the effect of the portion having a strong straining force <<b-1>> can be further supplemented and reinforced, and the load to the shoulder due to weight of the arm can be reduced. Moreover, since the portion having a strong straining force <<e>> is further provided, the effect of the portion having a strong straining force <<a>> and the supporting effect of the portion having a strong straining force <<b-1>> is supplemented.

Figure 10:
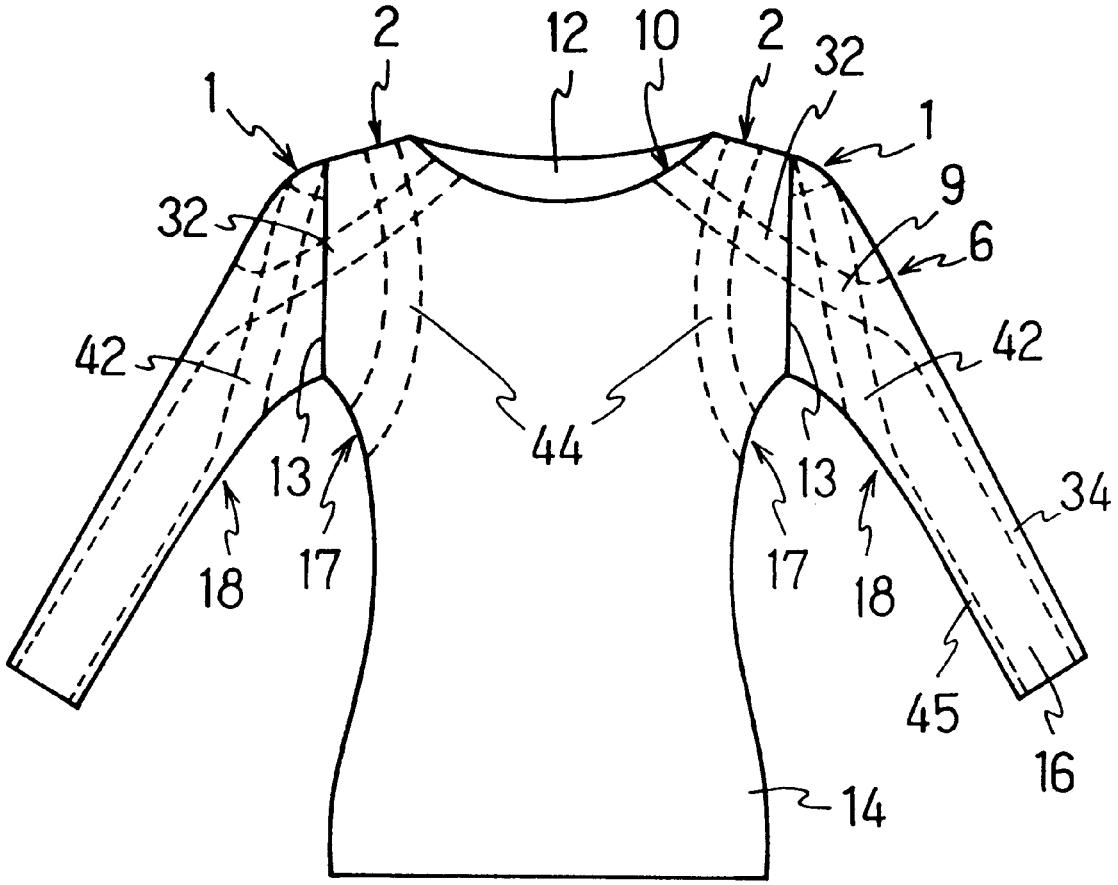
FIG. 10 is a front view showing a long-sleeved shirt of a further embodiment of the shoulder and arm support garment of the present invention.
Figure 11:
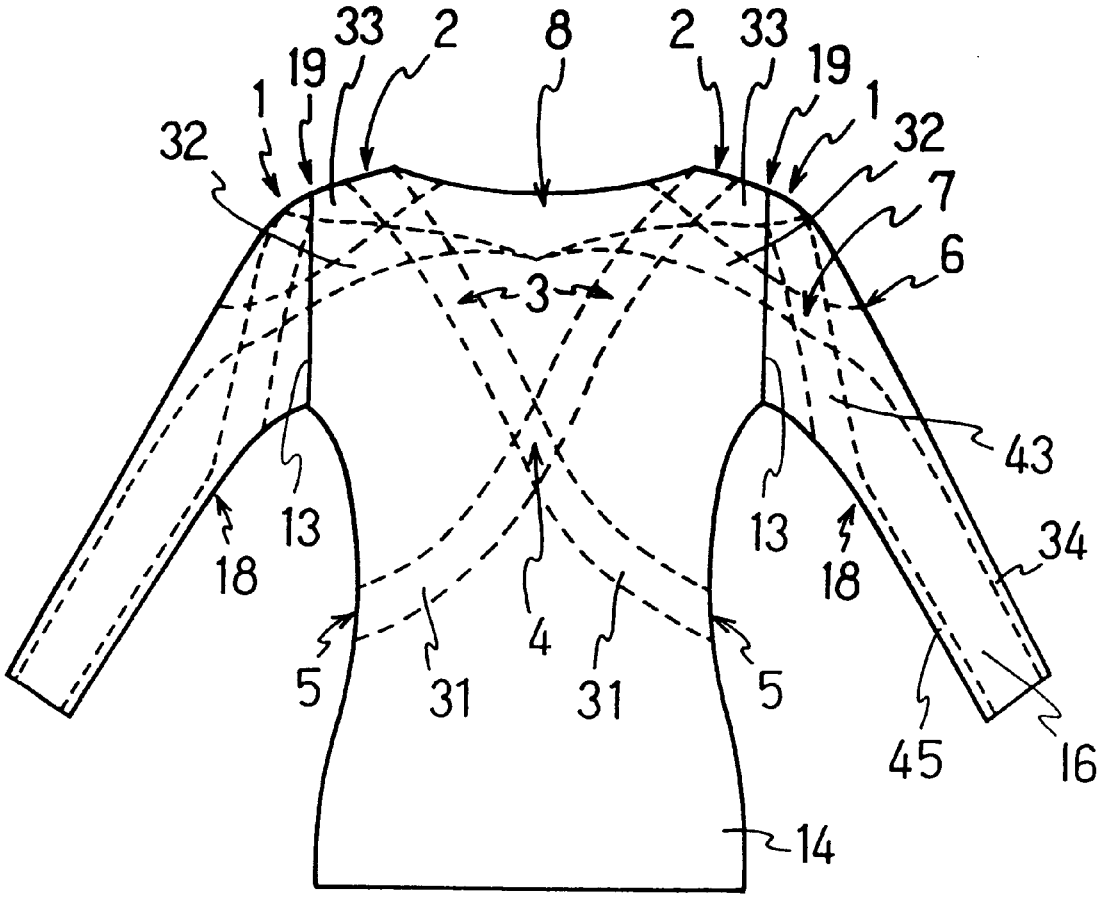
FIG. 11 is a rear view of the shirt shown in FIG. 10.
Figure 12:
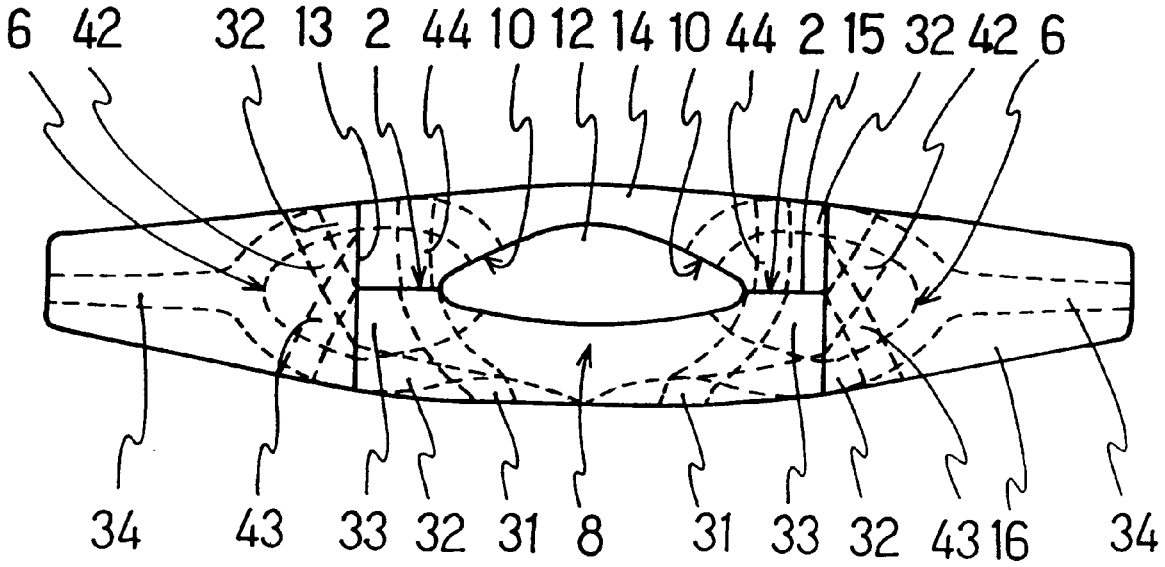
FIG. 12 is a plan view of the shirt shown in FIG.10 and FIG. 11.

Next, FIGS. 10 to 12 show further embodiment of the shirt of the present invention. FIG. 10 is a front view of the shirt; FIG. 11 is a rear view; and FIG. 12 is a plan view. The difference between this embodiment and the embodiment shown in FIGS. 7 to 9 is: this embodiment further has the portion having a strong straining force 45 which extends from the vicinity of the body side of the upper arm at the portion having a minimum circumference 18 of the portion having a strong straining force <<d>>, comprising the portions having a strong straining force 42 and 43, in the direction of the edge of the sleeve along the lower surface of the sleeve.

By such an embodiment, the same effect as the shirt of the embodiments of the above mentioned FIGS. 7 to 9 is seen. Additionally, in a case where the shirt has the portion having a strong straining force 34 it is preferable that the portion having a strong straining force 45 is provided. Because by further providing the portion having a strong straining force 45 in the lower side of the sleeve, the stretchable power of the fabric of the upper sleeve side and the fabric of the lower sleeve side can be balanced and distortion can be inhibited.

Figure 55:
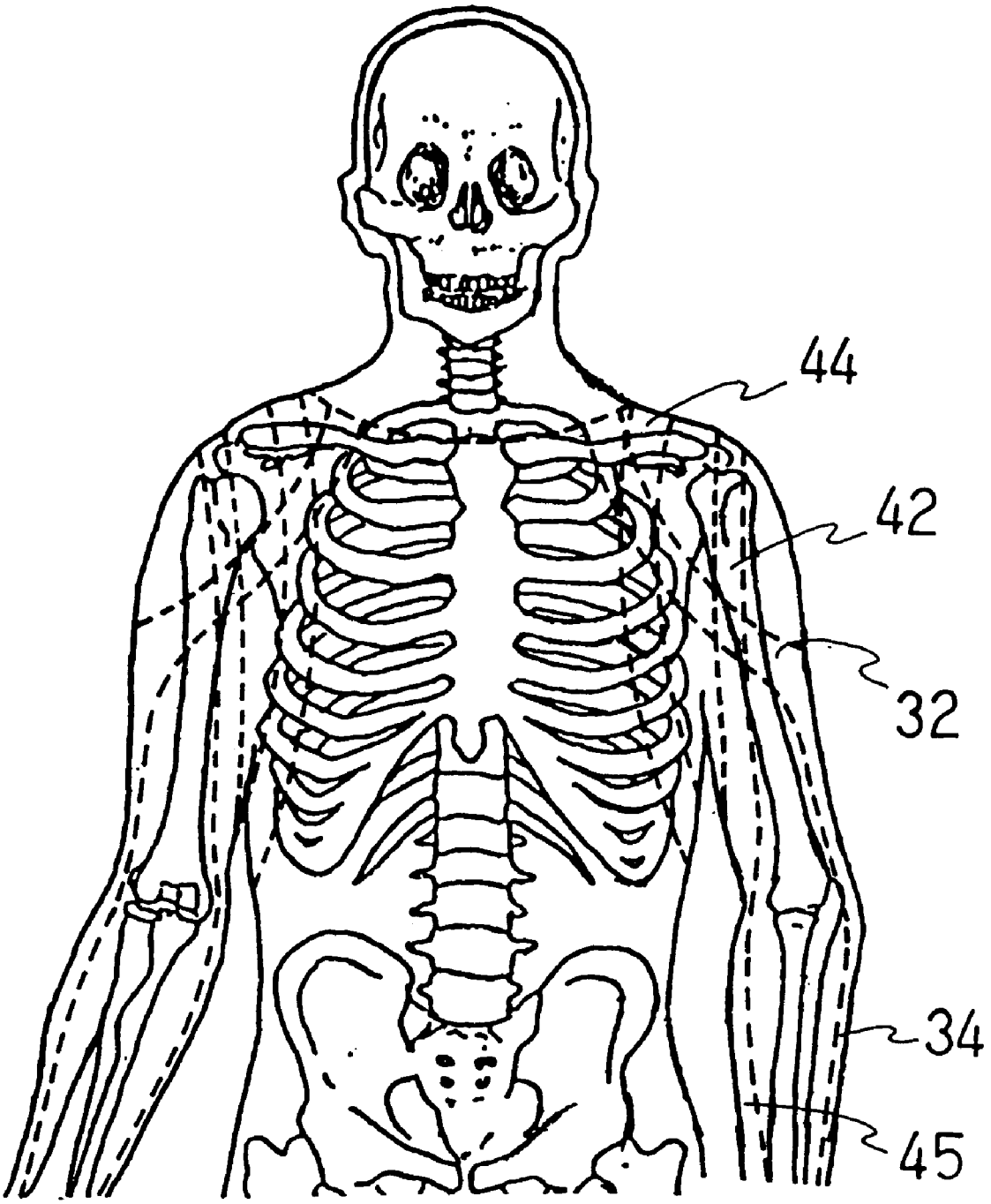
FIG. 55 is a front view showing the state in use for the long-sleeved shirt shown in FIG. 10 to FIG. 12 overlapped on the skeleton chart of the human body.
Figure 56:
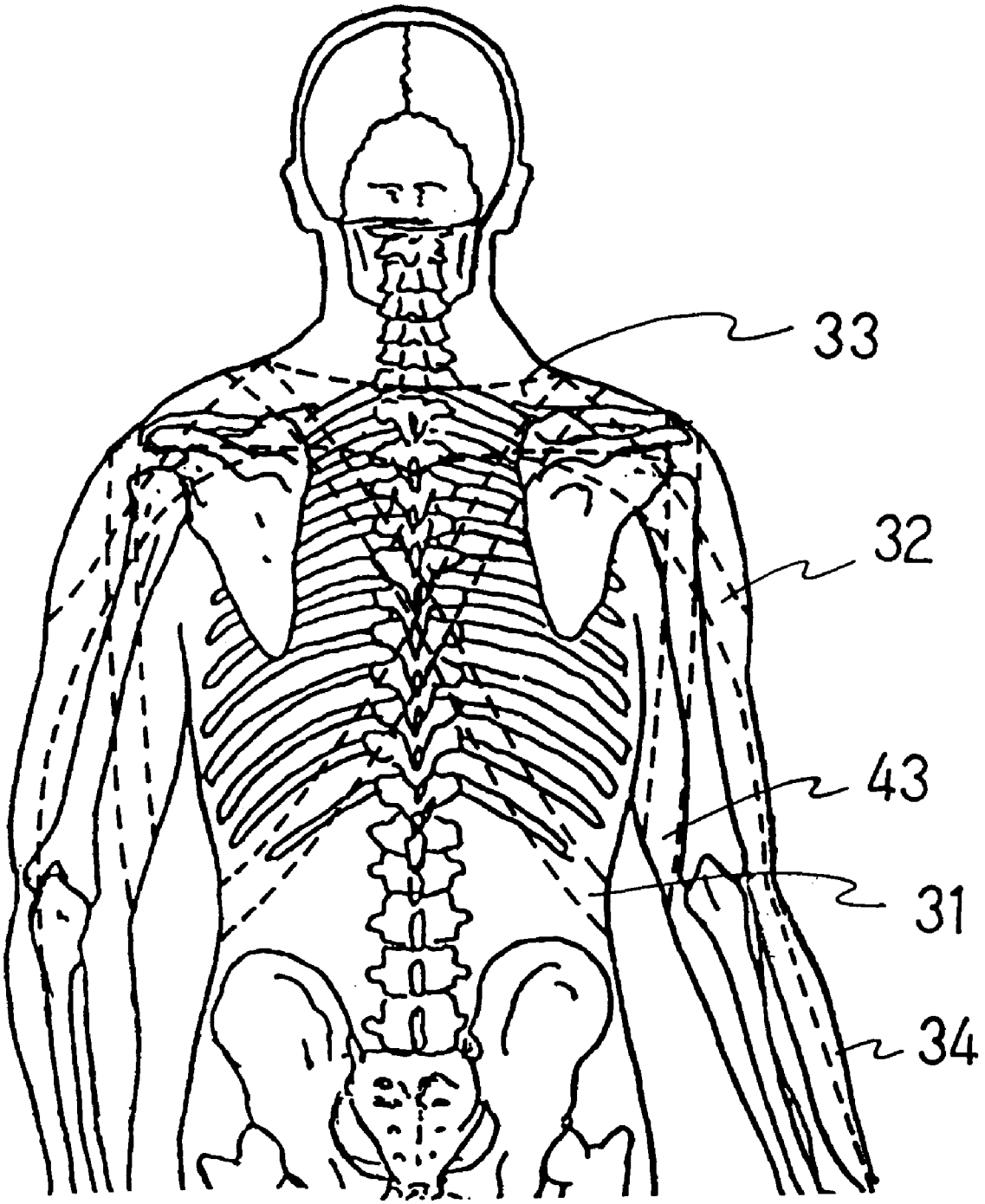
FIG. 56 is a rear view showing the state in use for the long-sleeved shirt shown in FIG. 10 to FIG. 12 overlapped on the skeleton chart of the human body.

Moreover, for an ease of understanding, FIGS. 55 and 56 show the views in which a front view and rear view of the long-sleeved shirt shown in FIGS. 10 to 12 in use are overlapped onto the skeleton charts of the human bones.

Figure 13:
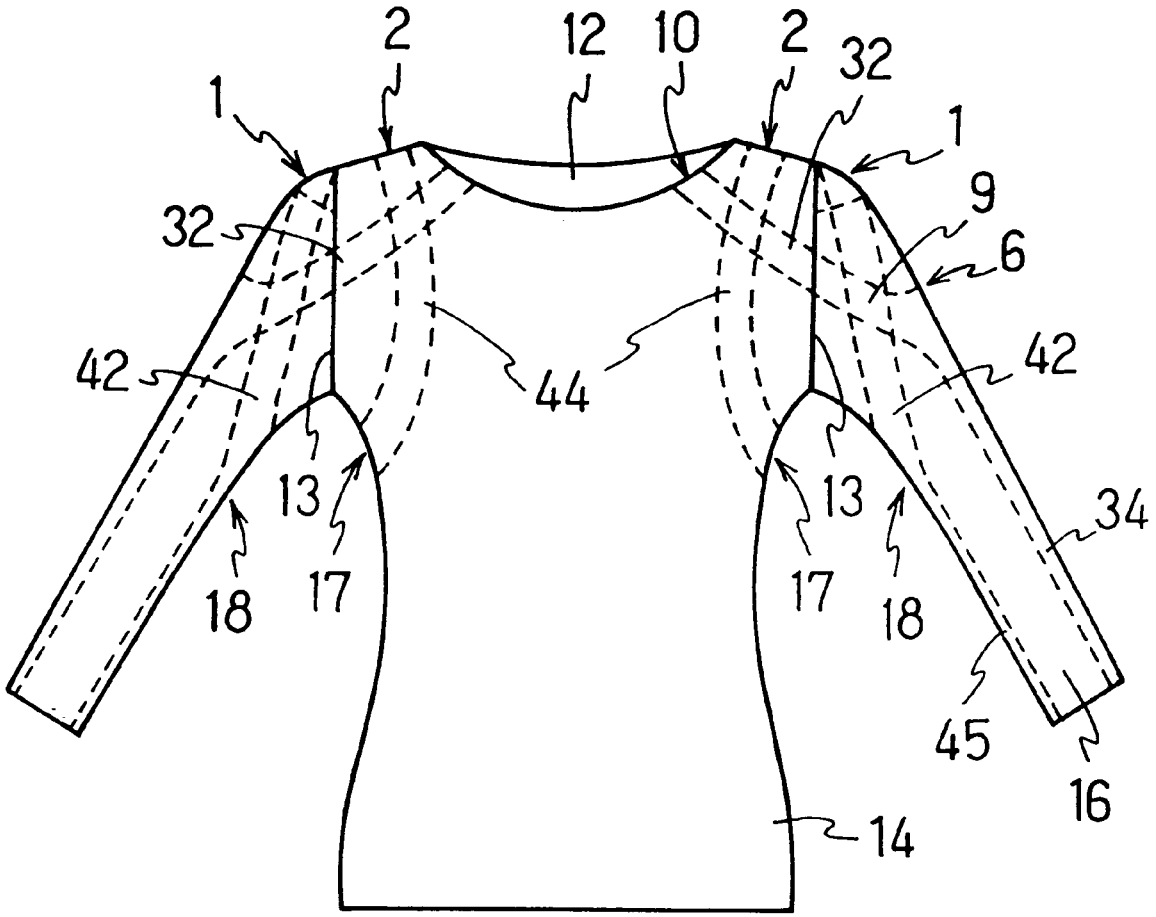
FIG. 13 is a front view showing a long-sleeved shirt of a further embodiment of the shoulder and arm support garment of the present invention.
Figure 14:
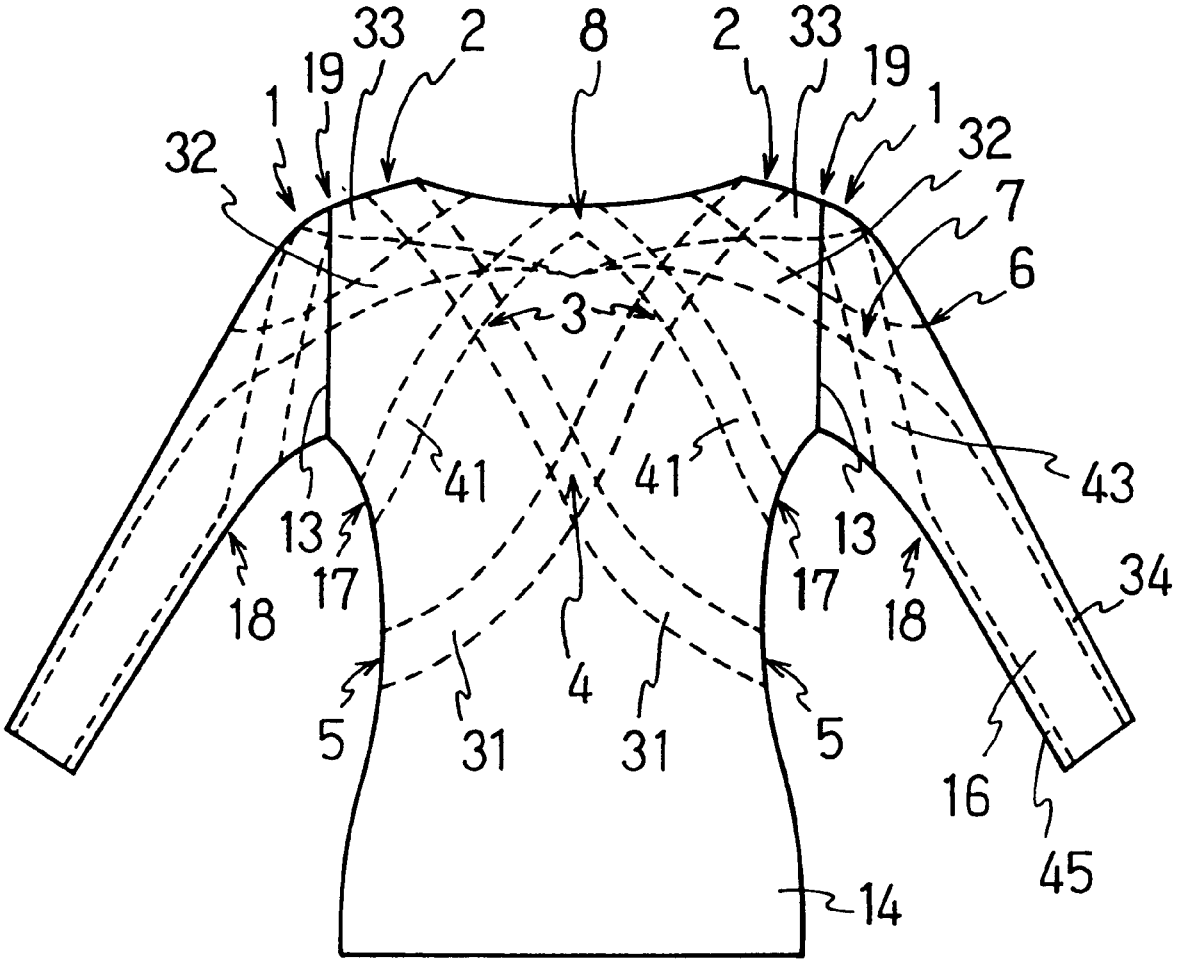
FIG. 14 is a rear view of the shirt shown in FIG. 13.
Figure 15:
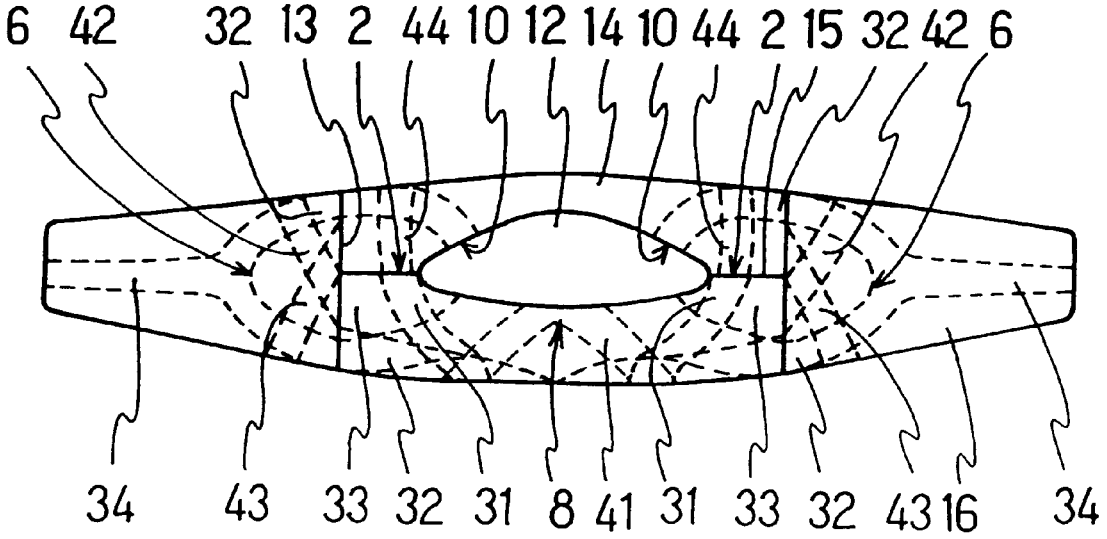
FIG. 15 is a plan view of the shirt shown in FIGS. 13 and 14.

Next, FIGS. 13 to 15 show a shirt of one embodiment of the shoulder and arm support garment of the present invention. FIG. 13 is a front view of the shirt; FIG. 14 is a rear view; and FIG. 15 is a plan view. The difference between this embodiment and that shown in FIGS. 10 to 12 is: in this embodiment, the portion having a strong straining force <<c>> is further provided, comprising the portion having a strong straining force 41 which, in the back part of the garment, ranges from the location between the portion corresponding to the vertebrae cervicales VII and the portion corresponding to the vertebrae thoracicae III of the human body to the axilla 17 by way of the vicinity of angulus superior scapulae 3.

By such an embodiment, the same effect as the long-sleeved shirts shown in FIGS. 10 to 12 can be exhibited. Furthermore, it is preferable that the portion having a strong straining force <<c>> can compress the angulus superior scapulae and supplement the effect of the portion having a strong straining force <<a>> of strongly fitting the scapula to behind the thorax, and thereby the effect of the portion having a strong straining force <<a>> can be reinforced.

Moreover, the embodiments shown in FIGS. 13 to 15 are embodiments in which the portion having a strong straining force <<c>> <<d>>, and <<e>> or the like are added in addition to the portion having a strong straining force <<a>> and <<b-1>>. As to portions other than those having a strong straining force <<a>> and <<b-1>>, that is, as to the portion having a strong straining force <<c>>, <<d>>, and <<e>> etc., one of them or the combination of the two of them may be added. Moreover, needless to say, instead of the portion having a strong straining force <<b-1>>, the portion having a strong straining force <<b-2>> can be employed. This also is true in the below mentioned embodiments.

Figure 16:
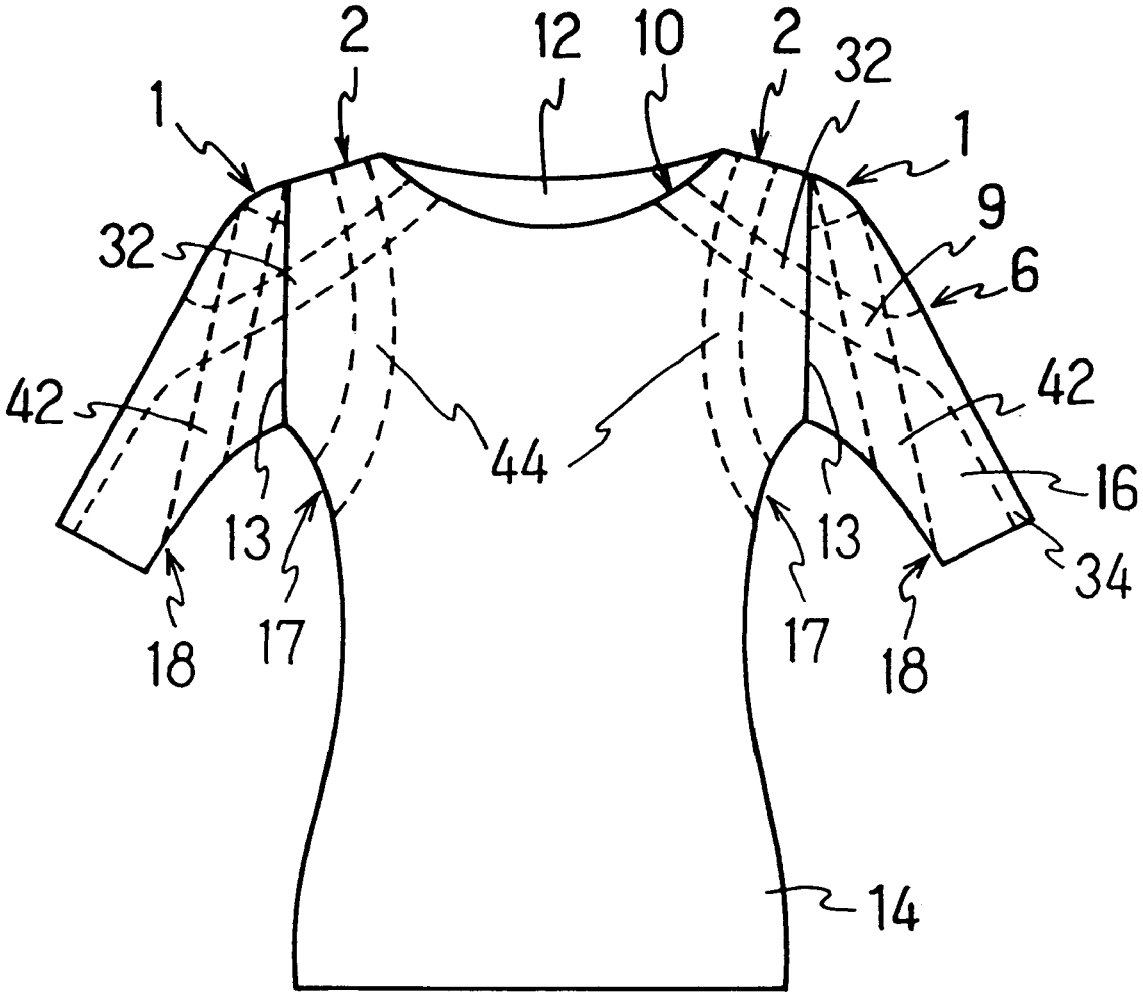
FIG. 16 is a front view showing a short-sleeved shirt of this embodiment of the shoulder and arm support garment of the present invention.
Figure 17:
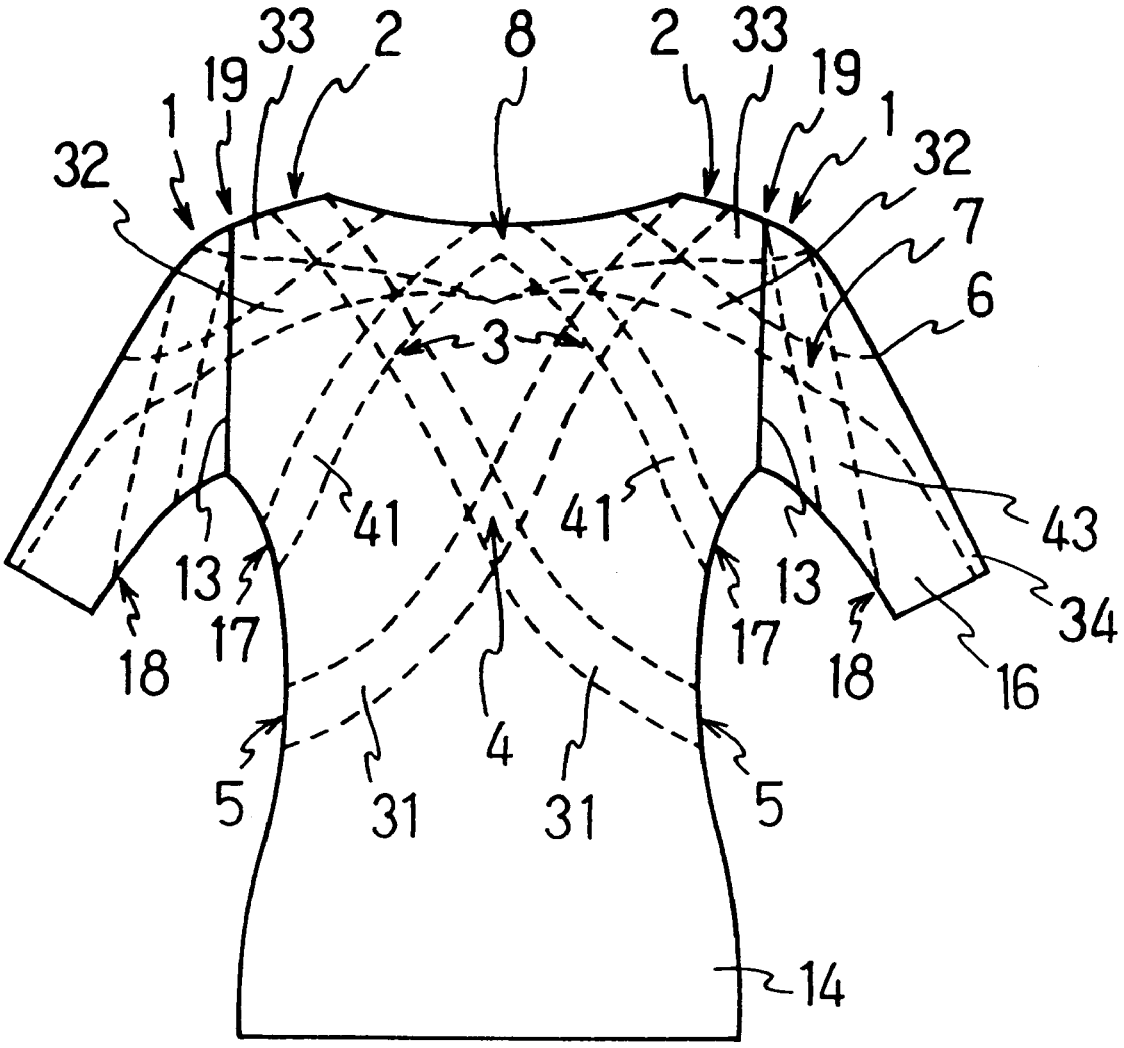
FIG. 17 is a rear view showing a short-sleeved shirt of this embodiment of the shoulder and arm support garment of the present invention.
Figure 18:
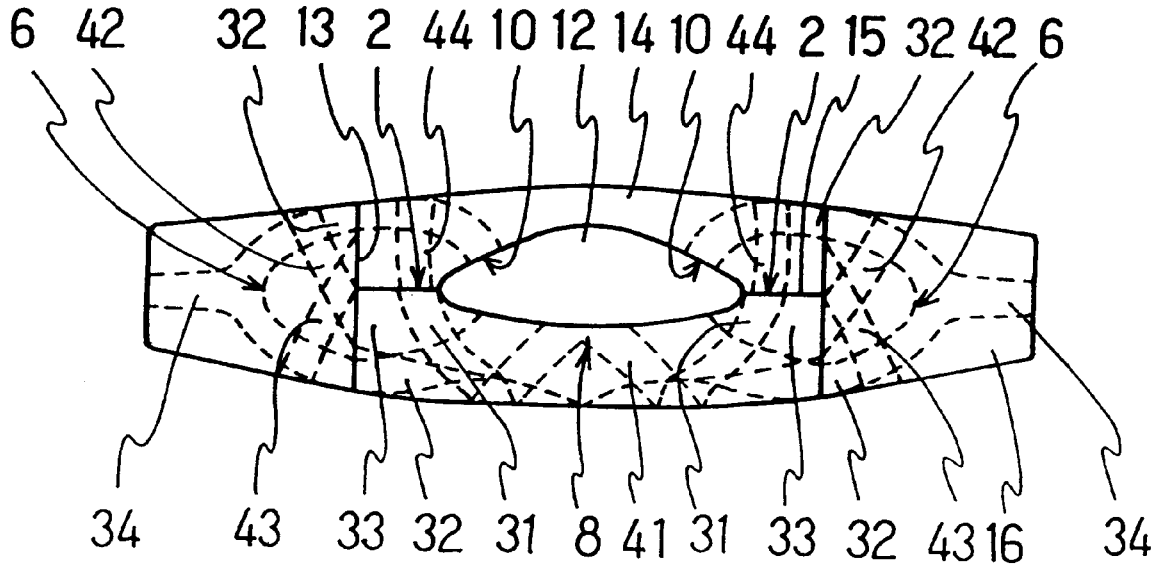
FIG. 18 is a plan view showing a short-sleeved shirt of this embodiment of the shoulder and arm support garment of the present invention.

Next, FIGS. 16 to 18 show a further embodiment of a short-sleeved shirt as one embodiment of the shoulder and arm support garment of the present invention. FIG. 16 is a front view when the shirt is viewed from the front side; FIG. 17 is a rear view; and FIG. 18 is a plan view. The difference between this embodiment and the embodiment shown by FIGS. 13 to 15 is: in this embodiment, the sleeves are short. Other portions are basically the same as the shirt shown in FIGS. 13 to 15. Therefore, the same numbers are given to the same portions as in FIGS. 13 to 15, and the detailed explanations are omitted herein because they are repetitive.

In the short-sleeved shirt shown in FIGS. 16 to 18, the shoulder and arm support garment having the same effects as mentioned above can be provided.

Figure 19:
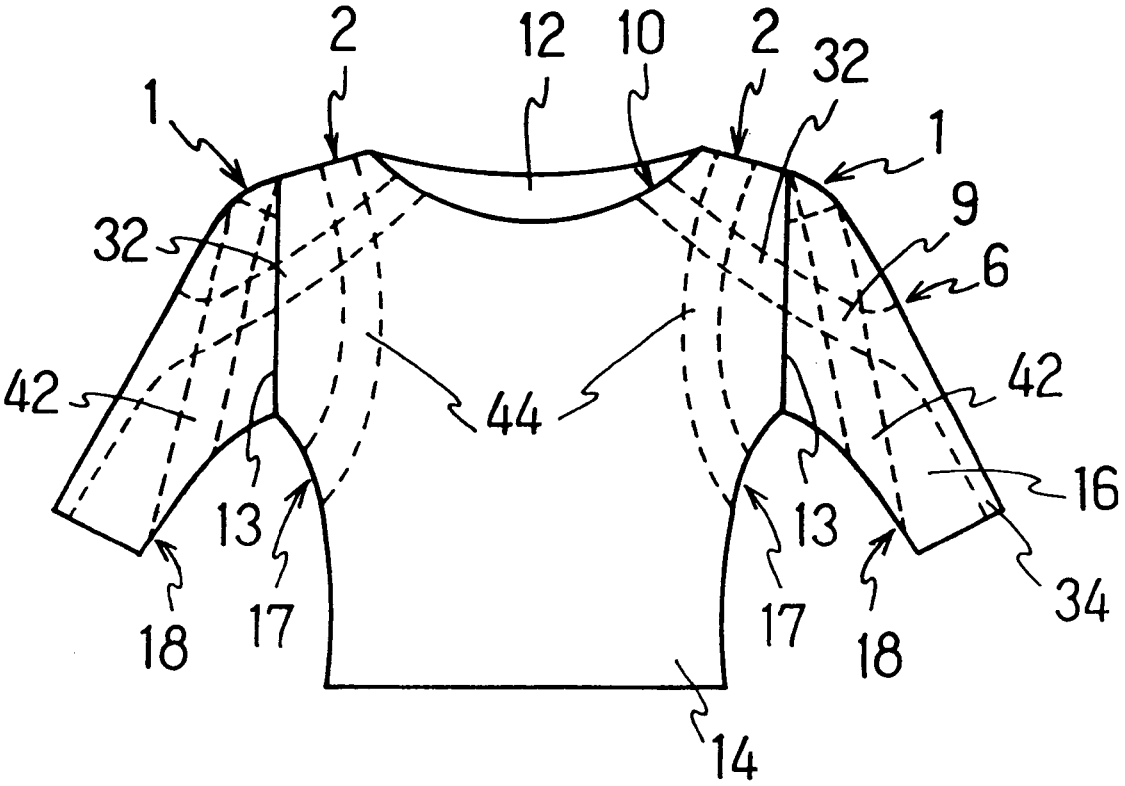
FIG. 19 is a front view showing a short-sleeved shirt of another embodiment of the shoulder and arm support garment of the present invention.
Figure 20:
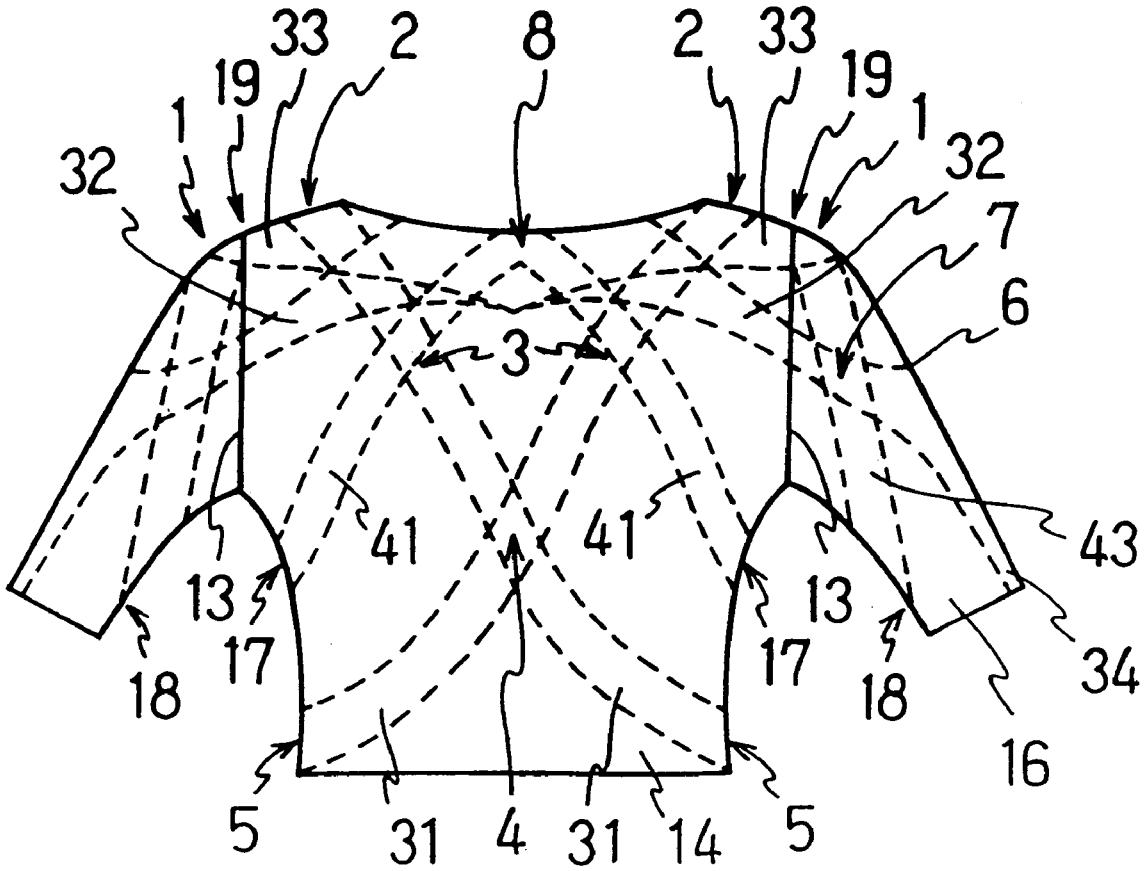
FIG. 20 is a rear view showing a short-sleeved shirt of this embodiment of the shoulder and arm support garment of the present invention.

Next, FIGS. 19 to 20 show a further embodiment of a short-sleeved shirt having a short length body part as one embodiment of the shoulder and arm support garment of the present invention. FIG. 19 is a front view when the shirt is viewed from the front side; and FIG. 20 is a rear view. The plan view when the shirt is viewed from the top is the same as FIG.18, and so it is omitted herein. The only difference between this embodiment and the embodiment shown by FIGS. 13 to 15 is: in this embodiment, the length of the sleeves and body part are short. Other portions are basically the same as the shirt shown in FIGS. 13 to 15. Therefore, the same numbers are given to the same portions as in FIGS. 13 to 15, and the detailed explanations are omitted herein because they are repetitive.

In the short-sleeved shirt shown in FIGS. 19 to 20, the shoulder and arm support garment having the same effects as mentioned above can be provided.

Figure 21:
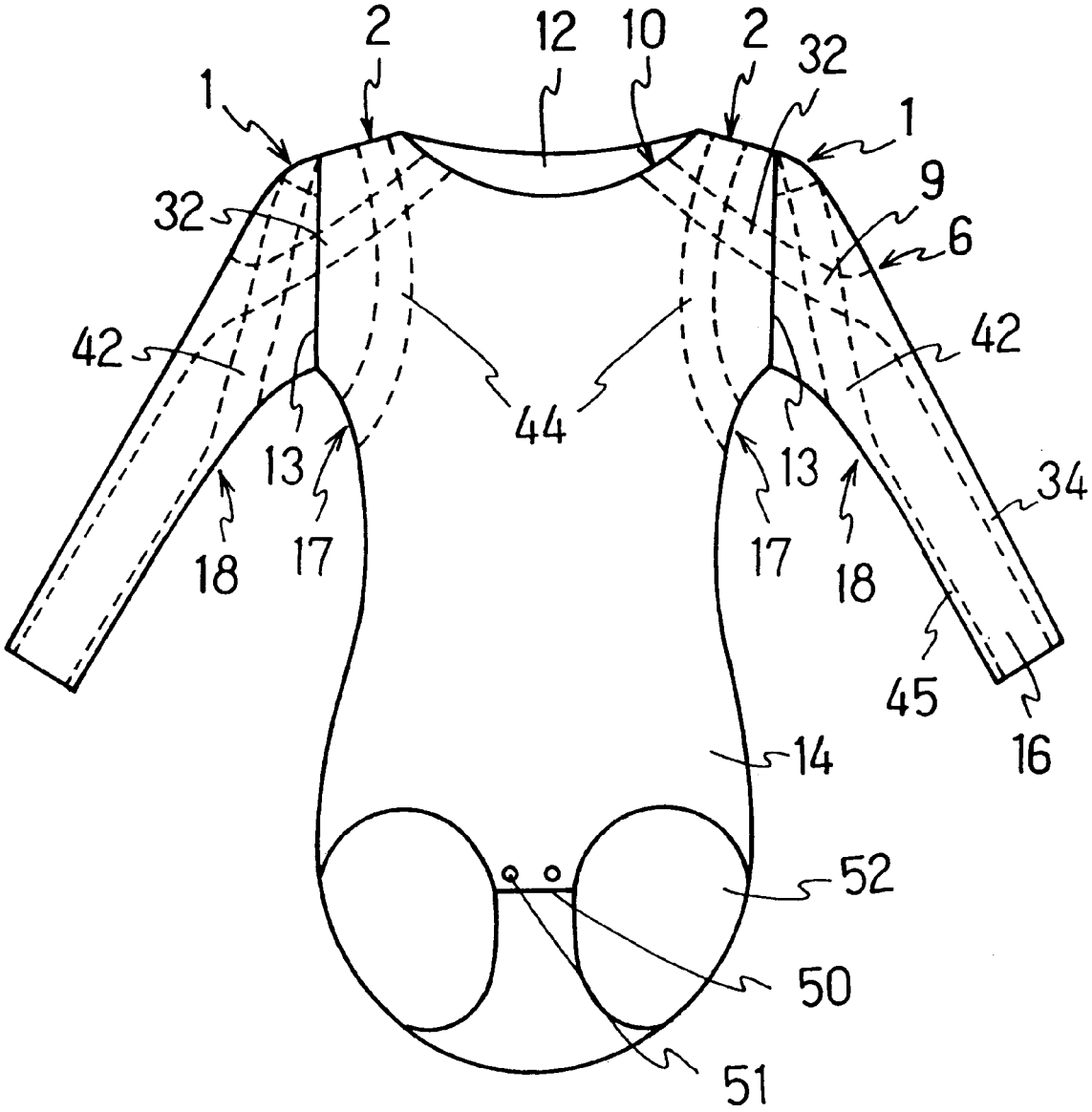
FIG. 21 is a front view showing a long-sleeved shirt having a crotch piece of one embodiment of the shoulder and arm support garment of the present invention.
Figure 22:
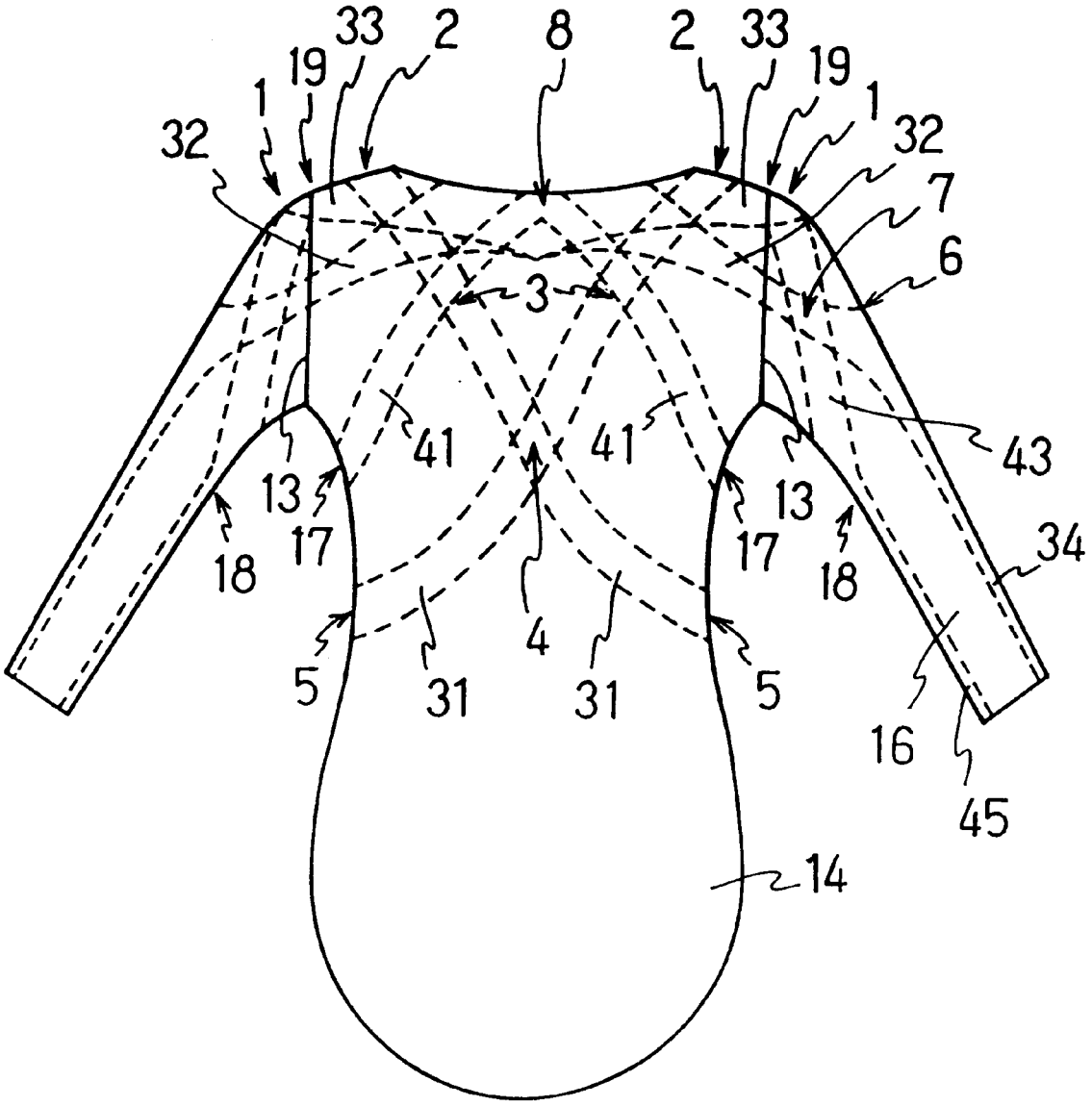
FIG. 22 is a rear view showing a long-sleeved shirt having a crotch piece of this embodiment of the shoulder and arm support garment of the present invention.

Next, FIGS. 21 to 22 show a long-sleeved shirt having a crotch portion as one embodiment of the present invention. FIG. 21 is a front view when the shirt is viewed from the front side; and FIG. 22 is a rear view. The plan view in which the shirt is viewed from the top is the same as FIG. 15, and so it is omitted herein. The difference between this embodiment and the embodiment shown by FIGS. 13 to 15 is: in this embodiment, the length of the shirt is further longer and the shirt has a crotch portion 50 for opening and closing when putting on, and appropriate snaps 51 etc. are provided for keeping the crotch portion closed. Numeral 52 denotes a leg hole. The other portions are basically the same as the shirt shown in FIGS. 13 to 15. Therefore, the same numbers are given to the same portions as in FIGS. 13 to 15, and the detailed explanations are omitted herein because they are repetitive.

In the long-sleeved shirt having a crotch portion shown in FIGS. 21 to 22, the same effects as mentioned above can be provided and furthermore the garment is not dislocated upward in use, even if the user does exercises, thanks to the crotch portion.

Figure 23:
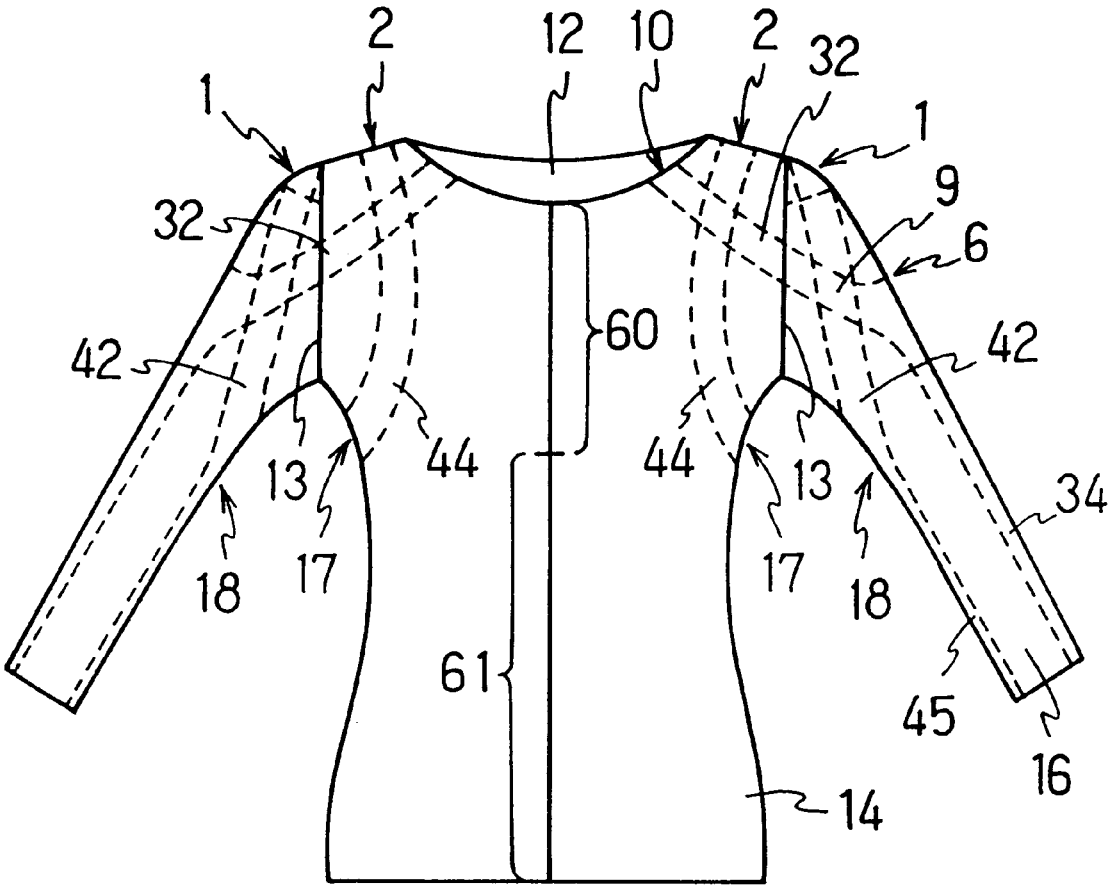
FIG. 23 is a front view showing a front opening type shirt of one embodiment of the shoulder and arm support garment of the present invention.
Figure 24:
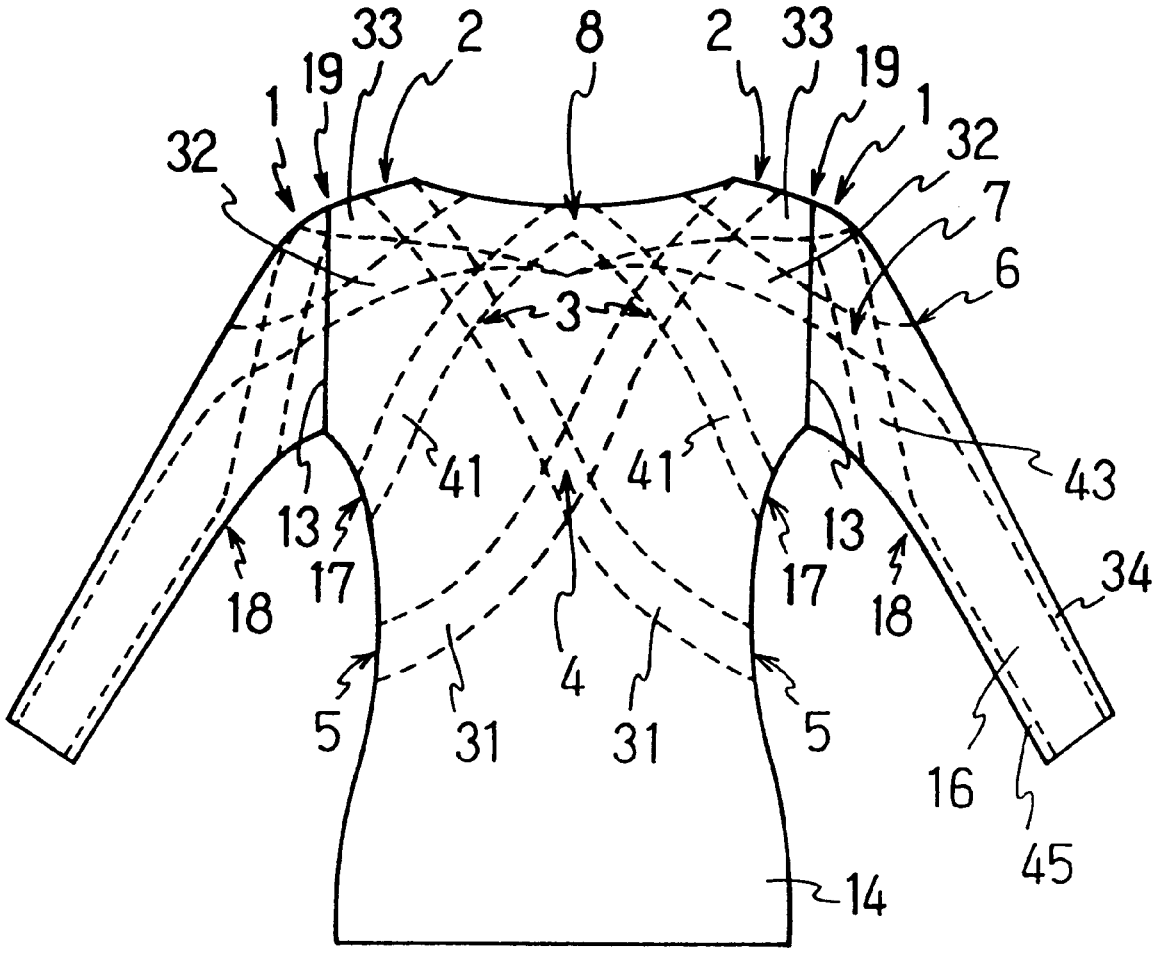
FIG. 24 is a rear view showing a front opening type shirt of this embodiment of the shoulder and arm support garment of the present invention.

Next, FIGS. 23 to 24 show a shirt whose front part can be opened as one embodiment of the shoulder and arm support garment of the present invention. FIG. 23 is a front view when the shirt is viewed from the front side; and FIG. 24 is a rear view. The difference between this embodiment and the embodiment shown by FIGS. 13 to 15 is: in this embodiment, a part of the front part of the shirt can be opened and fastener 60 having a length of about 20 cm is provided downwards from the edge of the side of the front center of the open portion for the neck 12. Numeral 61 denotes the seam portion when the front part is closed. Other portions are basically the same as the shirt shown in FIGS. 13 to 15. Therefore, the same numbers are given to the same portions as in FIGS. 13 to 15, and the detailed explanations are omitted herein because they are repetitive.

In the shirt whose front part can be opened shown in FIGS. 23 to 24, the shoulder and arm support garment can exhibit the same effects as mentioned above and furthermore has the feature that the user can put the garment on and take it off easily because the front part can be opened by using the fastener.

Needless to say, the length of the portion where the fastener is used can be extended to the lower most part of the hem to make the shirt the fully openable type shirt. Moreover, instead of the fastener, a button or snap or the like can be employed.

Figure 25:
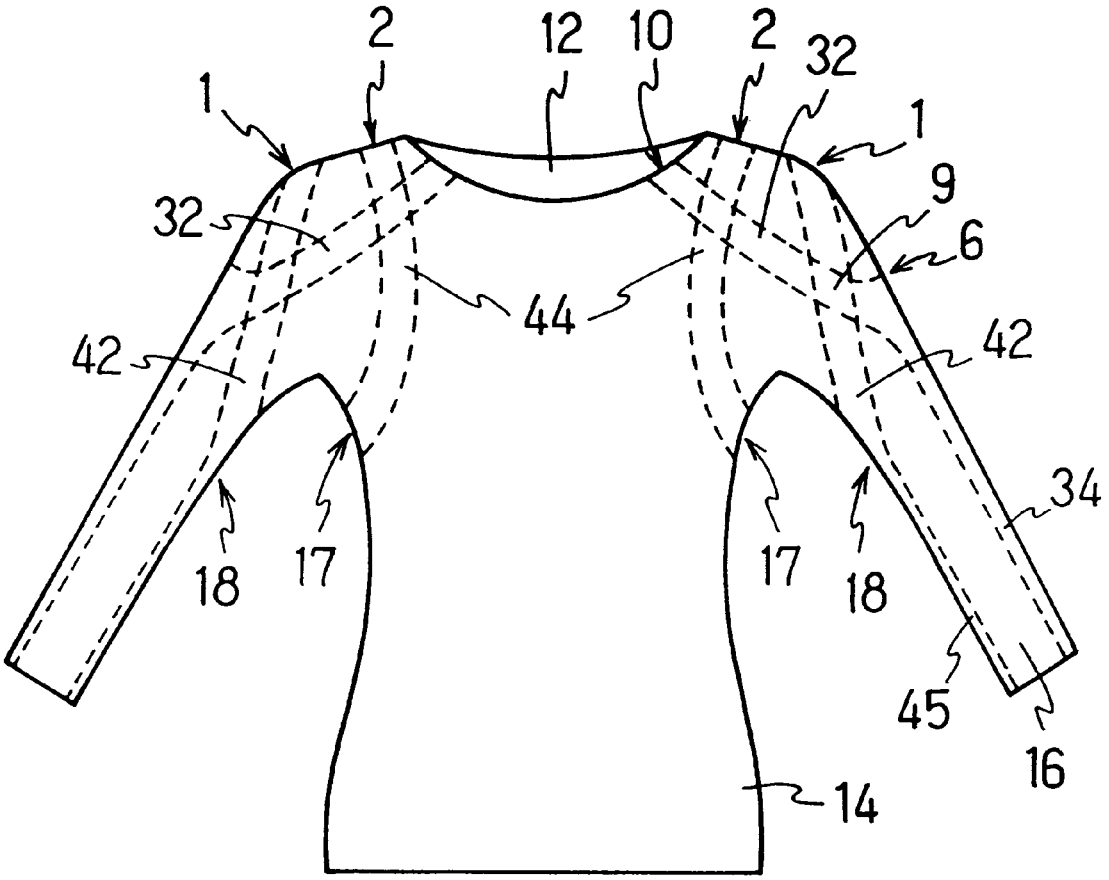
FIG. 25 is a front view showing a dolman sleeve type long-sleeved shirt of one embodiment of the shoulder and arm support garment of the present invention.
Figure 26:
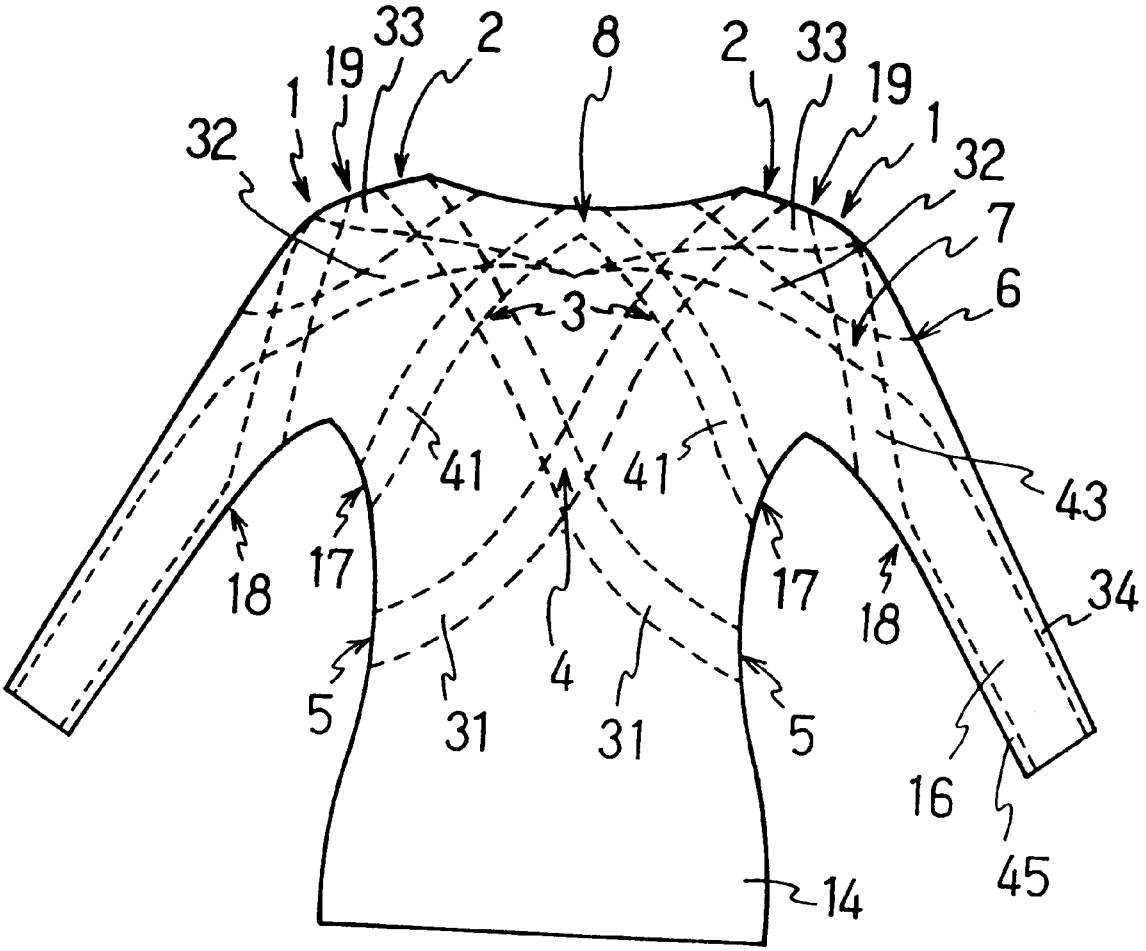
FIG. 26 is a rear view showing a dolman sleeve type long-sleeved shirt of this embodiment of the shoulder and arm support garment of the present invention.

Next, FIGS. 25 to 26 show a dolman sleeve type long-sleeved shirt as one embodiment of the shoulder and arm support garment of the present invention. FIG. 25 is a front view when the shirt is viewed from the front side; and FIG. 26 is a rear view. The shirts shown in FIGS. 13 to 15 are so called set-in type shirt in which the sleeve portion and main part of the shirt are seamed by the seam line 13. On the other hand, in the shirts shown in FIGS. 25 to 26, the garment of the present invention is applied to the dolman sleeve type shirt, and they are substantially the same as the shirts shown in FIGS. 13 to 15. Therefore, the same numbers are given to the same portions as in FIGS. 13 to 15, and the detailed explanations are omitted herein because they are repetitive.

In the dolman sleeve type long-sleeved shirt shown in FIGS. 25 to 26, the shoulder and arm support garment exhibiting the same effects as the shirts disclosed in FIG. 13 to FIG. 15 mentioned above can be provided. Moreover, the garment of the present invention can be applied to a raglan sleeve type shirt, although it is not shown in figure.

Moreover, the embodiments shown in FIGS. 16 to 26 are the embodiments in which all of the portions having a strong straining force, <<a>>, <<b-1>>, <<c>>, <<d>>, <<e>> are provided. However, depending on the purposes, the embodiment in which the portion having a strong straining force <<c>>, <<d>>, and <<e>> are not provided and only <<a>> and <<b-1>> are provided can be employed. Also, the embodiment in which the combination of any one of or two or more of portions having a strong straining force <<c>>, <<d>> and <<e>> are added to the portions having a strong straining force <<a>> and <<b-1>> may be employed. In addition, instead of the portions having a strong straining force <<b-1>>, the portion having a strong straining force <<b-2>> may be employed.

The stretchable fabrics used for the garment main part of the shoulder and arm support garment of the present invention or the stretchable fabric used in a case where the portion having a strong straining force is formed by overlapping the predetermined shaped stretchable fabric by stitching or adhering is not particularly limited. However, power net containing polyurethane fiber that is stretchable rochelle knitted fabric containing polyurethane fiber, two directions stretchable tricot knitted fabric containing polyurethane fiber that is tricot knitted fabric containing polyurethane fiber or circular knitting fabric containing polyurethane fiber can be preferably used. As the types of power net, for example, plain power net, satin-like power net, two directions rochelle, "Torisukin" (the product of Urabe Corporation) etc. can be employed.

In a case where the portion having a strong straining force is formed in a way in which elastic resin is impregnated or elastic resin film is adhered to the predetermined portion of the garment main part, as an elastic resin, appropriate elastic resin such as polyurethane resin or polyester elastomer resin or the like can be used.

All of the portions having a strong straining force are not necessarily the same. If necessary, a different straining force can be applied. Alternately, in one portion having a strong straining force, the straining force can be varied from strong to weak to design a portion having a strong straining force which has different levels of straining force.

(1) The present invention provides a shoulder and arm support garment that is capable of being easily put on and taken off (e.g., when taking a bath, etc.) by ordinary people and, therefore, does not require treatment by the skilled person (as is the case with taping treatment). Furthermore, the garment is effective for promoting the prevention or treatment of disorders, etc. in the shoulder joint or the arm muscles in the vicinity of the shoulder joint by providing a portion having a strong straining force on certain portions of the garment main part wherein the garment main part is capable of covering at least the upper body part and made of stretchable fabric incorporated into the garment; the tightness and looseness of the compression can be obtained by the motion without causing, discomfort. In contrast, the portion where the taping is applied is always subjected to the compression in the case of the taping treatment. As a result, the shoulder and arm support garment of the present invention provides a comfortable feeling in wearing to the user when the user does not move the body due to a small supporting power. On the other hand, it can exhibit the suitable straining force while the user moves the body. Therefore, it provides a good comfortable feeling without making the user feeling pain in use.

Moreover, since the tape is not adhered directly to the skin of the human body as in the case of the taping treatment, the hygienic problems, for example, the occurrence of itch in the skin due to it becoming stuffy, can be improved.

Moreover, the use of excessive numbers of tapes in the taping treatment limits the movement in the joint, so that the taping treatment only protects the damaged and weak portion. The support garment of the present invention can sufficiently protect the weak portion in addition protecting the entire joint.

In addition, the present invention can provide the shoulder and arm support garment that does not deteriorate in appearance, e.g. in proportion in use, and which has a relatively excellent ventilation.

In a preferred embodiment of the shoulder and arm support garment of the present invention, in the right side of the garment, in the front portion, the portion having a strong straining force <<b-1>> or <<b-2>> ends in the vicinity of the upper end portion (10) of the garment between the center-to right front of the garment and the right acromion (1) (the acromion is not included); and in the left side of the garment, the portion having a strong straining force <<b-1>> or <<b-2>> is located in the vicinity of the upper end portion (10) of the garment of between the center-to-left front of the garment and the left acromion (1) (the acromion is not included). It is preferable that the feeling of compression of the front part in use is reduced as compared with the garment in which a long portion having the strong straining force <<b-1>> or <<b-2>> ranges from right or left arm through the center front part of the garment respectively to the opposite side in the vicinity of the upper portion of the garment.

(3) In a preferred embodiment, the shoulder and arm support garment of the present invention further comprises a portion having a strong straining force (34) which extends from the vicinity corresponding to the muscles deltoideus distalis (6) of the portion having a strong straining force <<b-1>> or <<b-2>> in the direction of the edge of the sleeve along the upper surface of the sleeve. Preferably, the effect of the above mentioned portion having straining force <<b-1>> or <<b-2>> is strengthened and the stress is applied in a manner that holds up the humeral head (the upper edge of the humerus) in the direction of the scapula (in a manner that can fit the humeral head in the regular location of the glenoidal cavity). In other words, the stress acts in the direction that holds up the arms so that the load to the shoulder can be reduced.

(4) In the shoulder and arm support garment of the present invention, which a preferred embodiment which further comprises the portion having a strong straining force <<c>> comprising the portion having a strong straining force (41) which, in the back part of the garment, ranges from the location (8) between the portion corresponding to the vertebrae cervicales VII and the portion corresponding to the vertebrae thoracicae III of the human body to the axilla (17) by way of the vicinity of angulus superior scapulae (3). It is preferable that the portion having straining force <<c>> can enhance the compression of the vicinity of the angulus superior scapulae and fitting strongly the scapula to the backside of the thorax together with the effect of the portion having straining force <<a>>.

(5) Also in the shoulder arm support garment of the present invention, which a preferred embodiment which further comprises the portion having a strong straining force <<d>> comprising portions having a strong straining force (42) and (43) which, in the front and back parts of the garment, extend from the acromion (1) obliquely down to the vicinity of the body side of the upper arm at the portion having a minimum circumference (18) and surround the circumference of the upper arm. The portion having a strong straining force <<d>> has a structure in which it starts from the acromion and sandwiches the shoulder joint (the glenohumeral joint) from the front and back sides, so that the portion can support the shoulder joint from many sides at the same time and can exhibit the effect of supporting the function of the shoulder joint, and can supplement and strengthen the effect of the above mentioned portion having a strong straining force <<b-1>> or <<b-2>>. Subsequently, the load to the shoulder due to the weight of the arms can be reduced.

(6) Further in the shoulder and arm support garment of the present invention, a preferred embodiment further comprises a portion having a strong straining force (45) extending from the vicinity of the body side of the upper arm at the portion having a minimum circumference (18) of the portion having a strong straining force <<d>> in the direction of the edge of the sleeve along the lower surface of the sleeve. It is preferable that, in particular, in a case where the shoulder and arm support garment of the present invention comprises the portion having a strong straining force (34) extending from the vicinity of the portion corresponding to the muscles deltoideus distalis (6) of the portion having a strong straining force <<b-1>> or <<b-2>> in the direction of the edge of sleeve along the upper surface of the sleeve to the direction of the edge of the sleeve as mentioned in the above item (3), that the straining force of the fabric of the lower sleeve surface and that of the fabric of the upper sleeve surface can easily be balanced, and the generation of distortion in the sleeve portion can be inhibited.

(7) Further, in the shoulder and arm support garment of the present invention, a preferred embodiment further comprises a portion having a strong straining force <<e>> comprising a portion having a strong straining force (44) extending, in the front part of the garment, from the portion that is located slightly near to the front center from the acromion (1) and at the edge of the vicinity of the acromion side of the upper region of the trapezius muscle of the human body (2) towards the axilla (17) while curving slightly toward the front center of the human body. It is preferable that the portion having a strong straining force <<e>> can exhibit a supplemental function that ensures that the portions having a strong straining force <<a>> and/or <<c>> can exhibit the supplemental functions of the portions having a strong straining force <<b-1>> or <<b-2 >>.

(8) Moreover, in a preferred embodiment of the shoulder and arm support garment of the present invention, the portion having a strong straining force is formed in a way in which a stretchable fabric having a predetermined shape is overlapped with the garment main part by stitching or adhering to provide a garment having durability.

(9) Moreover, in a preferred embodiment of the shoulder and arm support garment of the present invention, the portion having a strong straining force is formed by stretching a stretchable fabric having a predetermined shape and overlapping with the garment main part by stitching or adhering.

(10) Moreover, in a preferred embodiment of the shoulder and arm support garment of the present invention, the portion having a strong straining force is formed by impregnating elastic resin or adhering elastic resin film to the predetermined portion of the garment main part such that a portion having a strong straining force of a relatively thin thickness can be obtained.

(11) Moreover, in a preferred embodiment of the shoulder and arm support garment of the present invention, the portion having a strong straining force is a portion using an elastic fiber having a thicker thickness than that of any other location in the fiber material constituting the garment main part, to obtain a portion having a strong straining force of a relatively thin thickness.

(12) Moreover, in a preferred embodiment of the shoulder and arm support garment of the present invention, the portion having a strong straining force comprises texture of knitted fabric having a stronger straining force than the texture of knitted stretchable fabric constituting the garment main part to obtain a portion having a straining force of a relatively thin thickness.

(13) Moreover, in a preferred embodiment the shoulder and arm support garment of the present invention, the portion having a strong straining force such that has 30 to 400 gf of straining force, the above mentioned effect of the present invention can be exhibited efficiently and the excellent feeling of wearing can be obtained without making the user feel a too strong compression.

(14) Moreover, in a preferred embodiment the shoulder and arm support garment of the present invention, the stretchable fabric is a knitted fabric selected from the group consisting of a two directions stretchable tricot knitted fabric and a power net knitted fabric, as compared with the conventional supporters etc. using the relatively thick pile fabric or neoprene sheet etc. It is preferable that the fabric having such a thickness as used for manufacturing the general garments can be used, and therefore, the shoulder and arm support garment having little deterioration of appearance, for example, in proportion in use; being well fitted to the body; and having excellent ventilation can be provided.

Industrial Applicability

As mentioned above, the shoulder and arm support garment of the present invention is useful to the promotion of the prevention and treatment of disorders in the shoulder joint or, the muscles of the arm in the vicinity of the shoulder joint.

We claim:

1. A shoulder and arm support garment capable of covering at least an upper body part of a human comprising:

a. a front body part having a front upper end portion, a front center, a first front side and a second front side, wherein the first front side and second front side are positioned on opposite sides of the front center;

b. a back body part attached to the front body part and having a back upper end portion, a back center, a first back side and a second back side, wherein the first back side is attached to the first front side and the second back side is attached to the second front side;

c. a first portion having a strong straining force, which in use extends from:

i. a first position between the back center and a first acromion of the human; to ii. a second position near a first lower costa of the human on an opposite side of the back center as the first position, by way of a position near a first angulus superior scapulae of the human; and d. a second portion having a strong straining force, which in use extends from:

i. a third position between the back center and a second acromion of the human on a side opposite the human from the first acromion; to ii. a fourth position near a second lower costa of the human on an opposite side of the back center as the third position, by way of a position near a second angulus superior scapulae of the human on an opposite side of the human as the first angulus superior scapulae.

2. The shoulder and arm support garment of claim 1, further comprising:

a. a third portion having a strong straining force, which in use extends from:

i. a fifth position on the front body part near the front upper end portion between the first acromion of the human and the front center; to ii. a sixth position on the back body part that is near the back upper end portion near vertebrae cervicales VII of the human; to iii. a seventh position that is near the front upper end portion between the second acromion of the human on an opposite side of the human as the first acromion and the front center, wherein the third portion having a strong straining force extends from the fifth position to the sixth position by way of a position near a first muscles deltoideus distalis of the human, from the sixth position to the seventh position by way of a second muscles deltoideus distalis on a side opposite the human from the first muscles deltoideus distalis, and from the second position near vertebrae cervicales VII of the human to a position near vertebrae thoracicae III of the human.

3. The shoulder and arm support garment of claim 2, further comprising a fourth portion having a strong straining force, which in use extends from an eighth position on the first back side of the back body part between the first acromion of the human and the back center to a ninth position on the second back side of the back body part between the second acromion of the human and the back center, and from a position corresponding to vertebrae cervicales VII of the human to a position corresponding to vertebrae thoracicae III of the human.

4. The shoulder and arm support garment of claim 2, further comprising:

a. a first sleeve attached to the first front side and the first back side wherein the first sleeve has an upper surface and the third portion having a strong straining force further extends from the position near the first muscles deltoideus distalis in the direction of the first sleeve along the upper surface of the first sleeve; and b. a second sleeve attached to the second front side and the second back side wherein the second sleeve has an upper surface and the fourth portion having a strong straining force further extends from the position near the second muscles deltoideus distalis in the direction of the second sleeve along the upper surface of the second sleeve.

5. The shoulder and arm support garment of claim 2, further comprising:

a. a first sleeve attached to the first front side and the first back side, wherein the first sleeve includes a first sleeve lower surface;

b. a second sleeve attached to the second front side and the second back side, wherein the second sleeve includes a second sleeve lower surface;

c. a fifth portion having a strong straining force, which in use extends from:

i. a tenth position near the first acromion of the human; to ii. an eleventh position near the first acromion of the human, wherein the fifth portion having a strong straining force extends obliquely downward from the tenth position along a side of a first upper arm of the human near the upper body of the human to a position on the upper arm having a minimum circumference and back up towards the eleventh position, thereby surrounding the circumference of the first upper arm of the human; and d. a sixth portion having a strong straining force, which in use extends from:

i. a twelfth position near the second acromion of the human; to ii. a thirteenth position near the second acromion, wherein the sixth portion having a strong straining force extends obliquely downward from the twelfth position along a side of a second upper arm of the human near the upper body of the human to a position on the upper arm having a minimum circumference and back up towards the thirteenth position, thereby surrounding the circumference of the second upper arm of the human.

6. The garment of claim 5, wherein the fifth portion having a strong straining force further extends from the position on the first upper arm having a minimum circumference in the direction of the first sleeve along the lower surface of the sleeve and the sixth portion having a strong straining force further extends from the position on the second upper arm having a minimum circumference in the direction of the second sleeve along the lower surface of the sleeve.

7. The shoulder and arm support garment of claim 5, further comprising:

a. a seventh portion having a strong straining force, which in use extends from:

i. a fourteenth position near the front upper end portion between the first acromion of the human and the front center; to ii. a fifteenth position between an upper region of a first trapezius muscle of the human and a first axilla of the human;

wherein the seventh portion having a strong straining force curves slightly towards the front center at it extends from the first position to the second position; and b. an eighth portion having a strong straining force, which in use extends from:

i. a sixteenth position near the front upper end portion between the second acromion on an opposite side of the human from the first acromion and the front center; to ii. a seventeenth position between an upper region of a second trapezius muscle on an opposite side of the human from the first trapezius muscle and a second axilla on an opposite side of the human from the first axilla, wherein the eighth portion having a strong straining force curves slightly towards the front center at it extends from the sixteenth position to the seventeenth position.

8. The shoulder and arm support garment of claim 7, further comprising:

a. a ninth portion having a strong straining force, which in use extends from:

i. an eighteenth position near the back upper end portion near vertebrae cervicales VII of the human to a nineteenth position near the first axilla of the human; and ii. the eighteenth position to a twentieth position near a second axilla on an opposite of the human as the first axilla, wherein the ninth portion having a strong straining force extends from the eighteenth position to the nineteenth position by way of the first angulus superior scapulae of the human and extends from the eighteenth position to the twentieth position by way of the second angulus superior scapulae on an opposite side of the human as the first angulus superior scapulae.

9. The shoulder and arm support garment of claim 1, further comprising:

a. a tenth portion having a strong straining force, which in use extends from:

i. a twenty-first position on the first front side of the front body part near the front upper end portion between the first acromion of the human and the front center; to ii. a twenty-second position on the first back side near the back upper end portion between the first acromion of the human and the back center, by way of a position near a first muscles deltoideus distalis of the human; and b. an eleventh portion having a strong straining force, which in use extends from:

i. a twenty-third position on the second front side of the front body part near the front upper end portion between the second acromion of the human and the front center; to ii. a twenty-fourth position on the second back side near the back upper end portion between the second acromion and the back center, by way of a position near a second muscles deltoideus distalis of the human on an opposite side of the human as the first muscles deltoideus distalis.

10. The shoulder and arm support garment of claim 9, further comprising a twelfth portion having a strong straining force, which in use extends from a twenty-fifth position on the first back side of the back body part between the first acromion of the human and the back center to a twenty-sixth position on the second back side of the back body part between the second acromion of the human and the back center, wherein the twelfth portion having a strong straining force further extends from a position corresponding to vertebrae cervicales VII of the human to a position corresponding to vertebrae thoracicae III of the human.

11. The garment of claim 1, wherein the garment is made of a stretchable fabric.

12. The shoulder and arm support garment of claim 1, wherein at least one of the first and second portions having a strong straining force are formed by stitching or adhering a stretchable fabric having a predetermined shape to the garment.

13. The shoulder and arm support garment of claim 3, wherein at least one of the first and second portions having a strong straining force are stretched prior to being stitched or adhered to the garment.

14. The shoulder and arm support garment of claim 1, wherein at least one of the first and second portions having a strong straining force are formed by adhering an impregnated elastic resin or an elastic resin film to the garment.

15. The shoulder and arm support garment of claim 1, wherein at least one of the first and second portions having a strong straining force include an elastic fiber that is thicker than any other fiber material of the garment.

16. The shoulder and arm support garment of claim 1, wherein the garment and at least one of the first and second portions having a strong straining force comprise a knitted fabric.

17. The shoulder and arm support garment of claim 16, wherein the knitted fabric is selected from the group consisting of a stretchable tricot knitted fabric and a power net knitted fabric.

18. The shoulder and arm support garment of claim 1, wherein at least one of the first and second portions having a strong straining force have a straining force of 30 to 400 gf.

19. A shoulder and arm support garment capable of covering at least an upper body part of a human comprising:

a. a front body part having a front upper end portion, a front center, a first front side and a second front side, wherein the first front side and second front side are positioned on opposite sides of the front center;

b. a back body part having a back upper end portion, wherein the back body part is attached to the front body part and includes a first back side and a second back side, wherein the first back side is attached to the first front side and the second back side is attached to the second front side; and c. a portion having a strong straining force, which in use extends from:

i. a first position on the front body part near the front upper end portion between a first acromion of the human and the front center; to ii. a second position on the back body part that is near the back upper end portion near vertebrae cervicales VII of the human; to iii. a third position that is near the front upper end portion between a second acromion of the human on an opposite side of the human as the first acromion and the front center, by way of a position near a first muscles deltoideus distalis of the human, from the second position to the third position by way of a second muscles deltoideus distalis on a side opposite the human from the first muscles deltoideus distalis, and from the second position near vertebrae cervicales VII of the human to a position near vertebrae thoracicae III of the human.

20. The shoulder and arm support garment of claim 19, further comprising a second portion having a strong straining force, which in use extends from a fourth position on the first back side of the back body part between the first acromion of the human and the back center to a fifth position on the second back side of the back body part between the second acromion of the human and the back center, wherein the second portion having a strong straining force further extends from a position corresponding to vertebrae cervicales VII of the human to a position corresponding to vertebrae thoracicae III of the human.

21. A shoulder and arm support garment capable of covering at least an upper body part of a human comprising:

a. a front body part having a front upper end portion, a front center, a first front side and a second front side, wherein the first front side and the second front side are positioned on opposite sides of the front center;

b. a back body part attached to the front body part and having a back upper end portion, a back center, a first back side and a second back side, wherein the first back side is attached to the first front side and the second back side is attached to the second front side;

c. a first portion having a strong straining force, which in use extends from:

i. a first position on the first front side of the front body part near the front upper end portion between a first acromion of the human and the front center; to ii. a second position on the first back side near the back upper end portion between the first acromion of the human and the back center, by way of a position near a first muscles deltoideus distalis of the human; and d. a second portion having a strong straining force, which in use force extends from:

i. a third position on the second front side of the front body part near the front upper end portion between a second acromion of the human on an opposite side of the human as the first acromion and the front center; to ii. a fourth position on the second back side near the back upper end portion between the second acromion and the back center, by way of a position near a second muscles deltoideus distalis of the human on an opposite side of the human as the first muscles deltoideus distalis.

22. The shoulder and arm support garment of claim 21, further comprising a third portion having a strong straining force, which in use extends from a fifth position on the first back side of the back body part between the first acromion of the human and the back center to a sixth position on the second back side of the back body part between the second acromion of the human and the back center, wherein the third portion having a strong straining force further extends from a position corresponding to vertebrae cervicales VII of the human to a position corresponding to vertebrae thoracicae III of the human.

23. The shoulder and arm support garment of claim 22, wherein the garment further comprises:

a. a first sleeve attached to the first front side and the first back side, wherein the first sleeve has an upper surface and the first portion having a strong straining force further extends from the position near the first muscles deltoideus distalis in the direction of the first sleeve along the upper surface of the first sleeve; and b. a second sleeve attached to the second front side and the second back side, wherein the second sleeve has an upper surface and the second portion having a strong straining force further extends from the position near the second muscles deltoideus distalis in the direction of the second sleeve along the upper surface of the second sleeve.

24. A shoulder and arm support garment capable of covering at least an upper body part of a human comprising:

a. a front body part;

b. a back body part attached to the front body part and having a back upper end portion, a back center, a first back side and a second back side, wherein the first back side and second back side are positioned on opposite sides of the back center; and c. a portion having a strong straining force, which in use extends from:

i. a first position near the back upper end portion near vertebrae cervicales VII of the human to a second position near a first axilla of the human; and ii. the first position to a third position near a second axilla on an opposite of the human as the first axilla, wherein the portion having a strong straining force extends from the first position to the second position by way of a first angulus superior scapulae of the human and extends from the first position to the third position by way of a second angulus superior scapulae on an opposite side of the human as the first angulus superior scapulae.

25. A shoulder and arm support garment capable of covering at least an upper body part of a human comprising:

a. a front body part having a front center, a first front side and a second front side, wherein the first front side and second front side are positioned on opposite sides of the front center;

b. a back body part attached to the front body part and having a back center, a first back side and a second back side, wherein the first back side and second back side are positioned on opposite sides of the back center;

c. a first sleeve having a lower surface wherein the first sleeve is attached to the first front side and the first back side;

d. a second sleeve having a lower surface wherein the second sleeve is attached to the second front side and the second back side;

e. a first portion having a strong straining force, which in use extends from:

i. a first position near a first acromion of the human; to ii. a second position near the first acromion, wherein the first portion having a strong straining force extends obliquely downward from the first position along a side of a first upper arm of the human near the upper body of the human to a position on the upper arm having a minimum circumference and back up towards the second position, thereby surrounding the circumference of the first upper arm of the human; and f. a second portion having a strong straining force, which in use extends from:

i. a third position near a second acromion of the human on an opposite side of the human as the first acromion; to ii. a fourth position near the second acromion, wherein the second portion having a strong straining force extends obliquely downward from the third position along a side of a second upper arm of the human near the upper body of the human to a position on the upper arm having a minimum circumference and back up towards the fourth position, thereby surrounding the circumference of the second upper arm of the human.

26. The garment of claim 25, wherein the first portion having a strong straining force further extends from the position on the first upper arm having a minimum circumference in the direction of the first sleeve along the lower surface of the sleeve and the second portion having a strong straining force further extends from the position on the second upper arm having a minimum circumference in the direction of the second sleeve along the lower surface of the sleeve.

27. A shoulder and arm support garment capable of covering at least an upper body part of a human comprising:

a. a front body part having a front upper end portion, a front center, a first front side, and a second front side, wherein the first front side and second front side are positioned on an opposite side of the front center;

b. a back body part attached to the front body part;

c. a first portion having a strong straining force, which in use extends from:

i. a first position near the front upper end portion between a first acromion of the human and the front center; to ii. a second position between an upper region of a first trapezius muscle of the human and a first axilla of the human;

wherein the first portion having a strong straining force curves slightly towards the front center at it extends from the first position to the second position; and d. a second portion having a strong straining force, which in use extends from:

i. a third position near the front upper end portion between a second acromion on an opposite side of the human from the first acromion and the front center; to ii. a fourth position between an upper region of a second trapezius muscle on an opposite side of the human from the first trapezius and a second axilla on an opposite side of the human from the first axilla, wherein the second portion having a strong straining force curves slightly towards the front center at it extends from the third position to the fourth position.

* * * * *